US011180338B2

(12) United States Patent
Yamada

(10) Patent No.: US 11,180,338 B2
(45) Date of Patent: Nov. 23, 2021

(54) VENEER MOVING APPARATUS

(71) Applicant: Meinan Machinery Works, Inc., Obu (JP)

(72) Inventor: Hidetaka Yamada, Obu (JP)

(73) Assignee: Meinan Machinery Works, Inc., Obu (JP)

( * ) Notice: Subject to any disclaimer, the term of this patent is extended or adjusted under 35 U.S.C. 154(b) by 225 days.

(21) Appl. No.: 16/659,609

(22) Filed: Oct. 22, 2019

(65) Prior Publication Data

US 2020/0130979 A1 Apr. 30, 2020

(30) Foreign Application Priority Data

Oct. 24, 2018 (JP) ..... JP2018-200285
May 20, 2019 (JP) ..... JP2019-094507

(51) Int. Cl.

| | |
|---|---|
| ***B65H 9/08*** | (2006.01) |
| ***B65H 31/14*** | (2006.01) |
| ***B65H 29/12*** | (2006.01) |
| ***B65H 29/14*** | (2006.01) |
| ***B65H 29/22*** | (2006.01) |
| ***B65H 31/02*** | (2006.01) |
| *B65H 9/10* | (2006.01) |

(52) U.S. Cl.

CPC ..... *B65H 31/14* (2013.01); *B65H 29/125* (2013.01); *B65H 29/14* (2013.01); *B65H 29/22* (2013.01); *B65H 31/02* (2013.01); *B65H 9/08* (2013.01); *B65H 9/10* (2013.01); *B65H 9/103* (2013.01); *B65H 2301/4212* (2013.01)

(58) Field of Classification Search

CPC ..... B65H 29/14; B65H 29/22; B65H 29/46; B65H 29/125; B65H 9/08; B65H 9/10; B65H 9/103; B65H 31/02; B65H 31/14; B65H 2301/4212; B65H 2301/4622; B27D 1/10

See application file for complete search history.

(56) References Cited

U.S. PATENT DOCUMENTS 3,274,044 A * 9/1966 Efird ..... B27D 1/10 156/556
4,653,197 A * 3/1987 Koba ..... F26B 13/28 34/397
4,724,877 A * 2/1988 Culley, Jr. ..... B27B 25/02 144/116

(Continued)

FOREIGN PATENT DOCUMENTS

JP S36-296 B 1/1961

*Primary Examiner* — Howard J Sanders
(74) *Attorney, Agent, or Firm* — Locke Lord LLP

(57) ABSTRACT

An apparatus for moving veneer includes a leaf spring having at lower tip end thereof sharpened edges and configured to move a veneer sheet toward its preceding stationary veneer sheet. Further lowering the leaf spring with the tip end already stuck in the veneer sheet causes the leaf spring to be resiliently deformed, which creates a force due to restoring force of the leaf spring that acts on the veneer sheet to move toward the preceding veneer sheet thereby to reduce or eliminate a gap between the two veneer sheets. Additional leaf spring movable with the above leaf spring and configured to hold the preceding veneer sheet during the movement may be provided.

8 Claims, 48 Drawing Sheets

(56) References Cited

U.S. PATENT DOCUMENTS 4,738,533 A * 4/1988 Iwamoto ..... G01N 21/8986
356/237.2
6,247,511 B1 * 6/2001 Maeda ..... B27C 1/04
144/117.1

* cited by examiner

VENEER MOVING APPARATUS

TECHNICAL FIELD

The present invention relates to a veneer moving apparatus for use in joining sheets of veneer peeled by a rotary lathe for manufacturing laminated wood such as plywood, such wood being referred to as product.

BACKGROUND

It has been practiced in the relevant art to join a plurality of discrete veneer sheets, each being short of a desired product length and different in length from one another, successively at straight cut edges extending along the grain direction of veneer into the desired product length. The joining may be accomplished by positioning two adjacent veneer sheets close to each other with as little gap as possible formed therebetween and connecting the veneer sheets together by means of adhesive, adhesive tape, U-shaped staple or any other suitable joining means.

Veneer joining operation may be performed, for example, by using an apparatus, for example, shown in FIG. 1 in a manner as will be described in detail below with reference to relevant drawings. In the veneer joining apparatus, irregularly-shaped opposite edge portions of discrete veneer sheets are cut off to generate straight edges extending in the grain direction of veneer, and any two veneer sheets having such cut edges are set with the adjacent cut edges of the two veneer sheets positioned as close as possible to each other in facing relation. Such veneer sheets are then transferred to a station where they are joined together along the straight cut edges.

For better understanding of the background of the invention, a typical veneer joining apparatus will be described in detail with reference to various drawings. Referring to FIG. 1, reference numeral 101 designates a plurality of veneer feed conveyor belts (only one belt being shown in the drawing) that are disposed along the direction in which veneer sheet such 205 is conveyed and movable to feed the veneer sheet 205 in arrow direction. Numeral 103 designates a rotary shaft, on which an anvil roll 105 is fixedly mounted for rotation with the shaft 103. The rotary shaft 103 is rotatable in synchronism with the movement of veneer feed conveyor belts 101. The anvil roll 105 has formed in the outer periphery thereof a plurality of circumferential grooves 106 spaced in axial direction of the anvil roll 105 and each extending circumferentially for receiving therein the tip end of each deflector 121, which will be described later.

Numeral 107 designates a veneer detecting device, which includes a plurality of veneer detecting rolls 108, for example three rolls, disposed spaced along the axis of the rotary shaft 103 or the axis of rotation the anvil roll 105. Each detecting roll 108 is rotatably mounted to one end of a rod 111 which is swingable about a pivot point 109. The other end of the rod 111 is normally set in contact with a movable part of a normally-closed limit switch 113. The limit switches 113 are arranged in parallel circuit relation to each other. The veneer detecting device 107 is connected to a control 200.

The veneer detecting device 107 is so configured that all the limit switches 113 are on when no veneer sheet is present in contact with the rolls 108, as shown in FIG. 1, and that when any part of a veneer sheet present on the anvil roll 105 pushes any one of the detecting rolls 108 upward at least for a distance corresponding to the thickness of veneer sheet, its corresponding limit switch 113 is turned off. When all the limit switches 113 are turned off, as shown in FIG. 4-2, a leading-edge cut signal, which represents the detection of full thickness of the veneer sheet by all the limit switches 113, is transmitted to a control 200. On the other hand, when at least any one of the limit switches 108 is turned on during the movement of veneer sheet on the anvil roll 105 due to reduction of absence of the veneer thickness, a trailing-edge cut signal is sent to the control 200. Driven rolls that drives the veneer feed conveyor belts 101 and the rotary shaft 103, on which the anvil roll 105 is fixed, are connected to a servo motor 115. Responding to detections signals from the veneer detecting device 107, the control 200 controls the servo motor 115 to operate the feed conveyor belts 101 and the anvil roll 105 for synchronized start and stop operations and also such that the anvil roll 105 rotates at a surface speed corresponding to traveling speed of the veneer feed conveyor belts 101.

Numeral 117 designates a knife blade that is movable reciprocally toward and away from the axis of rotation of the anvil roll 105, as indicated by double-headed arrow, between the retracted position shown in FIG. 1 and the operative cutting position where the cutting edge of the knife blade 117 is moved just in contact with the peripheral surface of the anvil roll 105, as shown in FIG. 5-1. The knife blade 117 is driven to move reciprocally by a servo motor 119 which is connected to and controlled by the control 200.

The aforementioned deflector 121 is provided for each of the grooves 106 of the anvil roll 105. Each deflector 121 is fixedly mounted on a shaft 123 that is driven to rotate by a servo motor 125 to cause the deflector 121 to reciprocally swing, as indicated by double-headed arrow, between the retracted position shown in FIG. 1 and the operative position where the tip end of the deflector 121 is positioned in its corresponding groove 106 of the anvil roll 105.

Numeral 127 designates a hook member that is guided along a groove (not shown) formed in the bottom of the deflector 121 and movable reciprocally in double-headed arrow directions. The hook member 127 has at the tip end thereof a hook portion 127A that is bent toward the anvil roll 105 and at the bottom end thereof a bent portion 127B that is bent in the same direction as the hook portion 127A. The hook member 127 is driven to move reciprocally by an actuator 131 such as motor via a connecting member 129 which has at one end thereof a holding portion 129A connected to and holding the bent portion 127B of the hook member 127.

Numerals 133, 134, 135 designate idle rolls and numeral 137 a driven roll that is driven to rotate by a servo motor 139 having an absolute encoder. Two lower conveyor belts 141 are mounted around the rolls. Specifically, one conveyor belt 114 is mounted around the idle rolls 133, 134, 135, and the other roll 141, which is located downstream of the one conveyor belt, is trained around the idle roll 135 and the driven roll 137. The idle rolls 133, 134, 135, the driven roll 137 and the lower conveyor belts 141 cooperate to constitute one set of veneer transfer conveyor, and a plurality of such sets of veneer transfer conveyor are disposed spaced from one another in the direction that is parallel to the axis of rotation of the anvil roll 105. The respective rolls 133, 134, 135, 137 of the veneer transfer conveyor are mounted on respective common shafts. The servo motor 139 is connected to the control 200.

Similarly, a plurality of other sets of veneer transfer conveyor, each set including idle rolls 143, 145, 147, 149, driven roll 151 and a single upper veneer transfer conveyor belt 153 mounted around the rolls, are disposed above the respective sets of rolls 133, 134, 135, 137. The driven roll 151 is driven to rotate also by the servo motor 139. As shown in FIG. 1, the roll 143 is located adjacent to the roll 133, the roll 145 to the roll 134, the rolls 147, 149 to the roll 135, and the roll 151 to the roll 137, respectively. Each of the upper conveyor belts 153 is disposed in facing relation to its corresponding lower conveyor belt 141.

The lower and upper veneer transferring conveyor belts 141, 153 are spaced vertically to such an extent that a veneer sheet may be held therebetween while being transferred forward, or rightward in FIG. 1. The conveyor belts 141, 153 are driven to move or stopped integrally by the servo motor 139 by way of the driven rollers 137, 151, respectively. When in operation, the conveyor belts 141, 153 are moved at a speed corresponding to the traveling speed of the veneer feed conveyor belts 101 and the surface speed of the anvil roll 105. Additionally, the current position of a veneer sheet being transferred by the conveyor belts 141, 153 is monitored by the servo motor 139 and data of such current position is sent to the control 200.

Referring to FIG. 1, there is provided a movable carriage 155 having mounted therein a plurality of adhesive tape feed devices 160 (only one device being shown in the drawing) that supply adhesive paper tapes 163 for joining veneer sheets at adjacent facing edges thereof in a manner as will be described in detail later. The carriage 155 has a width, or a dimension as measured in the direction parallel to the axis of rotation of the anvil roll 105, that is greater than the dimension of veneer sheet as measured along its grain direction. The carriage 155 is mounted to a movable linear block 156 that is guided by a stationary linear rail 154 so that the carriage 155 is movable linearly in double-headed arrow directions. Numeral 157 designates a screw rod that is inserted through and engaged with a threaded hole 158 formed through the carriage 155, and driven to rotate reversibly, as indicated by double-headed arrow, at a variable speed by a servo motor 159. Rotating the screw rod 157 reversibly causes the carriage 155 to move linearly in double-headed arrow directions. The servo motor 159 has an absolute encoder that monitors the current absolute position of the carriage 155.

The adhesive tape feed devices 160 are disposed in the carriage 155 in such an arrangement that each set of the lower and upper conveyor belts 141, 153 is flanked by two adjacent tape feed devices 160. Each device 160 includes a pair of upper and lower tape reels 161 each storing and supplying the adhesive tape 163 in the form of a strip. The adhesive tape 163 may be made, for example, by coating one side of a continuous paper strip with thermosetting adhesive and then allowing the coated adhesive to be dried under room temperature. Each tape reel 161 is mounted on an idle shaft 162. Numeral 165 designates a pair of upper and lower rolls that are driven to rotate by a servo motor 169 and numeral 167 a pair of upper and lower idle rolls, respectively. Each paired idle and driven rolls 165, 167 cooperate to hold therebetween the adhesive tape 163 while allowing the tape 163 to be fed. Numeral 171 designates a pair of upper and lower tape guides configured to guide the adhesive tapes 163 unwound from the reels 161 toward the opposite surfaces of veneer sheet.

Referring now to FIG. 2, numeral 173 designates a pair of support columns fixed to the carriage 155 on opposite sides thereof. Referring also to FIG. 3, numerals 176, 177 designate a pair of upper and lower actuating plates that are disposed in the carriage 155 and movably mounted to the support columns 173 by way of a linear guide device, respectively. Specifically, the upper actuating plate 176 is fixed to a linear block 181, which is in turn movably mounted to a stationary linear rail 179. Similarly, the lower actuating plate 177 is fixed to a linear block 183, which is in turn movably mounted to a stationary linear rail 180. In such bearing structure, the stationary linear rails 179, 180 and the movable linear blocks 181, 183 constitute a linear guide device, respectively.

In FIG. 3, the upper and lower actuating plates 176, 177 and a crank mechanism that drives the actuating plates 176, 177 are shown. In the drawing, the crank mechanism includes a circular disk 186 fixedly mounted on a rotary shaft 184 for rotation therewith. The rotary shaft 184 is mounted in a support 178 by way of a bearing (not shown) and driven to rotate by a servo motor 188. The crank mechanism further includes link bars 185, 187, whose lower ends are pivotally connected to the disk 186 by way of bearings (not shown), respectively, and whose upper ends are connected to the upper and lower actuating plates 176, 177 by way of bearings 189, 191, respectively. Thus, the upper and lower actuating plates 176, 177 are driven to move reciprocally by the servo motor 188 via the crank mechanism between the raised and lowered positions, respectively. As is apparent from FIG. 2, such crank mechanism is provided on opposite sides of the apparatus at each of the paired support columns 173.

Referring back to FIG. 2, the upper actuating plate 176 has formed therein a plurality of vertical grooves 193 spaced in the direction parallel to the axis of rotation of the anvil roll 105. Each groove 193 is recessed leftward as seen in FIG. 3 and opened at the bottom. An upper heater holder 195 is inserted in each of the grooves 193 and an upper heater 195A is fixed to the bottom of the upper heater holder 195. The upper heater 195A may be heated by any suitable heat source (not shown). The upper heater holder 195 is vertically slidable in the groove 193 along a pair of guides 197 fixed to the upper actuating plate 176, as indicated by double-headed arrow. A compression spring 201 having a free length is disposed in each groove 193 with the bottom end of the spring 201 set in contact with the top surface of the upper heater holder 195 and the top end of the spring 201 set in contact with the top surface of the groove 193 formed in the upper actuating plate 176, respectively.

As shown in FIGS. 2 and 3, the lower actuating member 177 has fixed at the top thereof a plurality of lower heater holders 203 disposed at the same spaced interval as the upper heater holders 195 in the upper actuating plate 176. A lower heater 203A is fixed to the top of each of the lower heater holders 203 immediately below and in facing relation to its corresponding upper heater 195A. The surfaces of the upper and lower heaters 195A, 203A that face each other are formed flat. The cross-section of each heater 195A and its corresponding heater 203A, which is taken, for example, along line Z-Z in an encircled insert 199 in FIG. 2, is of a zigzag shape having a plurality of sharpened edges. The sharpened edges of the heater 203A serve to cut adhesive tape 163. As will be described in detail below, in joining veneer sheets together, adhesive tapes 163 are applied to opposite surfaces of veneer sheets across a prospective joint between the veneer sheets, and the heaters 195A, 203A are then moved toward each other to press and heat the adhesive tapes 163 against veneer sheets so as to cure the adhesive on the paper tape 163.

The control 200 is configured to receive detections signals from the veneer detecting device 107 and other devices such as absolute encoders and to control the operation of various servo motors 115, 119, 125, 131, 139, 159, 169, 170. The carriage 155 is movable reciprocally within a range between P1 and P2 shown in FIG. 1 in which veneer joining is performed, which range will be referred to as joining zone P1-P2.

Veneer joining operation using the above-described apparatus will be described in the following with reference to various drawings. In the initial state of the apparatus, the feed conveyor belts 101 and the anvil roll 105 are running in arrow directions, the knife blade 117 is placed in its elevated retracted position, and the deflectors 121, the hook members 127 and the connecting members 129 are also placed in their retracted positions, as shown in FIG. 1. The lower and upper veneer transferring conveyor belts 141, 153 are both kept at a stop. The carriage 155 is located at a position adjacent to the anvil roll 105 within the joining zone between P1 and P2. In the carriage 155, the adhesive tape reels 161 are set on the respective rolls 162 and the ends of adhesive tapes 163 unwound from the reels 161 are set pinched between the driven roll 165 and the idle roll 167. Then, servo motor 169 is energized to drive the rolls 165 only to such an extent that the ends of adhesive tapes 163 reach a position that is slightly beyond the respective heaters 195A, 203A as seen in the traveling direction of conveyor belts 141, 153.

A first veneer sheet such as 205 is placed on the running veneer feed conveyor belts 101 in such an orientation that the grain of veneer sheet 205 extends in the direction that is parallel to the axis of rotation of the anvil roll 105, or extends across the direction in which the veneer sheet 205 is moved by the conveyor belts 101. A veneer sheet as peeled by a rotary lathe may have at the leading and trailing edges thereof irregularly shaped and/or varying thickness portions which are unwanted and hence need be removed. Specifically, product such as plywood panel having therein veneer with reduced thickness portion may be regarded as reject and, therefore, the irregular edge portions need be removed from veneer sheet.

FIG. 4-1 shows a state in which the leading edge portion of veneer sheet 205 has reached a position where none of the roll 108 are yet to be raised for a predetermined distance corresponding to the full thickness of veneer sheet and, therefore, its corresponding limit switch 113 remains on. In the meantime, when the leading edge portion has moved past and pushes all the rolls 108 for the predetermined distance, as shown in FIG. 4-2, the limit switches 113 are all turned off. This means that the thickness of veneer sheet 205 below the rolls 108 has become the designated full thickness. In other words, the veneer detecting device 107 has determined a boundary position or line on veneer sheet 205 between its unwanted irregularly-shaped leading edge portion and a usable portion of veneer sheet 205. Accordingly, the veneer detecting device 107 generates a leading edge cut signal to the control 200.

Responding to such signal, the control 200 causes the servo motor 115 to stop its rotation, thereby stopping the operation of the veneer feed conveyor belts 101 and the anvil roll 105. To be more specific, actual stopping of the conveyor belts 101 and the anvil roll 105 is effected with such a delay of time after the signal transmission that the cutting position of the knife blade 117 on the anvil roll 105 (FIG. 5-1) in the subsequent cutting operation coincides with the above-mentioned boundary position or line between unwanted leading edge portion and usable portion of veneer sheet 205.

After stopping the veneer feed conveyor belts 101 and the anvil roll 105 as shown in FIG. 4-2, the control 200 energizes the servo motor 119 to actuate the knife blade 117. The knife blade 117 makes a reciprocal cutting motion, i.e. moving downward to its cutting position shown in FIG. 5-1 and back to its retracted position of FIG. 5-2. Then, the servo motor 125 is energized to cause the deflectors 121 to swing in arrow direction (FIG. 5-2) with the hook members 127 and the connecting members 129 about the shaft 123 to their lowered operative position shown in FIG. 5-2. In the lowered position, the hook portions 127A of the hook members 127 are positioned behind a cut-off leading edge portion 206, as shown in FIG. 5-2.

Subsequently, the servo motor 131 is energized to cause the connecting members 129, and hence the hook members 127 to move in arrow direction shown in FIG. 6-1 thereby to remove the cut-off leading edge portion 206 from veneer sheet 205 with the bent portions 127A of the hook members 127. The cut-off leading edge portion 206 is dropped off from the anvil roll 105, as shown in FIG. 6-1. After the removal of the edge portion 206, the servo motor 125 is energized to cause the deflectors 121 to swing with the hook members 127 to their further lowered position where the tip ends of the deflectors 121 is positioned within the grooves 106 in the anvil roll 105, as shown in FIG. 6-2. Then, the servo motors 115, 139 are energized to move the veneer feed conveyor belts 101, the anvil roll 105, and the veneer transfer conveyor belts 141, 153, respectively, in the arrow directions, as shown in FIG. 7-1. As a result, the veneer sheet 205 is guided by the deflectors 121 and introduced between the lower and upper conveyor belts 141, 153, thus the veneer sheet 205 being transferred rightward between the conveyor belts 141, 153, as shown in FIG. 7-1.

FIG. 7-2 shows a state in which the trailing edge portion of veneer sheet 205 being advanced further by the conveyor belts 141, 153 has reached a position where any one of the rolls 108 is lowered due to a thickness reduction of any part of the trailing edge portion of veneer sheet 205, and its corresponding limit switch is turned on. This means that the veneer detecting device 107 has determined a boundary position or line on veneer sheet 205 between unwanted trailing edge portion and its preceding usable or effective veneer sheet 205A having a rectangular shape with its both leading and trailing edges cut straight. The veneer detecting device 107 generates a trailing edge cut signal the control 200. Accordingly, the control 200 generates a control signal that causes the servo motor 115 to stop its rotation thereby to stop the feed conveyor belts 101, the anvil roll 105 and the transferring conveyor belts 141, 153 with such a delay of time after the signal transmission that the cutting position of the knife blade 117 on the anvil roll 105 in the subsequent cutting operation coincides with the above boundary position between the trailing edge portion and the effective veneer sheet 205A.

Subsequently, the servo motor 119 is energized, actuating the knife blade 117 to cut the veneer sheet 205, as shown in FIG. 8-1, for separating unwanted trailing edge portion 207 from the effective veneer portion 205A. After the cutting, the knife blade 117 is moved back to its retracted position shown in FIG. 8-2. Then, the servo motor 125 is energized to cause the deflectors 121 and the hook members 127 to swing about the shaft 123 back to their elevated retracted position shown in FIG. 9-1. The cut trailing edge portion 207 lies on the anvil roll 105, while the effective veneer sheet 205A is held between the veneer transfer conveyor belts 141, 153.

While the deflectors 121 are being swung upward, the servo motor 131 is energized to cause the hook members 127 to move leftwardly upward to their retracted position, as shown in FIG. 9-1. Then, the servo motor 115 is energized to cause the veneer feed conveyor belts 101 and the anvil roll 105 to move and rotate, respectively, so that the cut-off trailing edge portion 207 is dropped off from the anvil roll 105, as show in FIG. 9-2.

In the meantime, a second veneer sheet 209 that follows the effective veneer sheet 205A is supplied by the veneer feed conveyor belts 101, as shown in FIG. 10-1. The feed conveyer belts 101 and the anvil roll 105 are stopped in the same manner as described with reference to FIG. 4-2. Responding to a signal indicating that all limit switches 113 are turned off or that full thickness of veneer sheet 209 is detected, the control 200 energizes the servo motor 119 for actuating the knife blade 117 to cut the veneer sheet 209 in the same manner as described with reference to FIG. 5-1, for separating unwanted leading edge portion 210 from veneer sheet 209, as shown in FIG. 10-2. Thereafter, same operations as those described with reference to FIGS. 5-2 through 6-2 are performed for the veneer sheet 209, with the result that the cut-off leading edge portion 210 is removed from the anvil roll 105 and the deflectors 121 are positioned with the tip ends thereof placed in the grooves 106 of the anvil roll 105, as shown in FIG. 11-1. With the deflectors 121 thus positioned, the cut trailing edge 205C of the preceding veneer sheet 205A and the cut leading edge 209B of the following veneer sheet 209 are placed in facing relation to each other, as shown in FIG. 11-1.

After an elapse of time that is long enough for the tip ends of the deflectors 121 to enter into the grooves 106, the servo motors 115, 139 are energized to rotate the anvil roll 105 and move the veneer feed conveyor belts 101 and the veneer transfer conveyor belts 141, 153 in the respective arrow directions shown in FIG. 11-1. The effective veneer sheet 205A and its following veneer sheet 209 are transferred while maintaining the above facing relation of the cut trailing edge 205C of the effective veneer sheet 205A and the cut leading edge 209B of the veneer sheet 209. In the meantime, when the veneer detecting device 107 determines the boundary position or line on the veneer sheet 209 between the effective portion and the unwanted trailing edge portion, same operations as those described with reference to FIGS. 8-1 through 9-2 are performed for the veneer sheet 209. Then, the anvil roll 105 waits for a new veneer sheet 213 (FIG. 15) following the veneer sheet 209 to arrive.

The above-described steps of operation are performed repeatedly for incoming veneer sheets and a plurality of effective veneer sheets of a rectangular shape having cut leading and trailing edges is transferred by the conveyor belts 141, 153 with trailing and leading edges of any two adjacent veneer sheets held in facing relation, as shown in FIG. 11-2. Current position of the facing edges of two adjacent veneer sheets is monitored by the absolute encoder of the servo motor 139 and data of such varying current position is sent to the control 200.

Veneer joining may be accomplished by allowing the heaters 195A, 203A to press the adhesive tapes 163 unwound from the tape reels 161 against the opposite veneer surfaces. For the adhesive tape 163 to exert the desired adhesion effect, the adhesive tapes 163 need be pressed against veneer surface, for example, for about ten seconds. If the pressing is done at a stationary position, the conveyor belts 141, 153 need be kept at a stop during the pressing operation, which apparently affects the efficiency in veneer processing operation. To prevent such problem, the apparatus of FIG. 1 is so configure that the carriage 155 having mounted therein the adhesive tape feed devices 160 and the actuating plates 176, 177 is movable back and forth in conjunction with the movement of veneer sheets transferred by the conveyor belts 141, 153.

Referring to FIG. 11-2, numeral 182 designates a prospective joint, i.e. facing adjoining edges of two adjacent veneer sheets such as 205A, 209, which are yet to be joined, but to be joints in a subsequent operation. When the absolute encoder of the servo motor 139 determines the prospective joint 182 approaching close to the heaters 195A, 203A in the carriage 155 which Is then located in its initial position within the joining zone P1-P2, the control 200 then responding to a signal from the absolute encoder generates a signal that energizes the servo motor 159 to rotate the screw rod 157, causing the carriage 155 to start moving rightward as indicated by arrow in FIG. 12. Specifically, the control 200 controls the moving speed of the carriage 155 so that the position of the heaters 195A, 203A coincides with the position of the prospective joint 182. When it is determined by the control 200 that the above two positions has coincided with each other, the control 200 controls the servo motor 159 so that the carriage 155 moves at the same speed as the prospective joint 182. The control 200 then energizes the servo motor 188 to cause the upper and lower actuating members 176,177 to move toward each other until the heaters 195A, 203A are brought into operative position where the heaters 195A, 203A are pressed against adhesive tapes 163 across the prospective joint 182 of two veneer sheets 205A, 209. As a result, the adhesive tapes 163 are applied to the opposite surfaces of the veneer sheets across the prospective joint 182 and, simultaneously, the adhesive tapes 183 are heated by the heaters 195A, 203A, as shown in FIG. 13 and also FIG. 14 which is an enlarged view as seen in arrow direction from line W-W in FIG. 13.

As indicated above, the term prospective as in prospective joint is used herein to indicate that joining of any two adjacent veneer sheets is not yet complete, but are to be completed in a subsequent joining process.

Heating of the adhesive tapes 183 is continued for the predetermined length of time while the carriage 155 is in motion or at a stop in synchronism with the movement of the veneer transfer conveyor belts 141, 153, as shown in FIG. 15. While the veneer sheets 205A, 209 are moving and the adhesive tape 163 are being pressed against the prospective joint 182 by the heaters 195A, 203A, it may happen that the trailing edge portion of the following veneer sheet 209 may lies on the anvil roll 105 and a boundary line on the veneer sheet 201 for cutting off the trailing edge portion may be detected by the veneer detecting device 107, as in the case described with reference to FIG. 11-2. In such a case, provided that the prospective joint 182 is located within the joining zone P1-P2, the veneer feed conveyor belts 101, the anvil roll 20, and the veneer transfer conveyor belts 141, 153 are all stopped to stop the movement of veneer sheets 205A, 209. Simultaneously, the servo motor 159 is stopped to stop the rotation of the screw rod 157, and hence the movement of the carriage 155.

After the pressing and heating are continued for the predetermined ten seconds, the servo motor 169 is operated to rotate the upper and lower rolls 165 in reverse directions, specifically rotate the upper rolls 165 in clockwise direction and the lower rolls 165 in counterclockwise direction, respectively, as seen in FIG. 1, irrespective of the motion of the carriage 155. Accordingly, the adhesive tapes 163 pressed against the veneer sheets 205A, 209A are subjected to tension acting leftwardly in FIG. 1, which causes sharpened edges of the heaters 195A, 203A to cut the adhesive tapes 163. As a result, adhesive tapes 163 of a predetermined length are applied securely to veneer sheets 205A, 209 on opposite surfaces thereof.

After the adhesive tapes 163 have been cut, the servo motor 188 is operated to move the heaters 195A, 203A back to their retracted positions irrespective of the position of the joint 182A and the heaters 195A, 203A along veneer transfer conveyor belts 141, 153. Adhesive on the tape 163 attached to the prospective joint 182 is cured, thus a completed joint 182A being formed, as shown in FIG. 15, so that the veneer sheets 205A, 209A are joined together securely. Subsequently, the servo motor 162 is operated to feed adhesive tapes 163 for a predetermined length between the heaters 195A, 203A.

Supposing that the carriage 155 is positioned, for example, as shown in FIG. 5, after the heating by the heaters 195A, 203A has continued for ten seconds, the control 200 responding to a signal indicative of an elapse of the ten seconds causes the heaters 195A. 203A to move to their retracted positions. Simultaneously, provision is made for joining the veneer sheet 209A and a next veneer sheet 213 with the adhesive tapes 163. The provision is made in different manners depending on the following two case, as will be described below.

If a prospective joint 204, which is formed between the cut trailing edge 209C of veneer sheets 209A and the cut leading edge 213B of veneer sheet 213A that follows the sheet 209A, is yet to arrive in the joining zone P1-P2, the servo motor 159 is energized to move the carriage 155 to its original position shown in FIG. 12. On the other hand, if the prospective joint 204 has already arrived in the joining zone P1-P1, as shown in FIG. 15, the control 200 receiving a signal indicative of such arrival energizes the servo motor 159 to move the carriage 155 leftward to a position shown in FIG. 16 where the heaters 195A, 203A are placed facing the prospective joint 204. Because the prospective joint 204 is then moving rightward simultaneously with the leftward movement of the carriage 155, the control 200 receiving current position data of the joint 204 and the carriage 155 controls the movement of the carriage 155 so that the heaters 195A, 203A in the carriage 155 are positioned facing the prospective joint 204. To describe in other words, while the carriage 155 is moving toward the position of FIG. 16 and the prospective joint 204 moving rightward, the control 200 receiving the current position data of the prospective joint 204 controls the movement of the carriage 155 so that the position of the heaters 195A, 203A in the carriage 155 coincide with the position of the prospective joint 204. As appreciated from the above description, the position of the above coincidence is actually rightward of the indicated position 204 in FIG. 15.

When it is determined by the control 200 that the heaters 195A, 203A and the prospective joint 204 are positioned in facing relation, the servo motor 159 I causes the screw rod 157 to stop its rotation, and hence to stop the leftward movement of the carriage 155. Simultaneously, the servo motor 159 is energized to rotate the screw rod 157, moving the carriage 155 rightward in synchronism with the movement of the prospective joint 204 being moved by the veneer transfer conveyors belts 141, 153, and the servo motor 188 is energized to move the heaters 295A, 203A into pressing contact with the adhesive tapes 163 applied to the prospective joint 204 of veneer sheets 209A, 213. As with the previous prospective joint 182, pressing and heading of veneer sheets across the prospective joint 204 is continued for a predetermined length of time while the carriage 155 is moving or at a stop in synchronism with the movement of the veneer transfer conveyor belts 141, 153.

Pressing and heading of the prospective joint 182 are continued for ten seconds to join veneer sheets 209A, 203A securely together with the adhesive tape 163. After an elapse of the ten seconds, the carriage 155 may be positioned adjacent to the right end of the joining zone P1-P2, as shown in FIG. 17. The dimension of a veneer sheet following the effective veneer sheet 213A, as measured in the veneer transferring direction, may be so small that there exists a plurality of prospective joints such as 215, 217 within the joining zone P1-P2, as shown in FIG. 17. In such a case, the carriage 155 is moved to a position for the prospective joint 215 that is located immediately upstream of the prospective joint 204 for joining veneer sheets at 215. If the carriage 155 moving with the prospective joint 215 during the joining operation reaches the right end P2 of the joining zone P1-P2 before the ten seconds are counted, the servo motors 115, 139, 159 are stopped and the heaters 195A, 203A are allowed to continue to press and heat the adhesive tapes 163 until the ten seconds elapse. After the ten seconds have passed, the carriage 155 is moved to a position of the prospective joint 217, which has then already moved rightward from the position shown in FIG. 17 for a distance moved by the prospective joint 215, where joining for the prospective joint 217 is performed.

Thus, in the event that a predetermined length of time, e.g. ten seconds, that is necessary for forming a complete joint by the heaters 195A, 203A is yet to pass when the carriage 155 has just reached the right end P2 of the joining zone P1-P2, the servo motors 115, 139, 159 are all stopped so as to stop transferring of all veneer sheets, so that priority is attached to competing the ongoing veneer joining operation.

Product veneer sheets, each of which is made by joining a plurality of undersized effective sheets and cut into a predetermined format size, are transferred to a station where such veneer sheets are stacked into a pile and wait for a subsequent process.

In the above-described apparatus, there has been a problem that a gap formed, for example, between the cut trailing edge 205C of veneer sheet 205A and the cut leading edge 209B of veneer sheet 209A may be enlarged, as shown in FIG. 14, while these veneer sheets 205A, 209A are being transferred by the conveyor belts 141, 153. If adhesive tapes are applied to a prospective joint 182 having such an enlarged gap, a space due to such a gap is formed in the product veneer sheet. Product veneer sheet having therein a large gap or space may cause separation of the joined constituent veneer sheets, thus making difficult the subsequent veneer handling operation. Additionally, the presence of a gap in the surface of wood product made of veneer sheets, such as plywood, LVL, etc. constitutes a defect, degrading the product quality.

To solve the problem, a veneer splicing apparatus is disclosed in the Japanese Examined Patent Application Publication (Kokoku) No. 36-296 (1961). This apparatus uses a sideway pushing plate 18 that is set in contact with a veneer sheet and moves the veneer sheet forward toward another veneer sheet through a link mechanism 25 thereby to reduce the gap between the two veneer sheets (reference numeral used in the Publication are used for the description and same is true for other reference numerals appearing below). In this apparatus, however, parts such as support frames 23, springs 24, and links 25 are required to move the pushing plate 18, which has made the apparatus complicated in structure and the maintenance of the apparatus troublesome and difficult.

SUMMARY

In order to solve the above-identified problem of the splicing apparatus disclosed in the above-cited Publication, there is provided an apparatus for moving veneer to reduce or eliminate a gap between a veneer sheet to be moved and its preceding veneer sheet.

In accordance with an aspect of the invention, the veneer moving apparatus comprises a plurality of first springs that are disposed spaced from one another along a first direction of the apparatus and configured to move a first veneer sheet toward a stationary second veneer sheet in a second direction that is perpendicular to the first direction and parallel to surfaces of the first and the second veneer sheets. The apparatus further comprises a veneer support that are disposed below the first veneer sheet and the second veneer sheet and configured to support the first and the second veneer sheets at the bottom thereof and at least one first actuator that is configured to move the first springs in a third direction that is perpendicular to the surfaces of the first and the second veneer sheets reciprocally toward and away from the first veneer sheet.

Each of the first springs includes a first leaf spring having a first end portion that is fixed to the at least one first actuator and a second end portion that is located opposite from the first end portion and closer to the first veneer sheet than the first end portion. In the first leaf spring, at least part of the first leaf spring is disposed extending obliquely from the first end portion toward the second veneer sheet with respect to an imaginary plane that extends parallel to the first direction and the third direction and passing through the first end portion. The second end portion of the first leaf spring may have formed at the tip end thereof a plurality of sharpened edges that are engageable with the first veneer sheet. Furthermore, the second end portion of the first leaf spring may be formed extending in the third direction.

The at least one first actuator is configured to move each of the first leaf springs reciprocally along a straight linear path defined by the above imaginary plane between a first position where the second end portion of the first leaf spring is spaced away from the surface of the first veneer sheet and a second position where the second end portion of the first leaf spring is engaged with the first veneer sheet while the first end portion of the first leaf spring is clear of the surface of the first veneer sheet. In an alternative aspect of the invention, the at least one first actuator may be configured to move each of the first leaf springs reciprocally along a circular or a curved path lying on the side of the linear path that is adjacent to the second veneer sheet, between the above first and the second positions.

The veneer moving apparatus may further comprise a plurality of second springs disposed spaced along the first direction of the apparatus at positions downstream of the respective first leaf springs with respect to the direction in which the first veneer sheet is moved toward the second veneer sheet, and at least one second actuator configured to move each of the second springs reciprocally in the third direction toward and away from the second veneer sheet.

Each of the second springs has a first end portion fixed to the at least one second actuator and a second end portion located opposite from the first end portion of the second spring and closer to the second veneer sheet than the first end portion of the second spring. In the second spring, the first end portion and the second portion are formed in alignment with each other in the third direction.

The at least one second actuator is configured to cause each of the second springs to move reciprocally between a first position where the second end portion of the second spring is spaced away from the surface of the second veneer sheet and a second position where the second end portion of the second spring is engaged with the surface of the second veneer sheet thereby to hold the second veneer sheet in place during the movement of the first veneer sheet toward the second veneer sheet.

Each of the second springs may include a second leaf spring having an intermediate curved compressible portion between the first end portion and the second end portion of the second leaf spring. Alternatively, each second springs may be provided by a compression spring disposed extending in the third direction.

The veneer moving apparatus may comprise a first sensor that is configured to determine the operation timing of the at least one first actuator. The veneer moving apparatus may comprise a second sensor that is configured to determine the operation timing of the at least one second actuator.

According to the invention, movement of veneer sheet is accomplished by using leaf springs that are engaged with a veneer sheet at positions adjacent to a cut leading edge of a veneer sheet and cause the veneer sheet to move toward its preceding veneer sheet by utilizing the restoring force created by the elastically deformable leaf spring. The veneer moving apparatus of the present invention, which uses such leaf springs, can be made simple in structure and facilitates the maintenance of the equipment.

BRIEF DESCRIPTION OF THE DRAWINGS

FIGS. 4-1 through 11-2 are fragmentary schematic illustrative side views showing various steps of operation of the veneer joining apparatus of FIG. 1;

DETAILED DESCRIPTION

A preferred embodiment of veneer moving apparatus according to the invention will be described in the following with reference to drawings.

Figure 1:
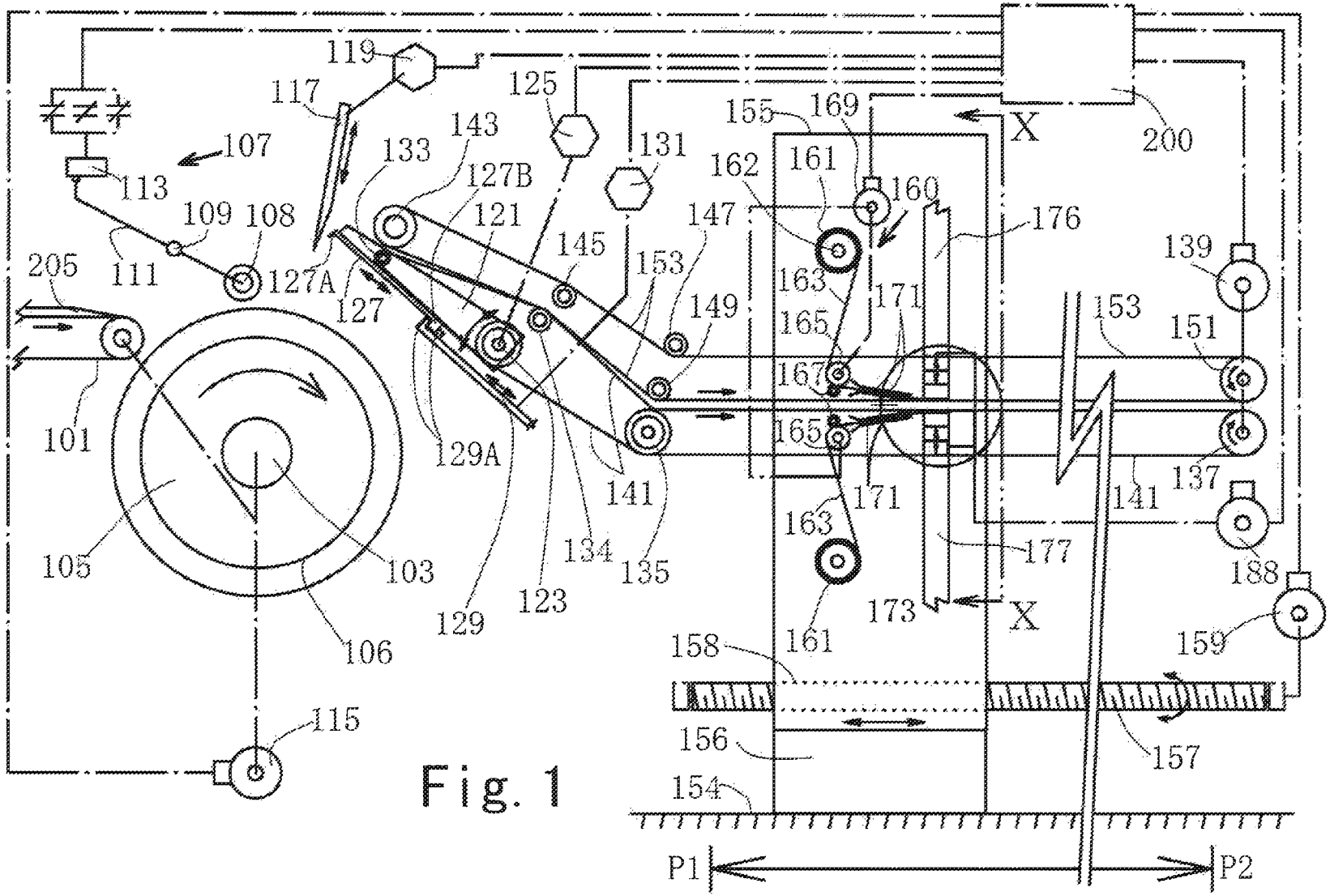
FIG. 1 is a fragmentary schematic side view of a known veneer joining apparatus.

As will be appreciated from the following description, the present invention relates to a veneer moving apparatus that may be added to an existing movable carriage such as 155 or similar equipment of veneer joining apparatus such as shown in FIG. 1.

In the following description of the embodiment, three difference directions will be indicated by reference numerals for the simplicity of description. Namely, referring to FIGS. 18 and 19, numeral 230 designates a first direction in which a plurality of veneer moving device each comprising a pair of leaf springs are disposed in the veneer moving apparatus, numeral 234 a second direction in which veneer sheets such as 205A, 209A are transferred by the veneer transferring conveyor belts 141, 153, or a direction that is perpendicular to the first direction 230 and parallel to the surfaces of veneer sheets 205A, 209A, and numeral 236 a third direction that is perpendicular to the surface of veneer sheets 205A, 209A, respectively. Reference to these directions is applicable to other drawings including those drawings showing other embodiments of the invention.

Figure 19:
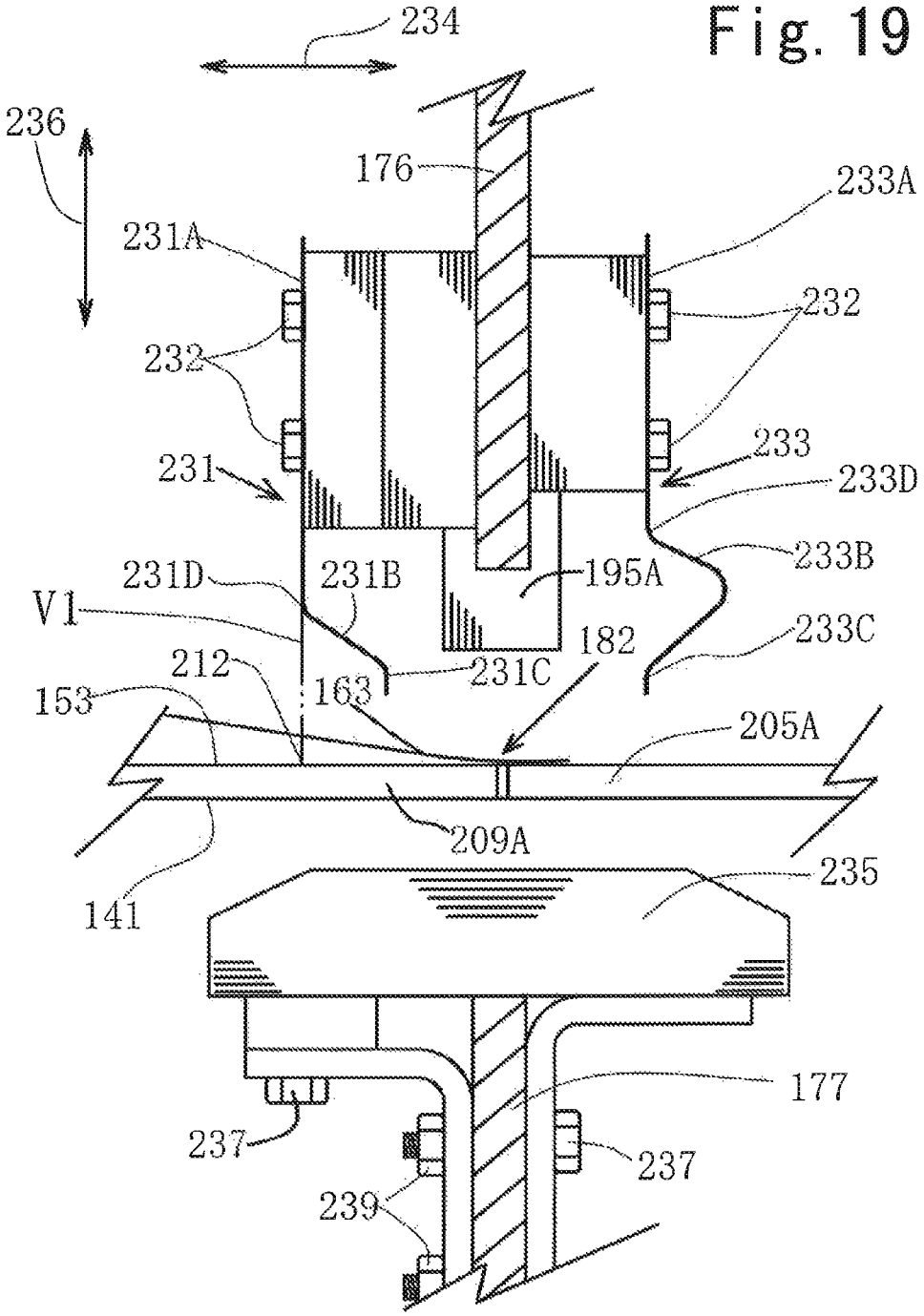
FIGS. 19 through 23 are fragmentary enlarged illustrative side views as seen in arrow direction from line S-S of FIG. 18, showing various states of one of a plurality of veneer moving devices each comprising a pair of leaf springs of the veneer moving apparatus of FIG. 18.

Referring to FIG. 19, each of the veneer moving devices in the veneer moving apparatus includes a veneer moving spring 231 and a veneer holding spring 233, both of which are made in the form of a resiliently deformable leaf spring. The veneer moving and holding leaf springs 231, 233 shown in FIG. 19 are in their elevated retracted positions, respectively. In FIG. 19, the effective veneer sheets 205A, 209A each having a rectangular shape with the leading and trailing edges cut straight in the first direction 230 are moved rightward. Effective veneer sheets such as 205A, 209A will be referred to hereinafter simply as veneer sheets.

Figure 18:
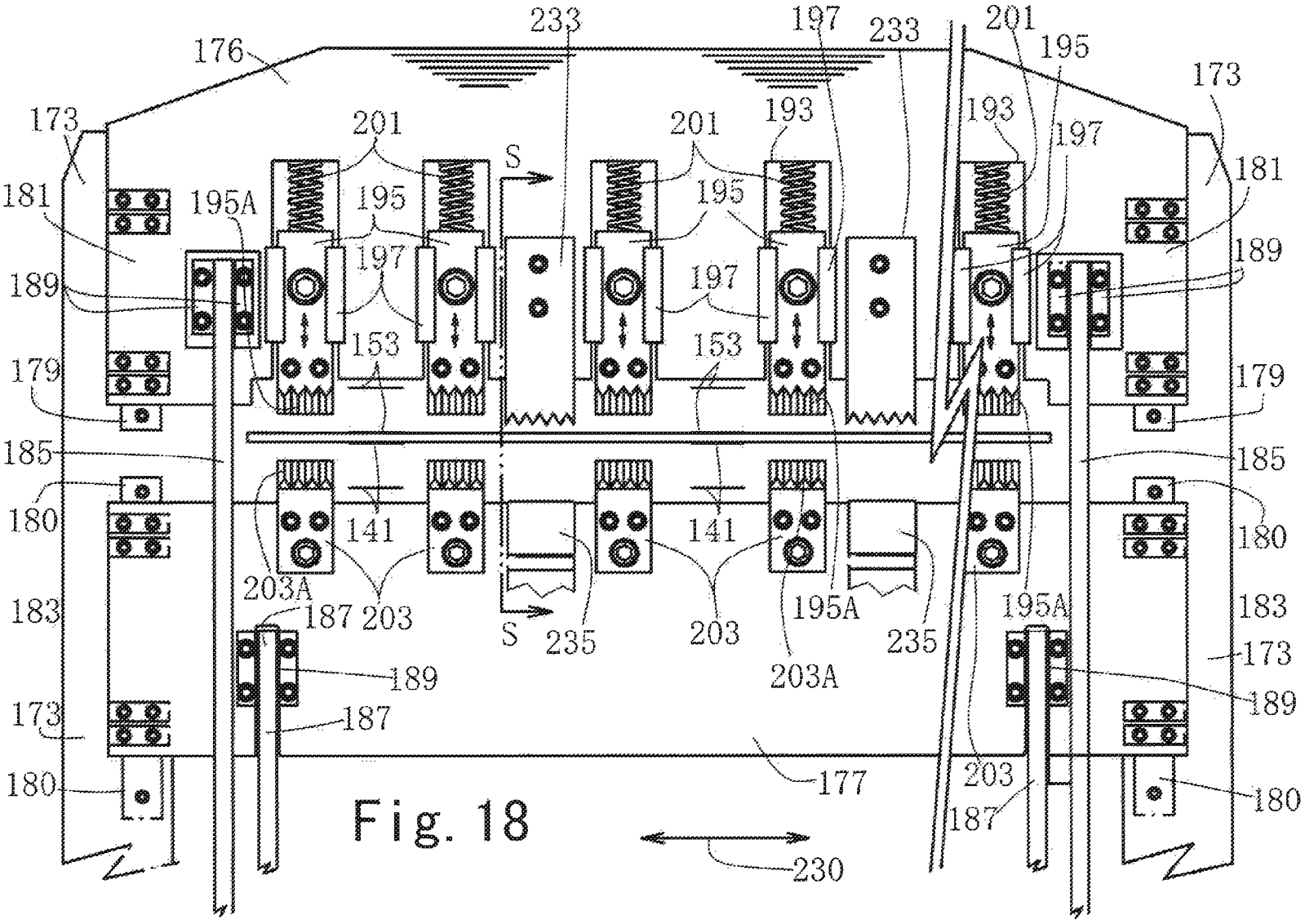
FIG. 18 is a fragmentary schematic illustrative front view showing a veneer moving apparatus according to a preferred embodiment of the invention.

The veneer moving leaf spring 231 includes an upper vertically flat base portion 231A extending in the third direction 236 and fixed by bolts 232 to the upper actuating plate 176 by way of mounting blocks on the upstream side of the actuating plate 176 with respect to the direction in which veneer sheets 205A, 209A are transferred. The leaf spring 231 further includes a lower end portion 231C extending downwardly in the third direction 236 toward the veneer sheet 209A, and an intermediate resiliently deformable inclined portion 231B connecting between the upper base portion 231A and the lower end portion 231C and extending obliquely from the base portion 231. Specifically, the inclined portion 231B is formed extending obliquely from the base portion 231 toward the downstream side, with respect to an imaginary plane that extends parallel to the first direction 230 and the third direction 236 and perpendicular to the second direction 234. The lower end portion 231C has at the tip end thereof a plurality of sharpened or pointed edges projecting toward the veneer sheet 209A, as shown in FIG. 18. In FIG. 19, reference symbol 231D indicates a part of the base portion 231A from which the inclined portion 231B extends obliquely. The part 231D of the base portion 231A corresponds to the first end portion of the invention and, therefore, the part 231D of the veneer moving leaf spring 231 may be fixed to the upper actuating plate 176 by way of a mounting block. Additionally, according to the invention, the lower end portion 231C need not necessarily be formed extending in the third direction 236, but in the same direction as the inclined portion 231B. As apparent from the drawing, the base portion 231A, the inclines portion 231B, and the lower end portion 231C are formed integral in a single leaf spring. As stated earlier, a plurality of such veneer moving leaf springs 231 are disposed spaced in the first direction 230 in the veneer moving apparatus.

The veneer holding leaf spring 233 includes an upper vertically flat base portion 233A fixed by bolts 232 to the upper actuating plate 176 on the downstream side of the actuating plate 176 by way of a mounting block, a lower end portion 233C extending downwardly in the third direction toward the veneer sheet 205A and having at the tip end thereof a plurality of sharpened or pointed edges similar to those of the lower end portion 231C, and an intermediate resiliently deformable curved portion 233B connecting between the upper base portion 233A and the lower end portion 233C and curved outward away from the veneer moving leaf spring 231. Reference symbol 233D designates a part of the base portion 233A from which the intermediate curved portion 233B extends. In the veneer holding leaf spring 231, the upper flat base portion 233A and the lower end portion 233C are disposed aligned in the third direction 236. As with the veneer moving leaf spring, 231, the base portion 233A, the curved portion 233B, and the lower end portion 233C are formed integral in a single leaf spring. A plurality of such veneer holding leaf springs 233 are disposed spaced in the first direction 230 and downstream of the respective veneer moving leaf springs 231.

As shown in FIG. 19, the veneer moving device further includes a veneer support block 235 disposed below the paired veneer moving and holding leaf springs 231, 233 and fixed to the lower actuating plate 177 by bolts 237 and nuts 239. Though not shown in the drawing, the veneer support block 235 is covered with a sheet having a low coefficient of friction against veneer. In the illustrated embodiment, a plurality of combinations each comprising a veneer moving leaf spring 231, a veneer holding leaf spring 233 and a veneer support block 235 are disposed at such a spaced distance that four such combinations are provided within a distance of about one meter.

Operation of the veneer moving apparatus thus constructed will be described in the following.

In the initial state of the veneer moving apparatus, the veneer moving leaf springs 231 and the veneer holding leaf springs 233 are both placed in their raised retracted positions with the tip ends of the lower end portions 231C, 233C clear of the upper surfaces of veneer sheets 209A, 205A, respectively, as shown in FIG. 19, which positions correspond to the first positions of the first springs and the second springs, respectively, of the invention. For the sake of clarity of illustration, part of the lower and upper veneer transferring conveyor belts 141, 153 not in contact with veneer sheet may be omitted from illustration. Veneer sheets conveyed by the veneer feed conveyor 101 and cut on the anvil roll 105 to remove unwanted leading and trailing irregular edge portions into an effective rectangular-shaped veneer sheets such as 205A, 209A are transferred by the veneer transfer conveyor belts 141, 153 while maintaining the aforementioned facing relation of any two adjacent veneer sheets.

Figure 2:
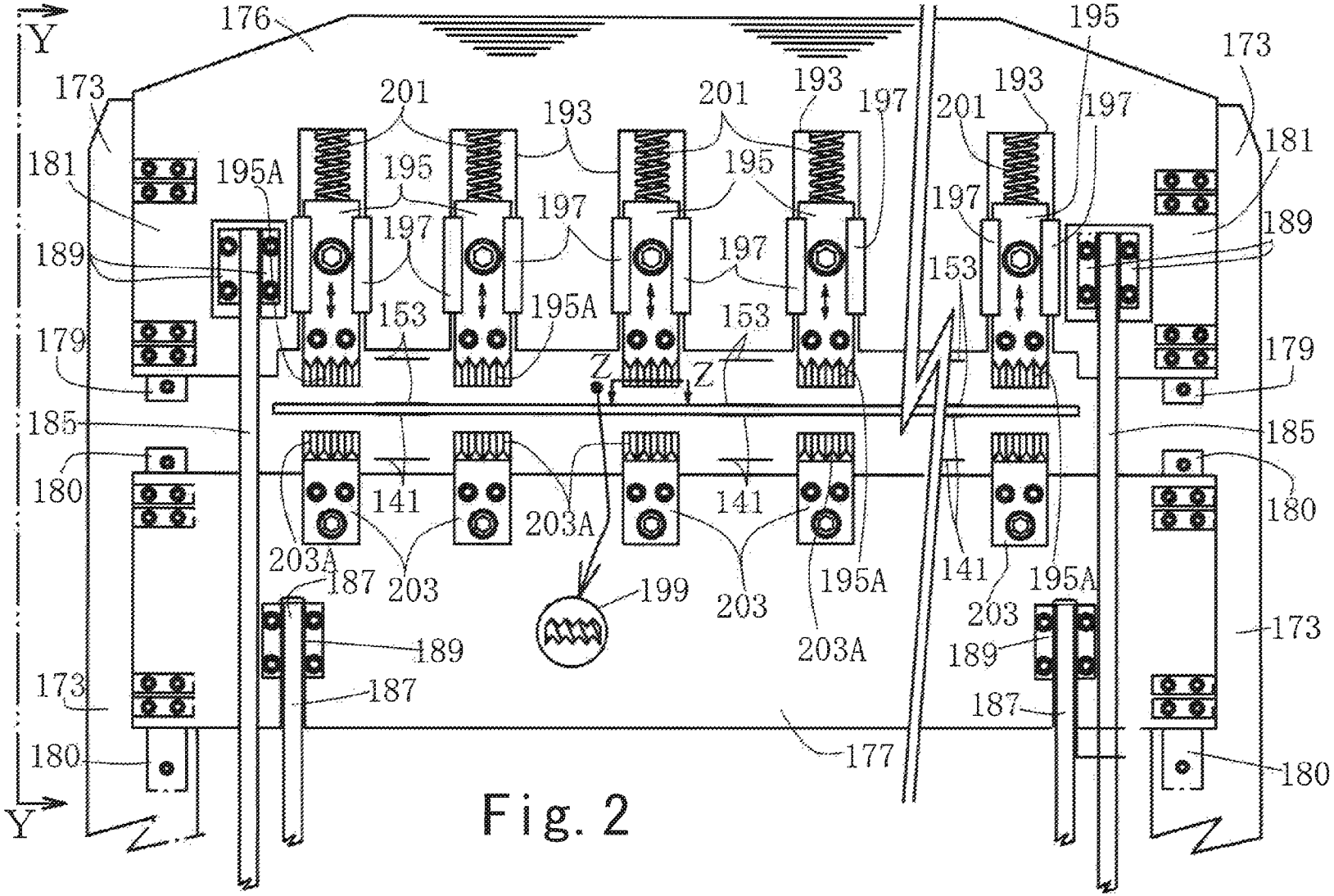
FIG. 2 is a fragmentary schematic front view as seen in arrow direction from line X-X of FIG. 1.
Figure 3:
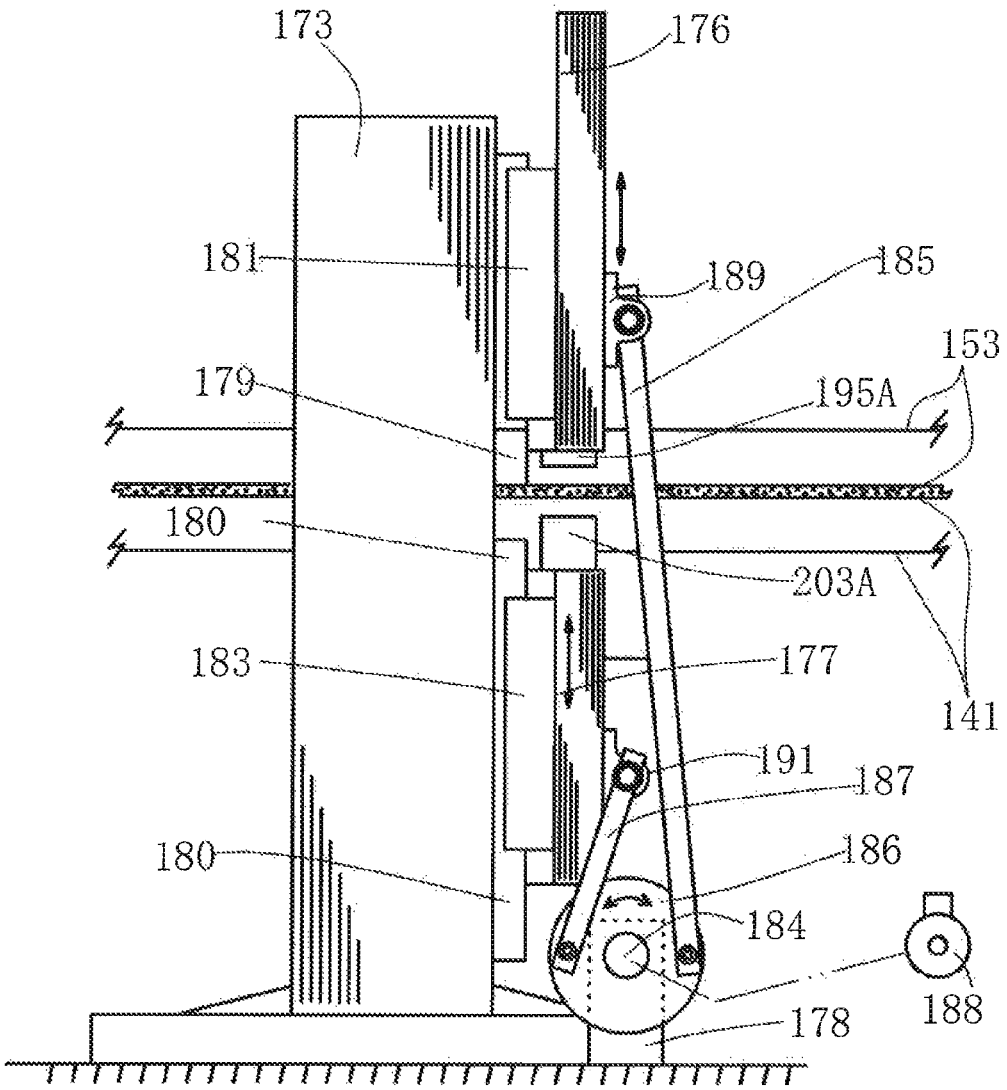
FIG. 3 is a fragmentary schematic view as seen in arrow direction from line Y-Y of FIG. 2.
Figures 1, 4:
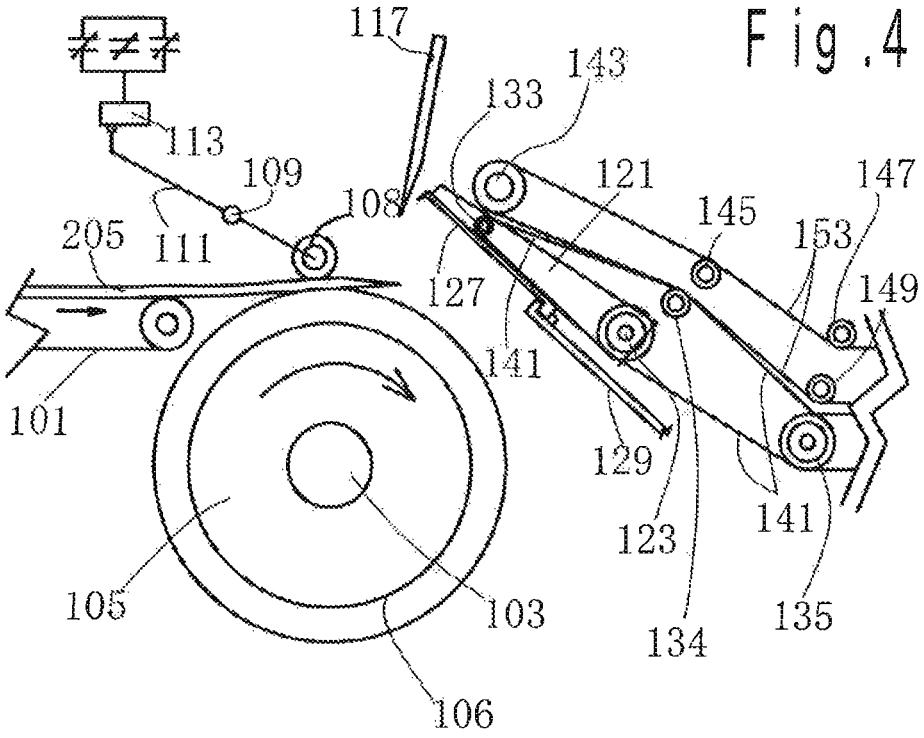
Figures 2, 4:
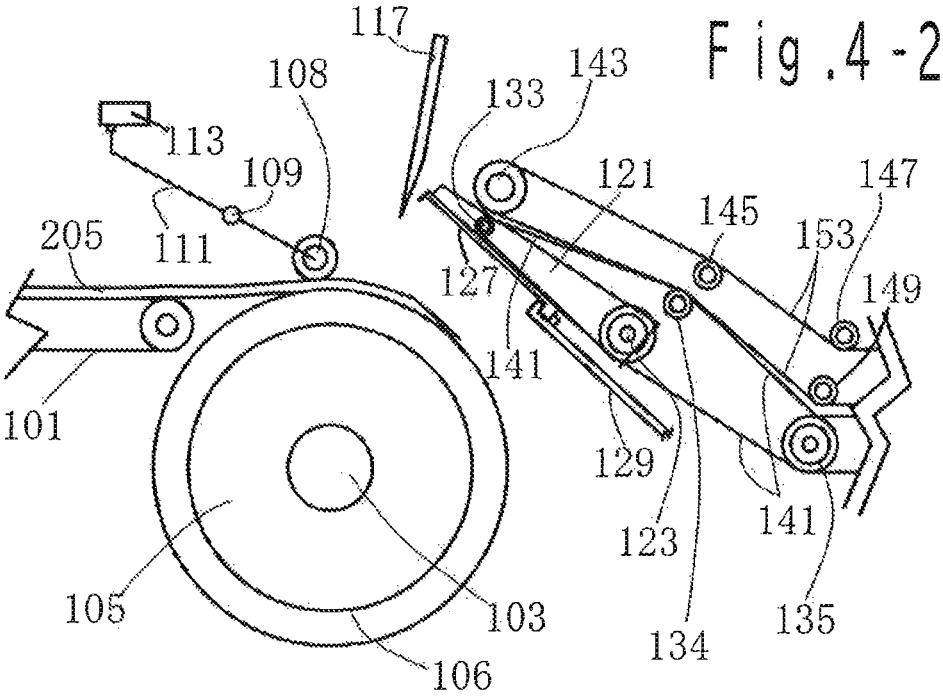
Figures 1, 5:
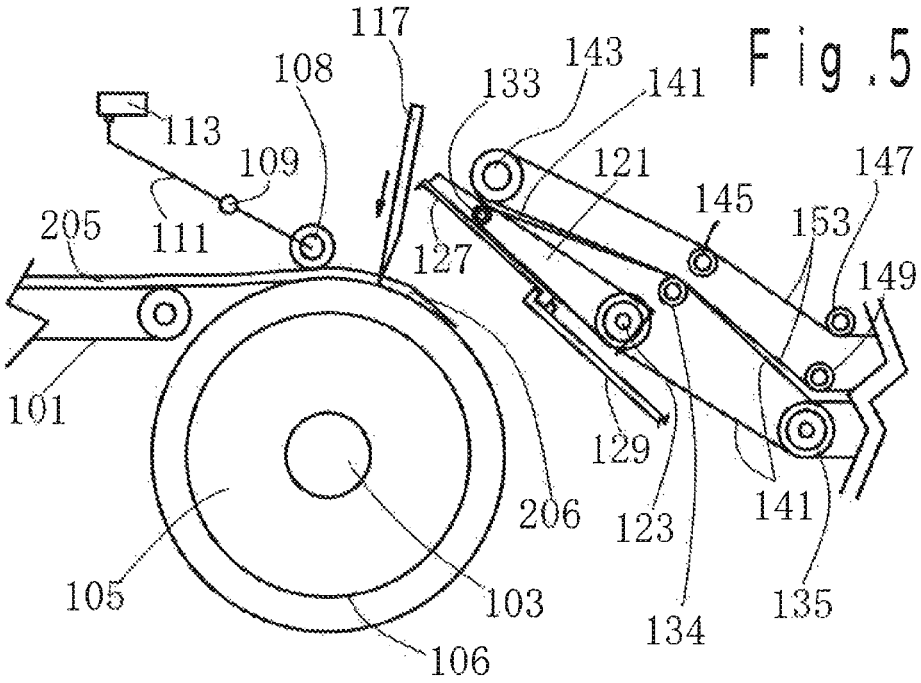
Figures 2, 5:
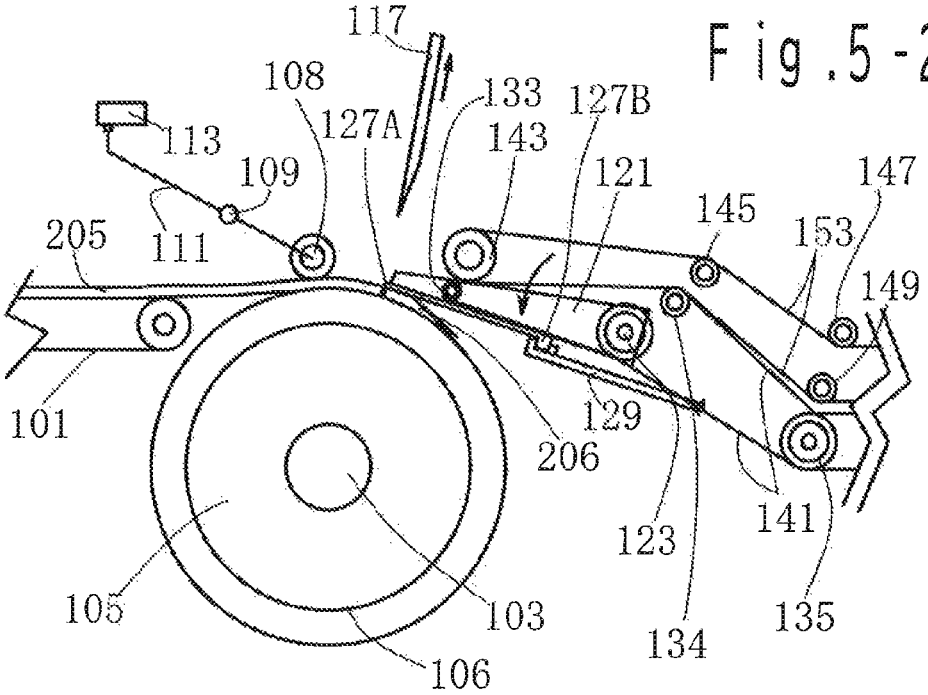
Figures 1, 6:
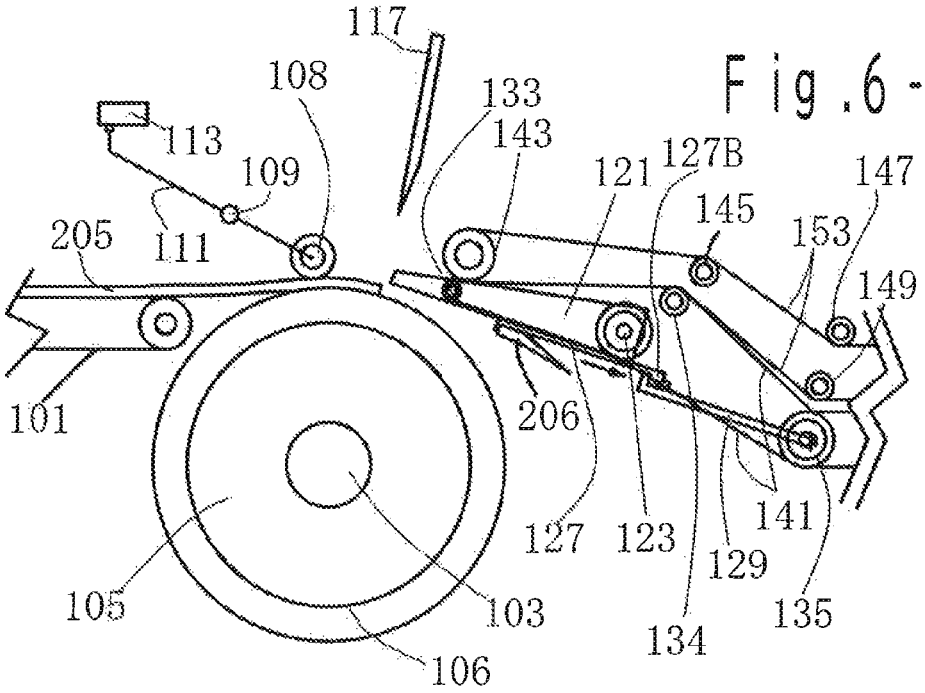
Figures 2, 6:
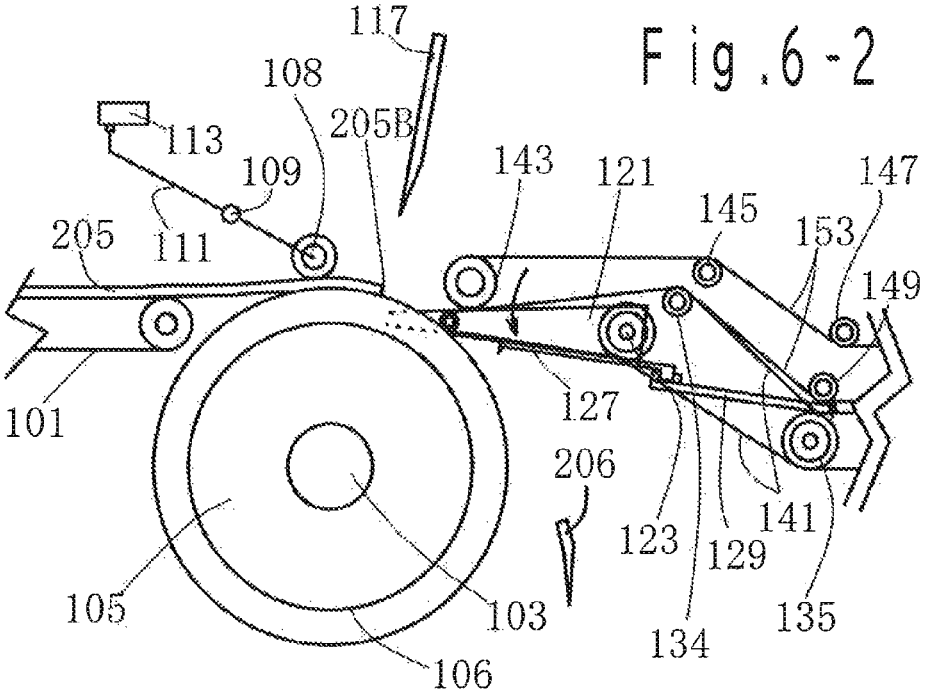
Figures 1, 7:
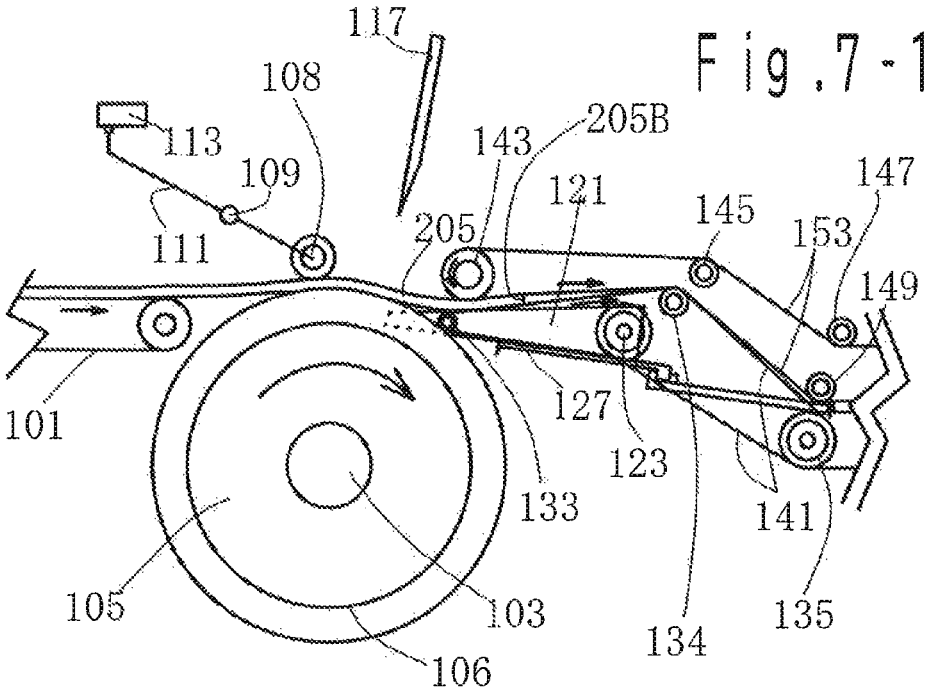
Figures 2, 7:
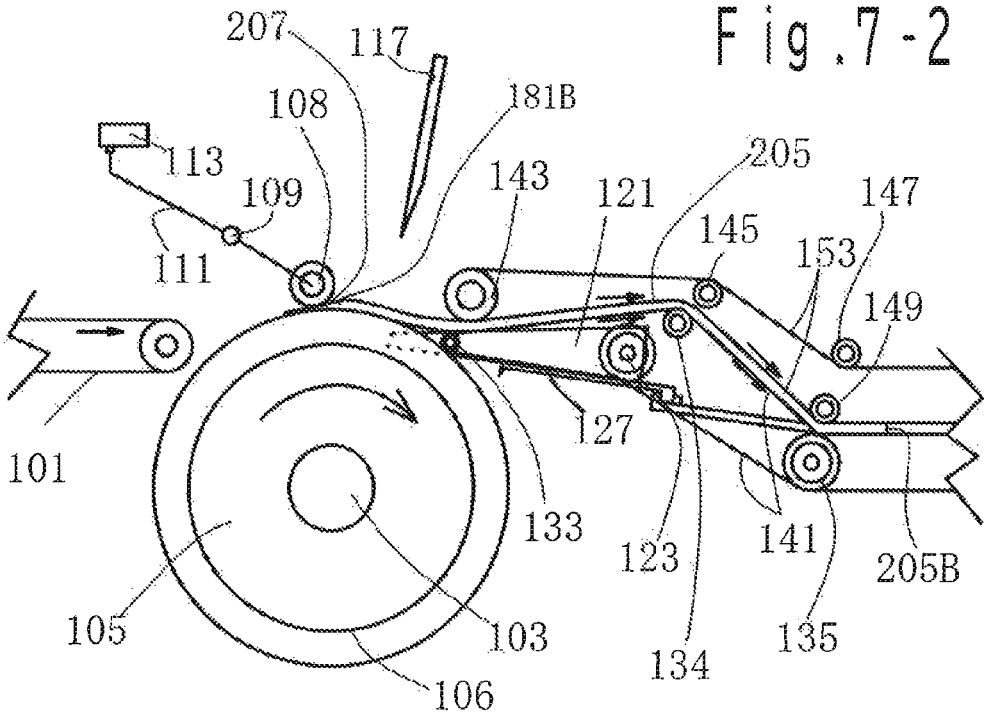
Figures 1, 8:
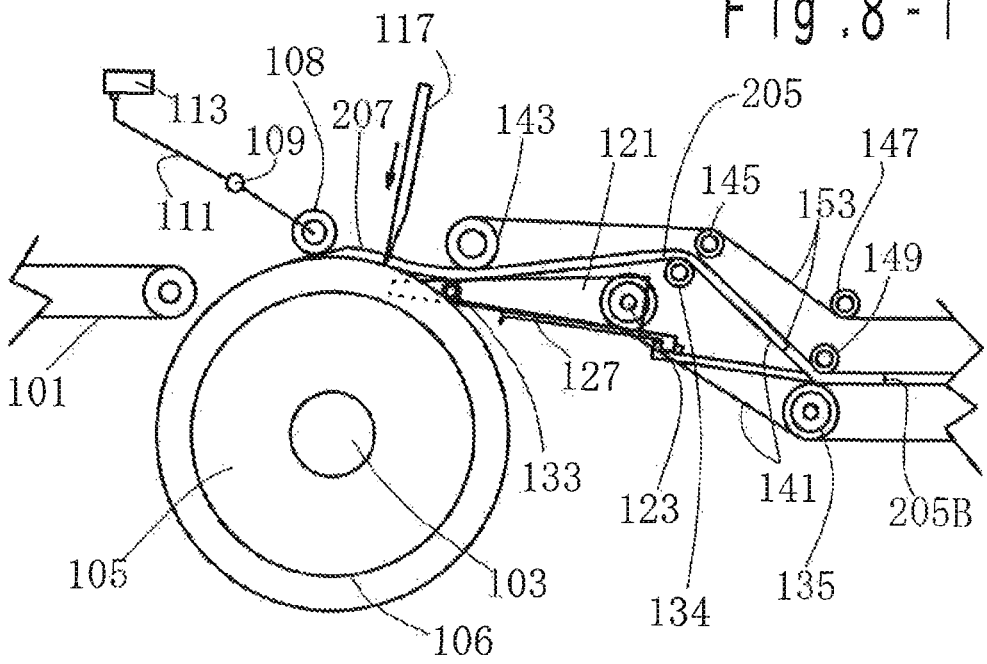
Figures 2, 8:
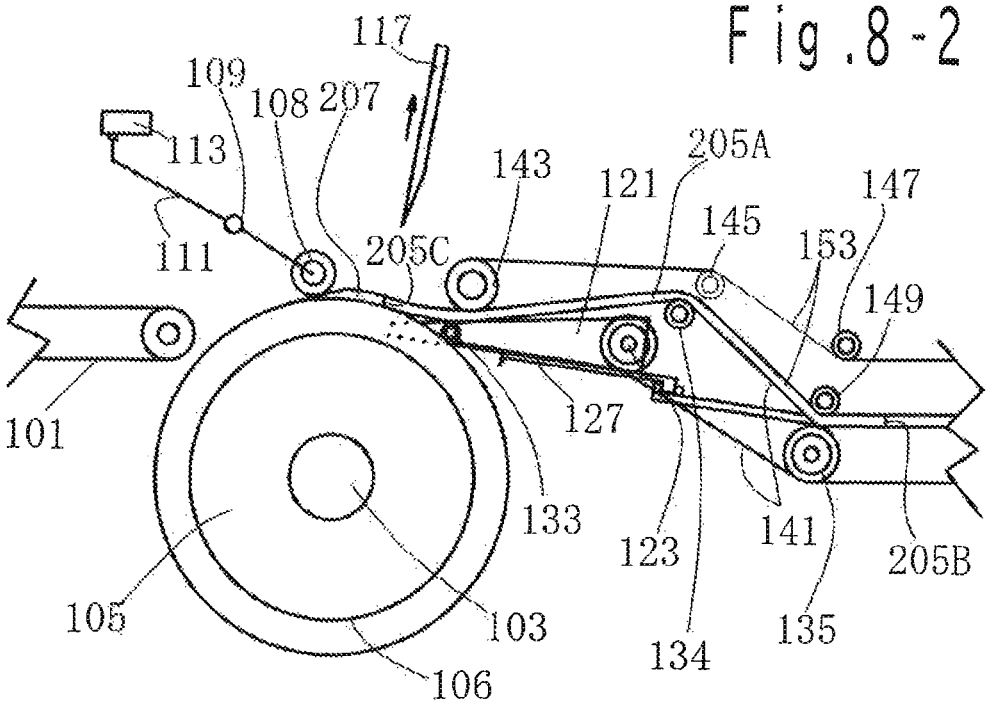
Figures 1, 9:
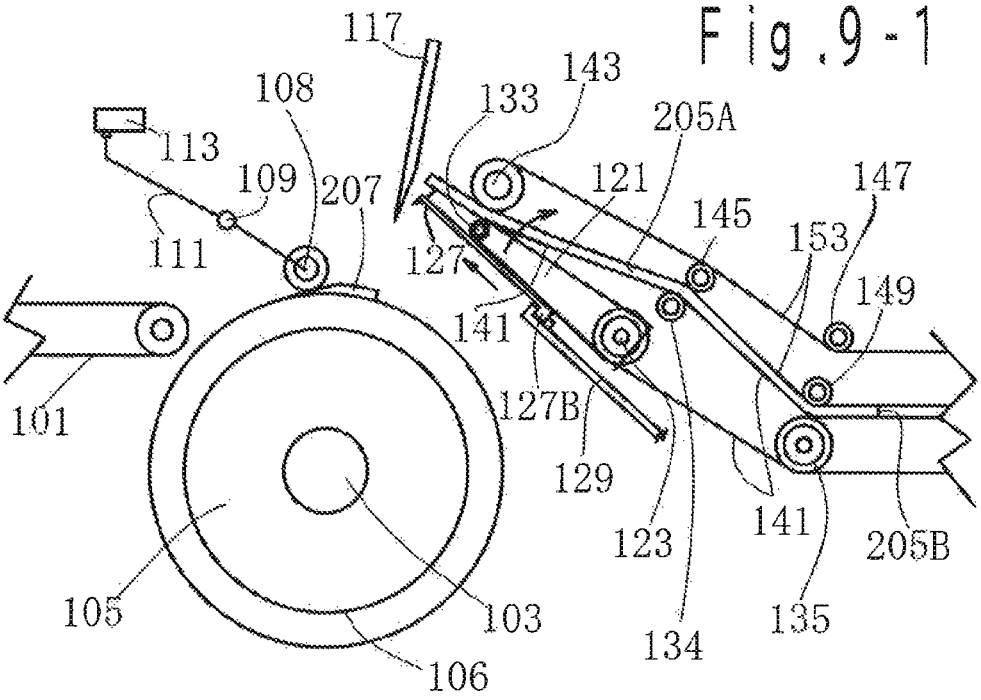
Figures 2, 9:
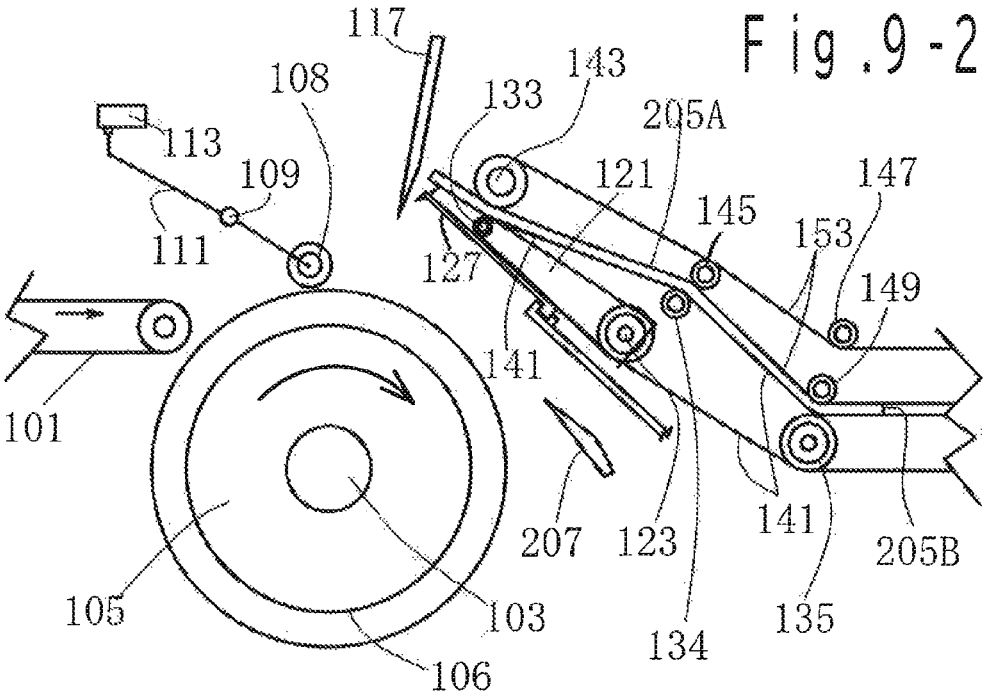
Figures 1, 10:
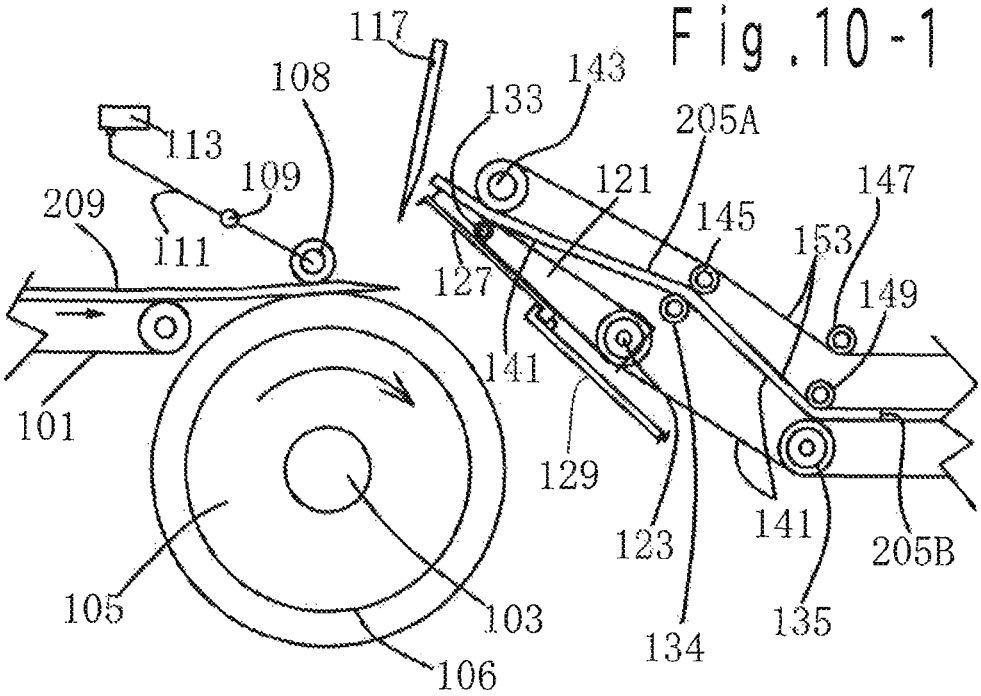
Figures 2, 10:
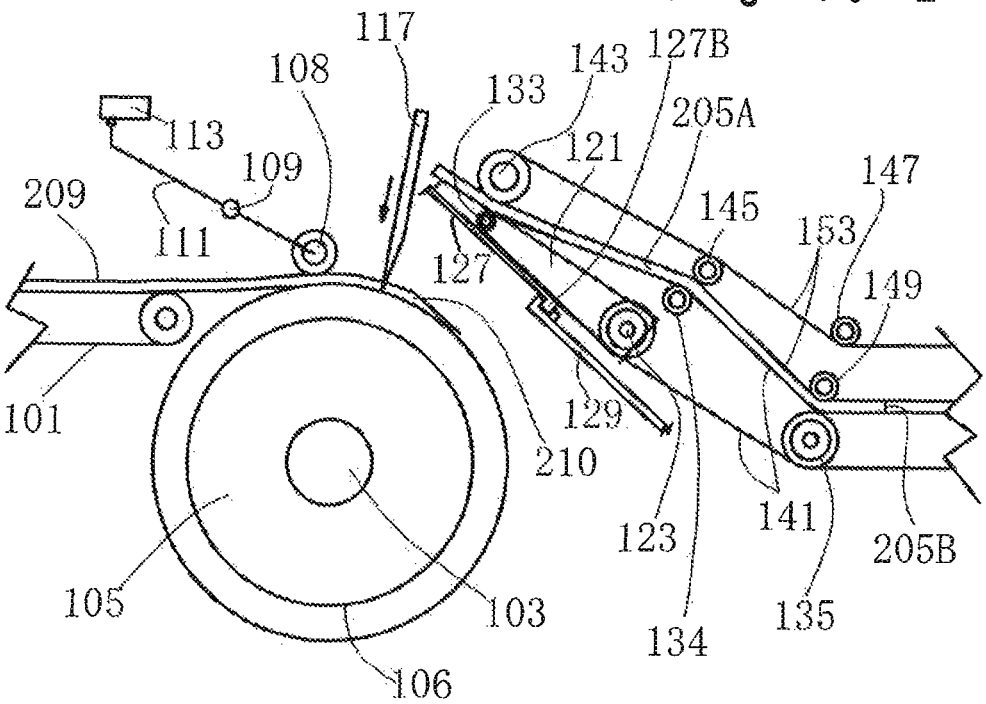
Figures 1, 11:
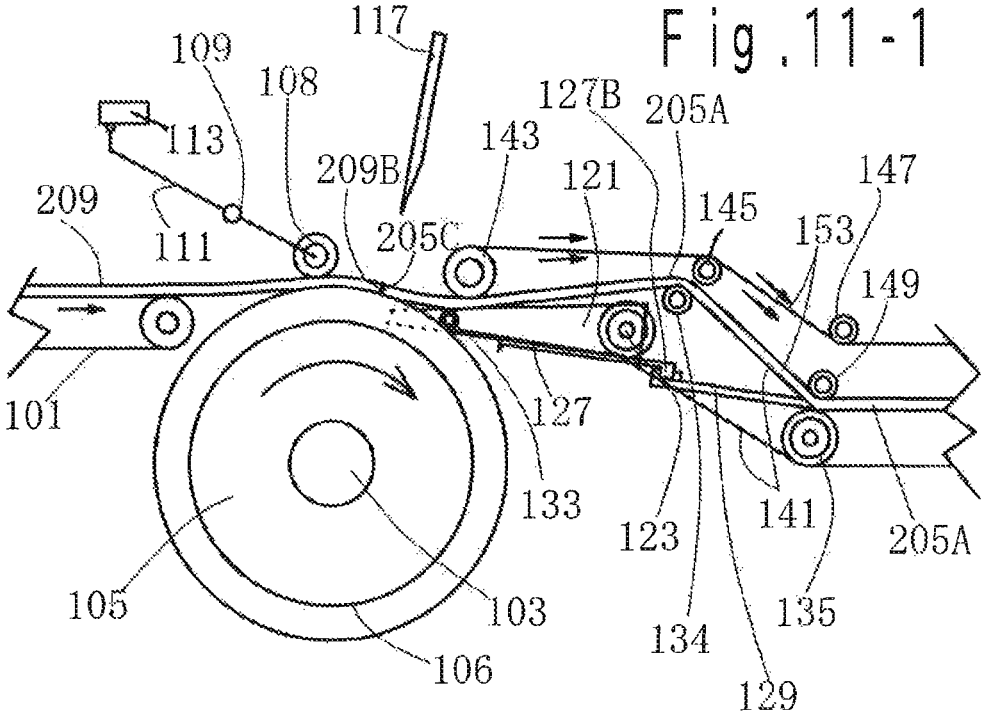
Figures 2, 11:
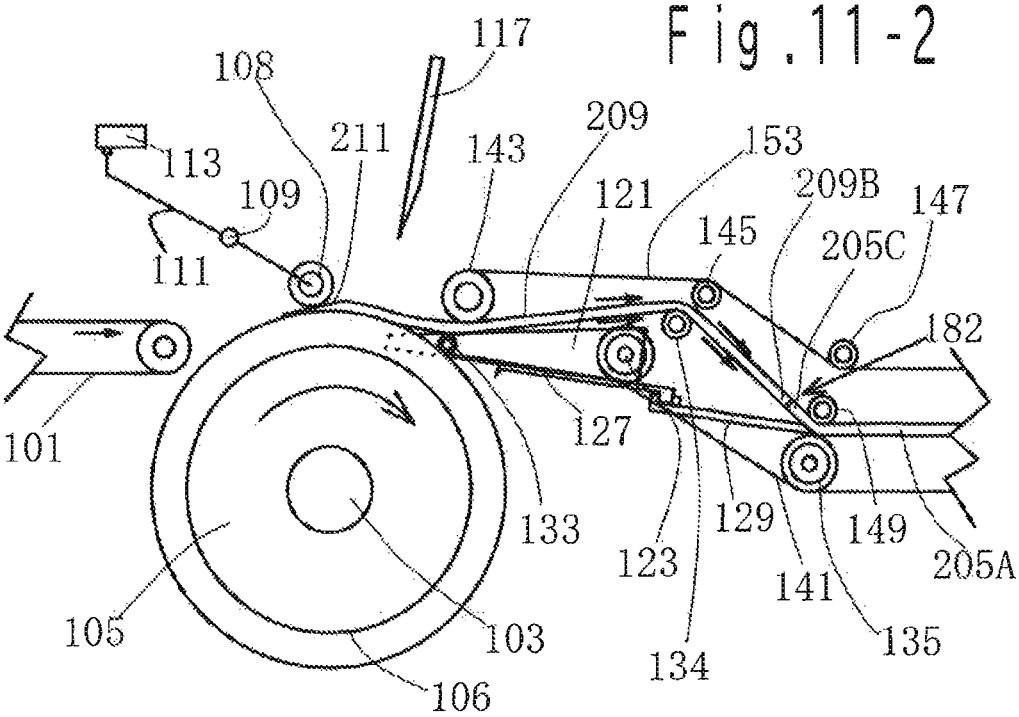
Figure 12:
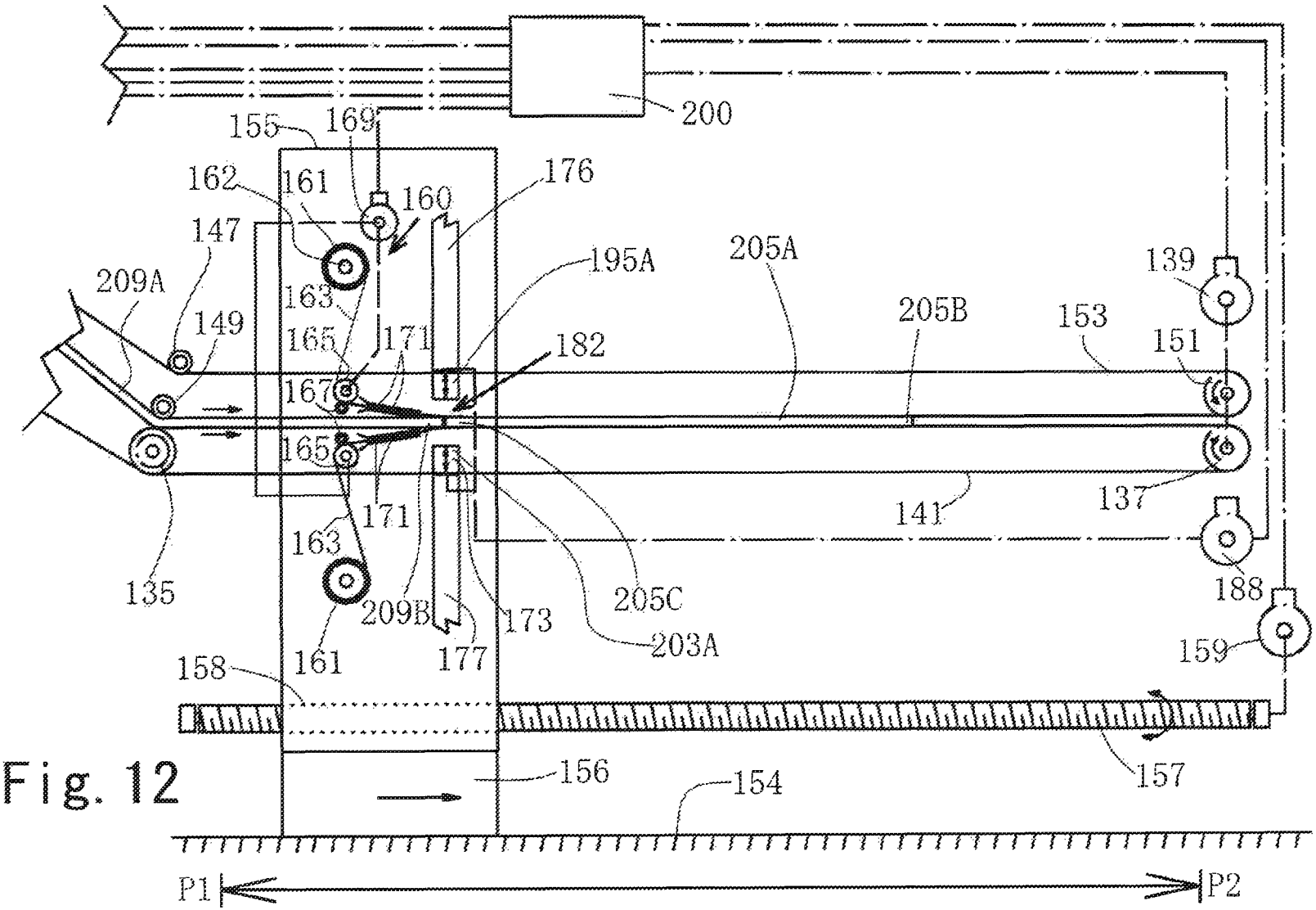
FIG. 12 is a fragmentary schematic illustrative side view showing operation of the apparatus of FIG. 1.
Figure 13:
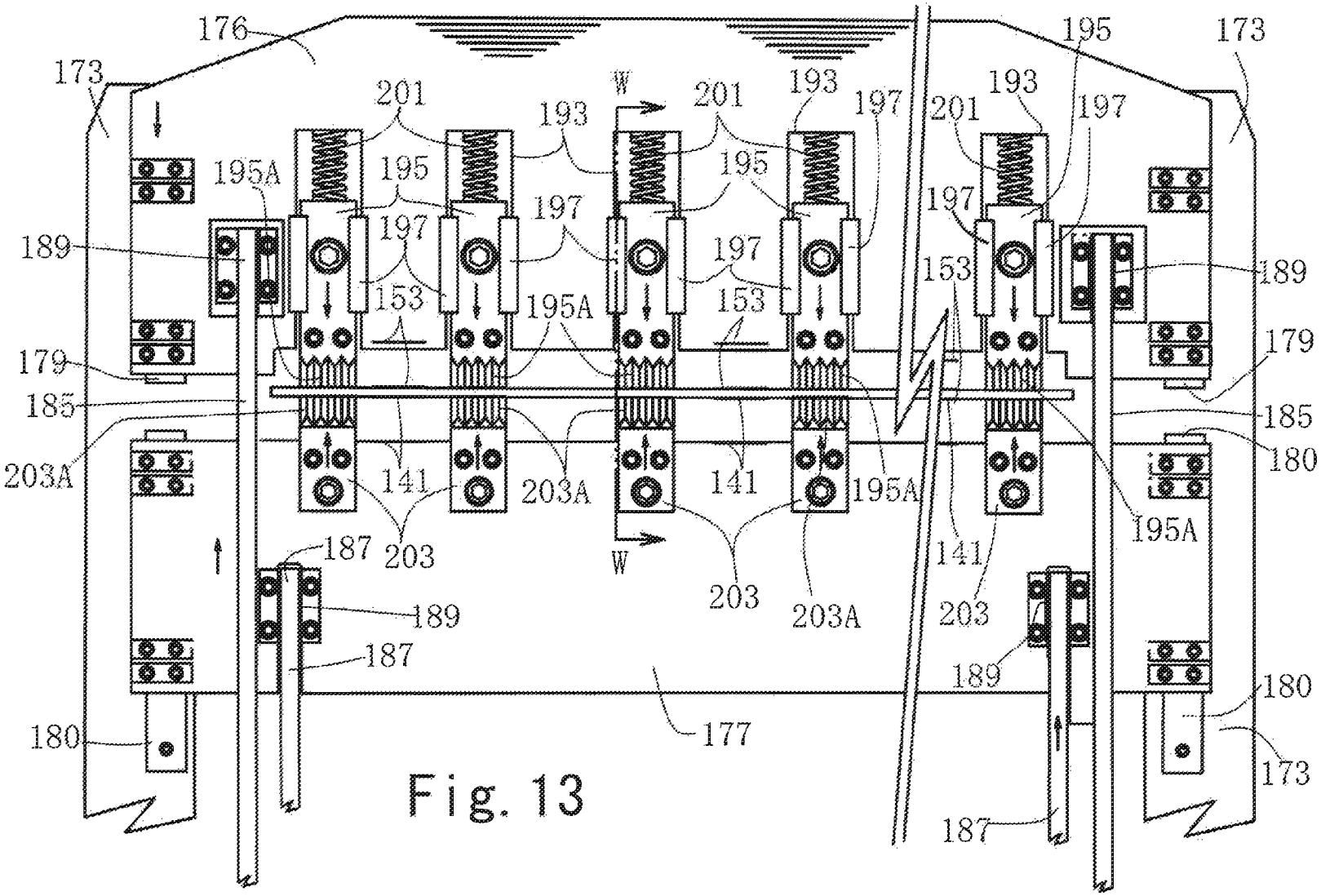
FIG. 13 is a fragmentary schematic front view similar to FIG. 2, showing operation of the apparatus of FIG. 1.
Figure 14:
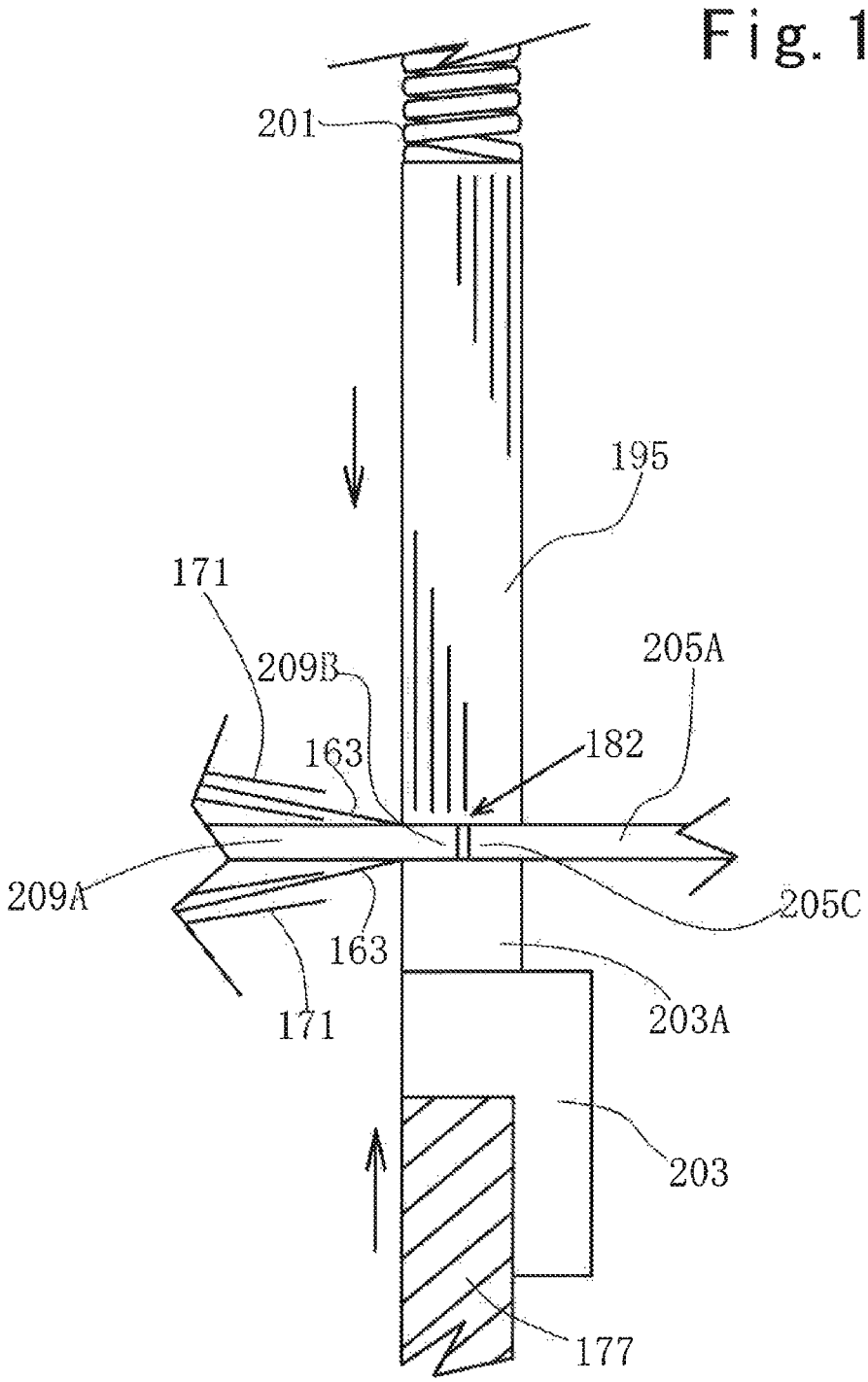
FIG. 14 is a fragmentary enlarged schematic view as seen in arrow direction from line W-W of FIG. 13.
Figure 15:
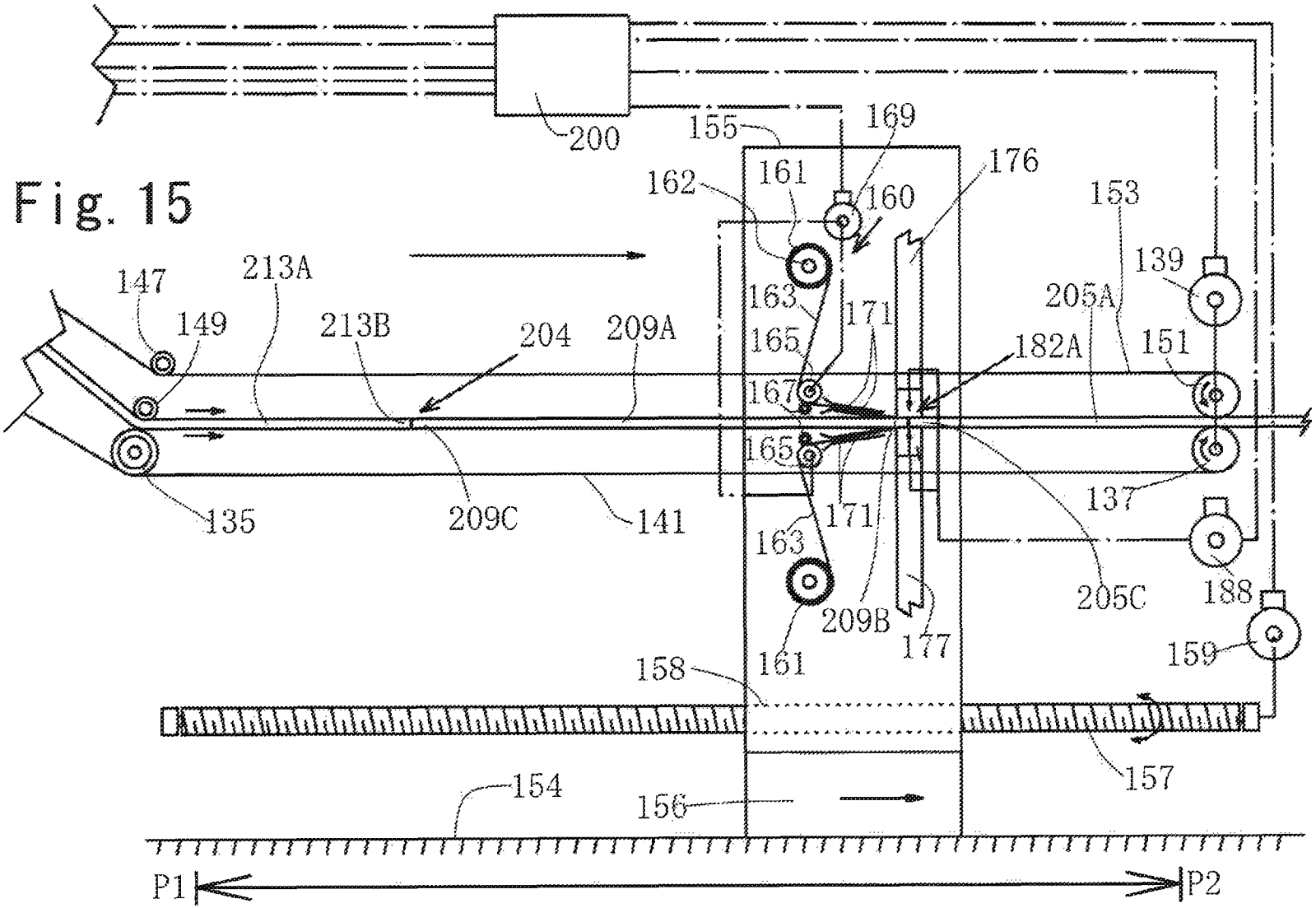
FIGS. 15 through 17 are fragmentary schematic illustrative side views showing various steps of operation of the apparatus of FIG. 1.
Figure 16:
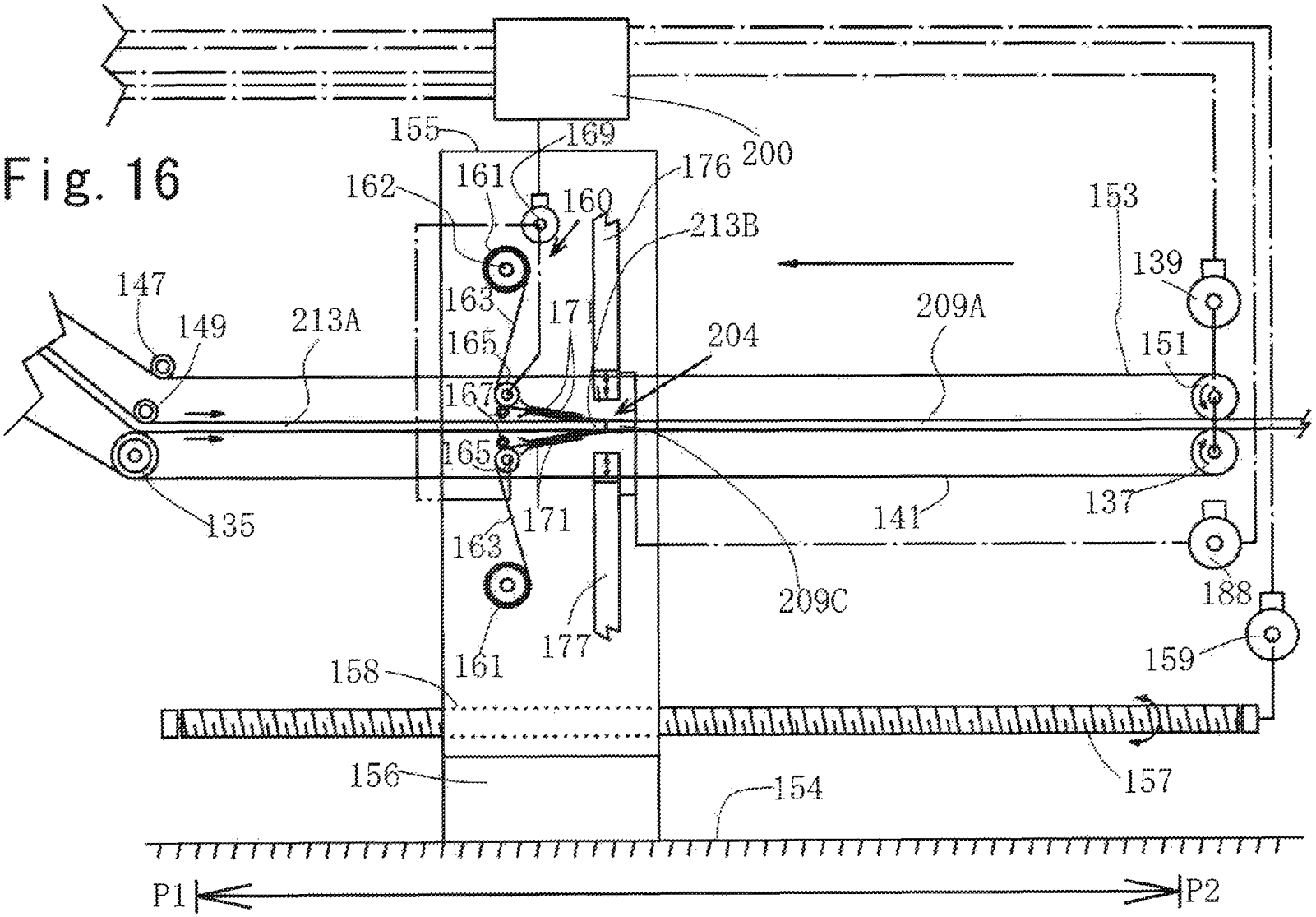
Figure 17:
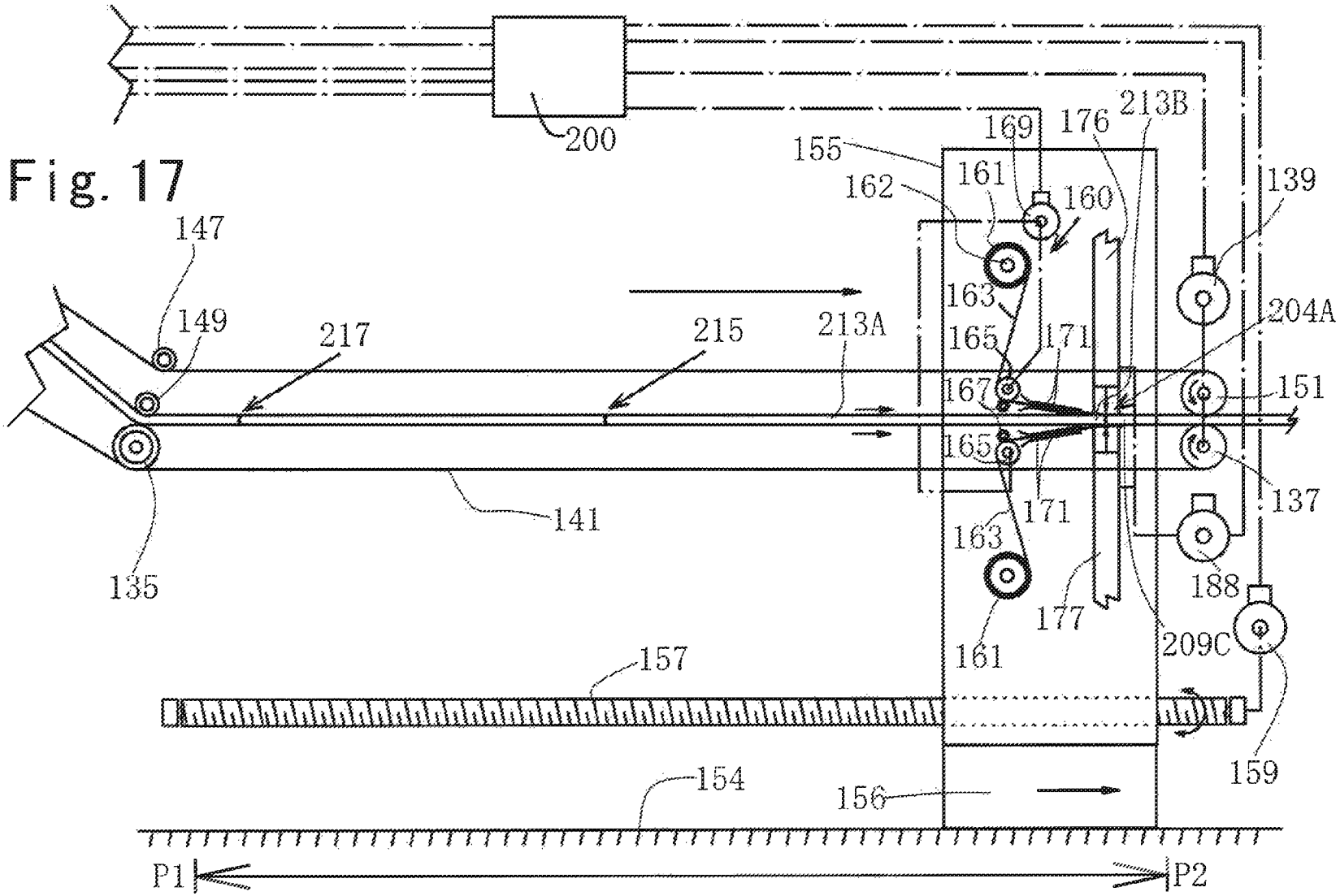

Referring back to FIGS. 11-1 and 11-2, two veneer sheets 205A, 209 are shown with a prospective joint 182 formed between the cut trailing edge 205C of veneer sheet 205A and the cut leading edge 209B of veneer sheet 209A. The prospective joint 182 may have formed therein a gap. When the prospective joint 182 reaches a position shown in FIG. 12 or FIG. 19, the carriage 155 is moved rightward in synchronism with the movement of the veneer transferring conveyor belts 141, 153, and the servo motor 188 is energized to cause the upper and lower actuating plates 176, 177 to move toward each other. In FIG. 19, reference numeral V1 shows an imaginary plane that extends along the base portion 231A in the third direction 236 toward the surface of veneer sheet 209A, and 212 a line of intersection between the plane V1 and the veneer surface 209A. With the downward movement of the upper actuating plate 176, the part 231D of each veneer moving leaf spring 231 is moved downward along a straight path defined by the imaginary plane V1 to a position shown in FIG. 23, by way of the positions shown in FIGS. 20, 21 and 22, which will be explained below.

Figure 20:
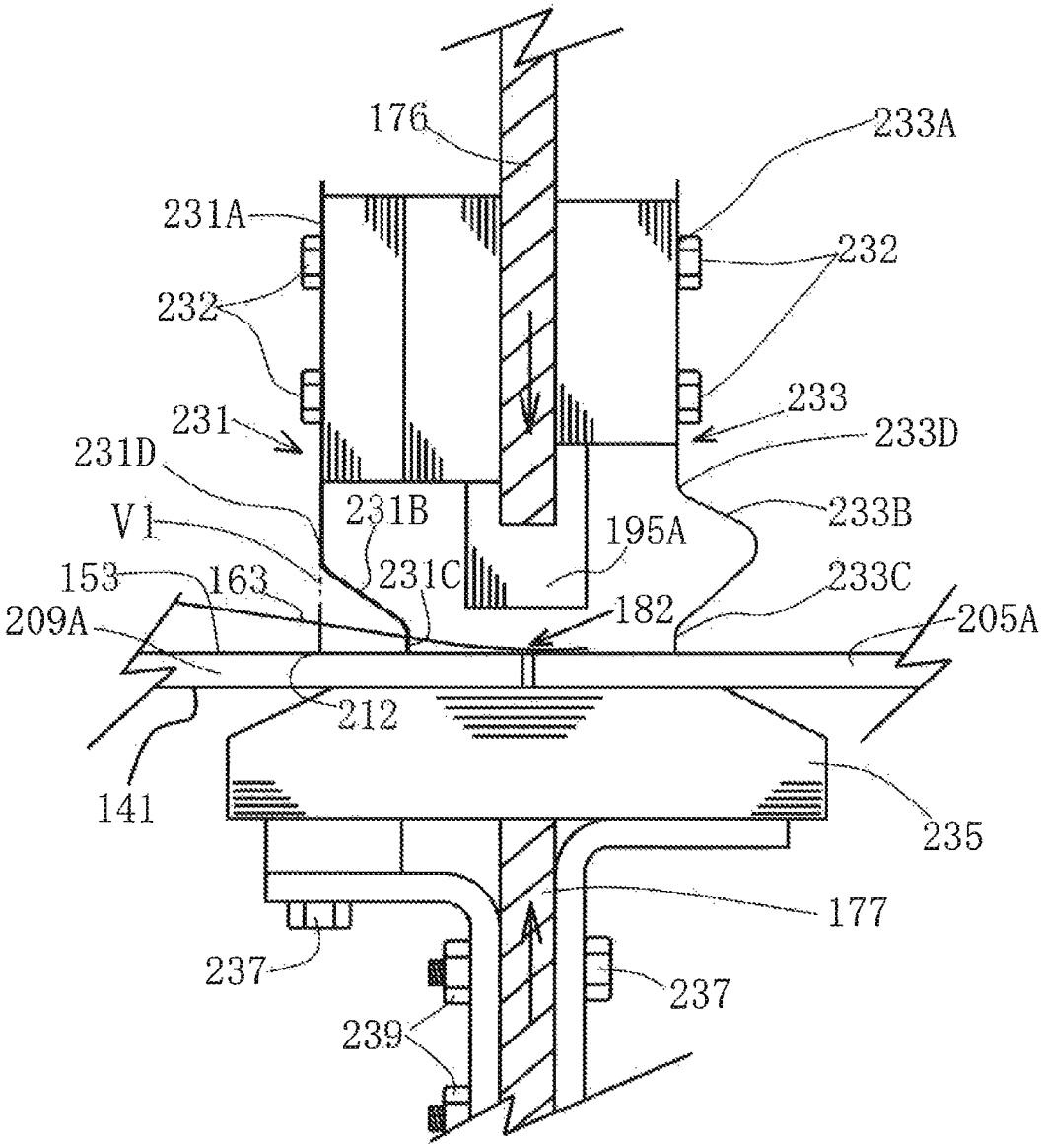

FIG. 20 shows a state in which the veneer moving and holding leaf springs 231, 233 are lowered by the upper actuating plate 176 to a position where the tip ends of the lower end portions 231C, 233C of the respective veneer moving and holding leaf springs 231, 233 have just touched the surfaces of veneer sheet 209A and its preceding veneer sheet 205A, respectively. Simultaneously with the lowering movement of the springs 231, 233, the veneer support block 235 is moved upward until it is positioned very close to the bottom surfaces of veneer sheets 205A, 209A. With further movement of the leaf springs 231, 233, the tip ends of the lower end portions 2310, 233C of the leaf springs 231, 2133 begin to engage with or is stuck into the veneer sheets 209A, 205A, respectively, which are then supported at the bottom thereof by the support block 235.

Figure 21:
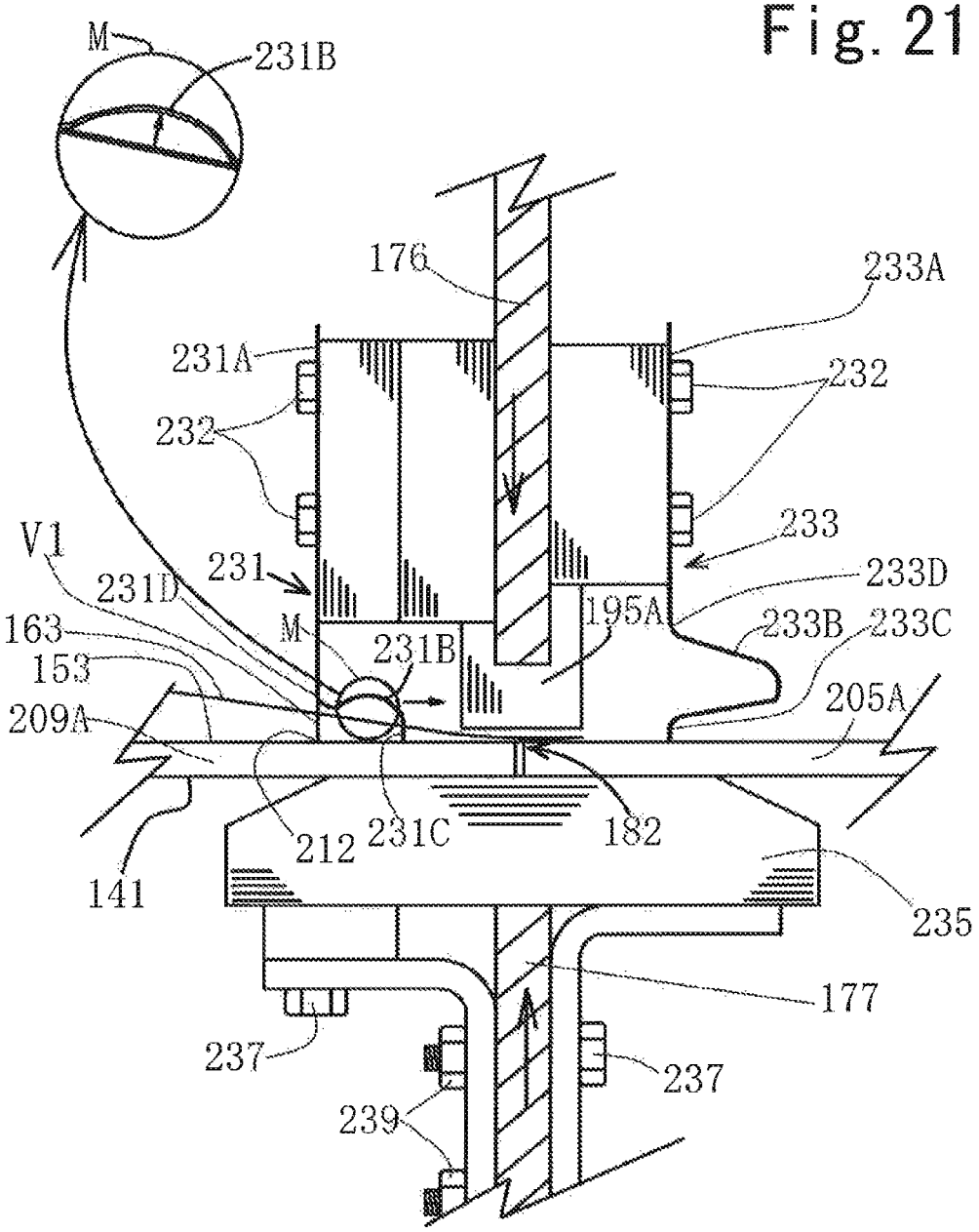

With still further movement, the veneer moving and holding leaf springs 231, 233 are moved toward their lowered operative positions shown in FIG. 21, which positions correspond to the second positions of the of the first and second springs, respectively, of the invention. During this movement of the veneer moving leaf spring 231 toward its operative position, the position of the tip end of the lower end portion 231C of the leaf spring 231 then stuck in the veneer sheet 209A, as viewed in the first direction 230, remains almost unchanged. Thus, the distance between the part 231D and the lower end portion 231C of the leaf spring 231 is reduced. Accordingly, the resiliently deformable inclined portion 231B of the leaf spring 231 is bent or curved upwardly away from veneer sheet 209A, as indicated by arrow shown in enlarged encircled insert M shown in FIG. 21. Such bending of the leaf spring 231 creates a force acting on the bent inclined portion 231B to restore to its original inclined shape, which in turn creates a force acting on the end portion 231C to move rightward and also a force acting on the part 231D of the leaf spring 231 to move in opposite leftward direction in FIG. 21, respectively. However, the part 231D, which is connected to the fixed base portion 231A, is barely moved, so that the force acting on the end portion 231C, whose tip end is stuck in the veneer sheet 209A supported at the bottom surface thereof by the veneer support block 235 having a low friction against veneer sheet surface, causes the veneer sheet 209A to move toward its preceding veneer sheet 205A, as indicated by arrow in FIG. 21, thus reducing or eliminating the gap between the two veneer sheets 205A, 209A. For allowing the veneer sheet 209A to move, the part 231D of the leaf spring need be clear of the veneer sheet 209A so that no braking force is applied to the veneer sheet 209A by the leaf spring 231.

On the other hand, further downward movement of the veneer holding spring 233 from the position of FIG. 20 causes its bent portion 233D to be resiliently deformed by being compressed in the third direction 236. This creates a force acting on the lower end portion 233 C of the leaf spring 233 in the third direction 236, with the result that the veneer sheet 205A is held down against the support block 235, so that the veneer sheet 205A is held firmly and kept from moving rightward by the force exerted by the veneer moving leaf spring 231.

Figure 22:
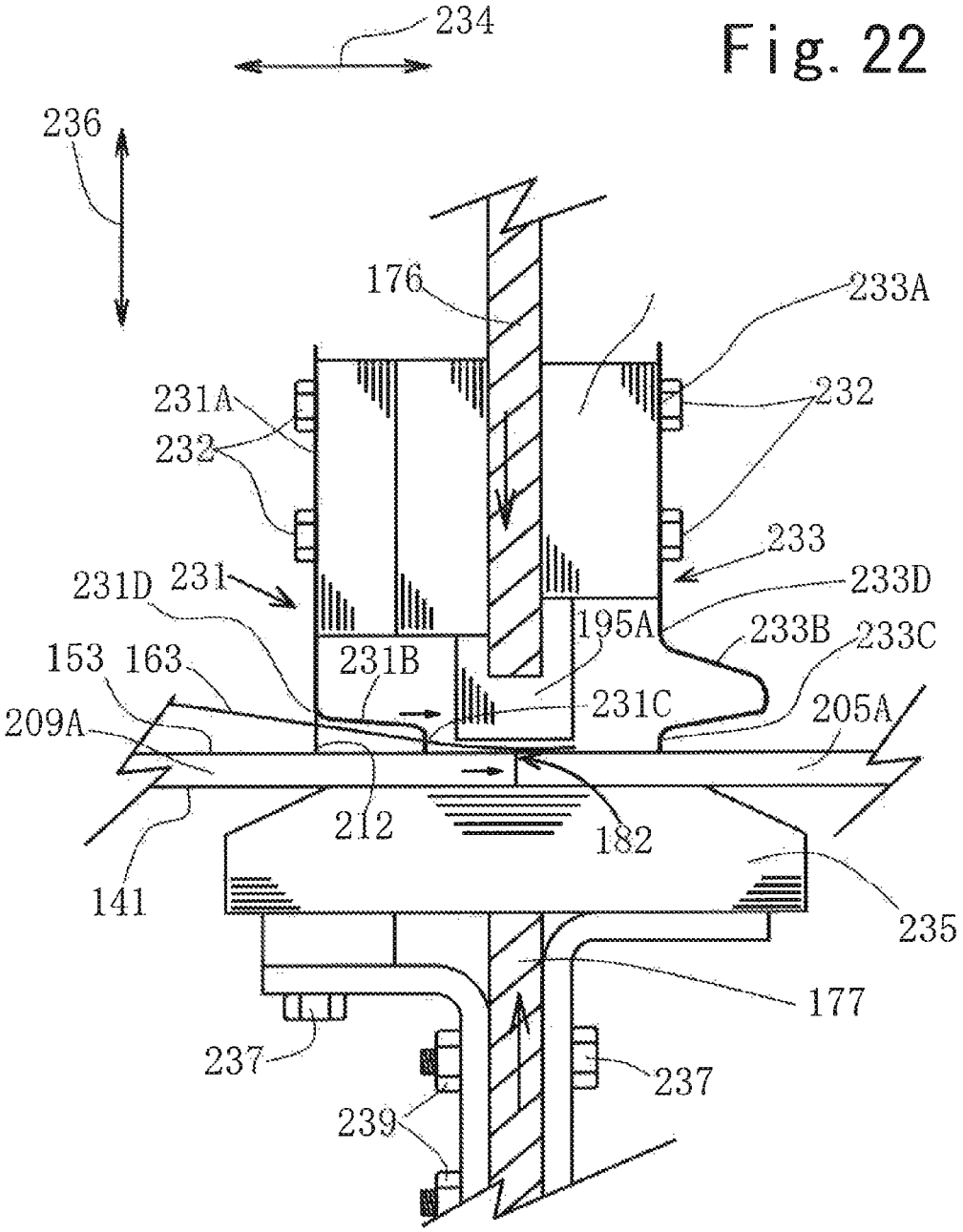
Figure 23:
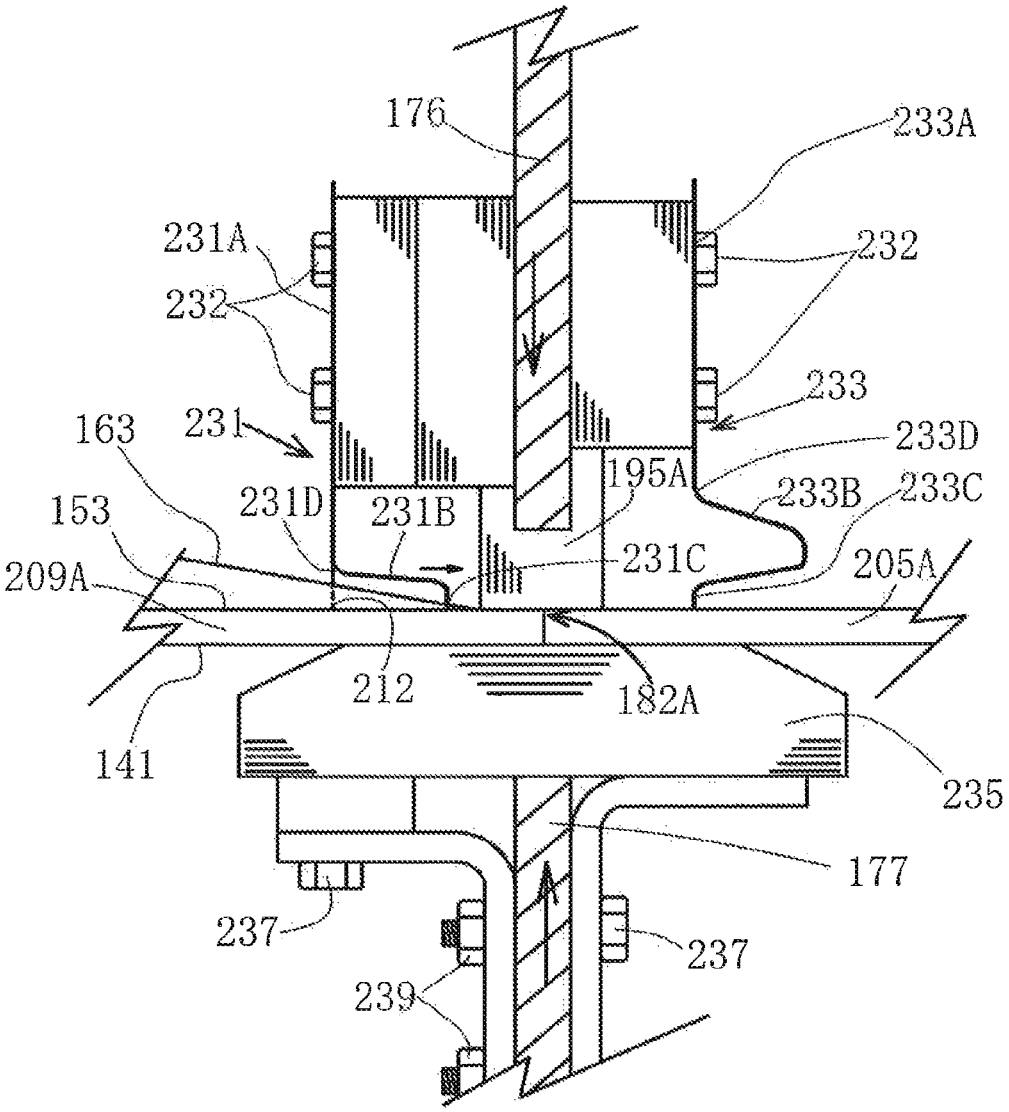

With the veneer sheet 205A thus held in place by the veneer holding leaf spring 233, the veneer sheet 209A is moved rightward as indicated by arrow until the cut leading edge 209B comes close to or is brought into contact with the cut trailing edge 205C of the preceding veneer sheet 205A so that the gap in the prospective joint 182 is reduced or substantially eliminated, as shown in FIG. 22. With the upper actuating plate 176 lowered to the position of FIG. 23, adhesive paper tapes 163 are applied to the prospective joint 182 and heated by the heaters 195A, 203A, thus accomplishing joining of two veneer sheets 205A, 209A and a completed joint 182A being formed, as shown in FIG. 23. Such joining is performed for each two adjacent veneer sheets transferred successively by the veneer transferring conveyor belts 141, 153. As stated earlier, a plurality of veneer sheets, each of which is made by joining a plurality of undersize effective sheets and cut into an integrated veneer sheet of a predetermined format size, is transferred to a station where such veneer sheets are stacked into a pile. As apparent to those skilled in the art, a veneer sheet of a format size having therein a joint 182A with reduced or eliminated gap is easier to handle and the problems associated with product quality stated earlier may be solved successfully.

In FIG. 22, veneer sheet 209A, which is located upstream of the prospective joint 182 and is yet to be joined to its preceding veneer sheet 205A, is a single sheet of veneer, while an integrated veneer sheet located downstream of the prospective joint 182 is made of a plurality of veneer sheets including veneer sheet 205A. Because the single veneer sheet 209A is lighter in weight than the preceding integrated veneer sheet, movement of the veneer sheet 209A for reducing or eliminating the gap between veneer sheets by the force exerted by the veneer moving leaf spring 231 may be accomplished easily.

Various modified embodiments of the invention will be described in the following.

Figure 24:
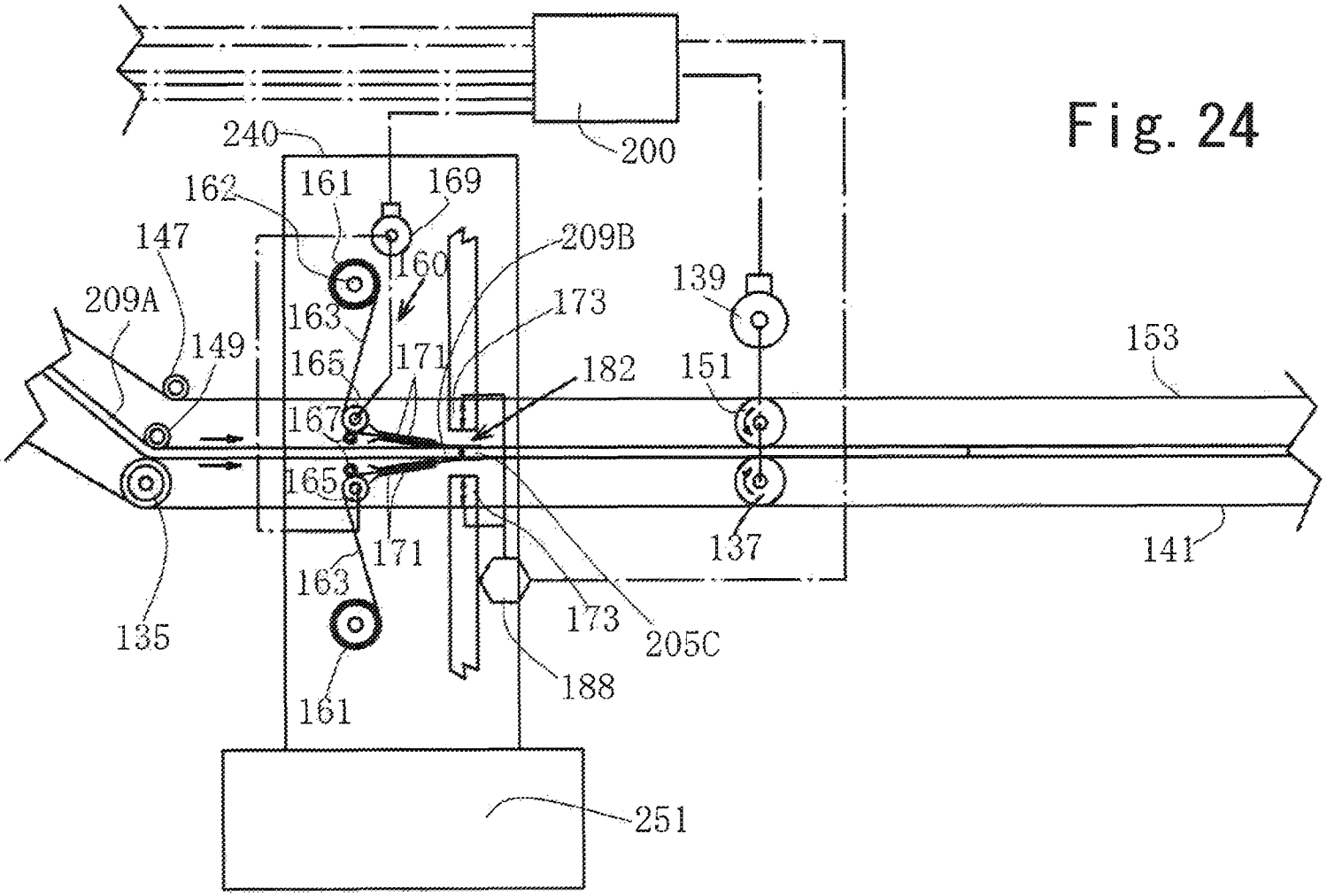
FIG. 24 is a fragmentary schematic side view of a veneer moving apparatus of a modified embodiment of the invention.

As stated earlier, for the adhesive paper tape 163 to exert desired adhesion in the above-described joining method, the adhesive tapes 163 need be pressed and heated, for example, for about ten seconds. However, other types of adhesive tape are available, including one that can exhibit good adhesion force by pressing and heading in a short period of time. If an apparatus using such adhesive tape, the carriage 155 need not be configured to be movable in conjunction with the movement of veneer sheets transferred by belts 141, 153. That is, the carriage 155 may be replaced with a stationary support 240 that is fixedly mounted to a stationary base 251, as shown in FIG. 24. It is noted that in FIG. 24 the illustration of veneer moving device is omitted for the sake of simplicity of illustration.

Operation of the veneer moving device of the embodiment of FIG. 24 will be described using the same reference numerals as those used in the preferred embodiment.

Veneer sheets 205A, 209A are moved by the veneer transferring conveyor belts 141, 153 so that the prospective joint 182 between the two veneer sheets 205A, 209A approaches a position between the heaters 195A, 203A. When the control 200 determines the arrival of the prospective joint 182 at the above position in response to a detection signal from the absolute encoder of the servo motor 139, the servo motor 139 is operated to stop the conveyor belts 141, 153 so that the prospective joint 182 is positioned between the heaters 195A, 203A. Then, the servo motor 169 is energized to drive the rolls 165 for feeding adhesive tapes 163. Subsequently, the servo motor 188 is energized to move the upper and lower actuating plates 176, 177 toward each other, thereby allowing the heaters 195A, 203A to press the tapes 163 against the adjoining veneer sheets 209A, 205A at the prospective joint 182. According to this embodiment wherein the adhesive tapes 163 may be just pressed and heated only for a short period of time, the efficiency in producing veneer sheets of a format size can be improved.

The veneer moving device in the embodiment of FIGS. 18 and 19 comprises the veneer moving leaf spring 231 and the veneer holding leaf spring 233 located on opposite sides of the prospective joint 182. However, the veneer sheet 205A, which is held by the leaf spring 233, as well as by the veneer transferring conveyor belts 141, 153, may be held in place only by the belts 141, 153. According to the present invention, therefore, the veneer holding leaf spring 233 may be dispensed with.

Figure 25:
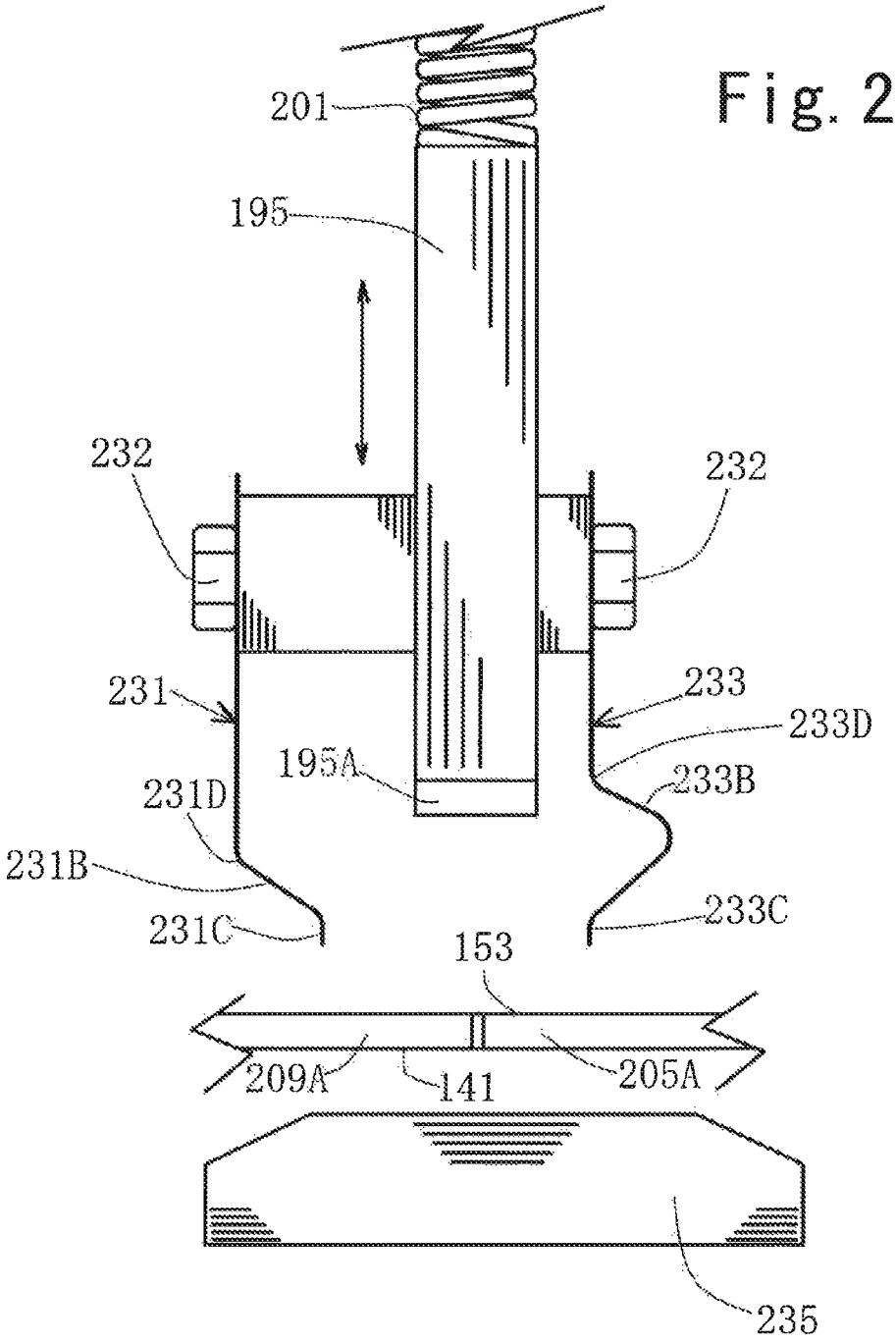
FIG. 25 is a fragmentary enlarged side view showing a veneer moving device according to a modified embodiment of the invention.

In the preferred embodiment of FIG. 19, the veneer moving and holding leaf springs 231, 233 fixed to the respective actuating plate 176, 177 are disposed in an offset relation to the heater holders 195, 203 in the first direction 230, as clearly seen from FIG. 18. According to the invention, the veneer moving and holding leaf springs 231, 233 may be fixed to the heater holder 195 by bolts 232 such that that the three parts, namely the leaf springs 231, 233 and the heater holder 195, are disposed aligned to each other in the first direction 230, as shown in FIG. 25. In the arrangement of FIG. 25 in which the two leaf springs 231, 233 and the heater holder 195 are assembled integrally, the structure of the veneer moving device becomes complicated.

According to the invention, means for joining veneer sheets may include adhesive, U-shaped staple and the like.

In the preferred embodiment and modified embodiment of FIG. 24, movement of veneer sheet 209A toward its preceding veneer sheet 205A to reduce or eliminate the gap at the prospective joint 182 and the subsequent application and pressing of adhesive tapes 163 to veneer sheets 209A, 205A at the prospective joint 182 are made at the same position along the first direction 230. In other words, the movement of veneer sheet 209A and the application of adhesive tapes 163 are performed without moving the prospective joint 182 relative to the leaf springs 213, 233 and the heaters 195A, 203A.

According to the invention, however, the reduction or elimination of the gap and the application of adhesive tapes 163 may be done at different positions as viewed in the first direction 230. Specifically, in the veneer moving apparatus shown in FIG. 26, the carriage 155 is replaced with the stationary support 240 that is fixedly mounted to the stationary base 251, as in the case of the embodiment of FIG. 24. The stationary support 240 has no adhesive tape feed device such as 160, but is equipped with the veneer moving leaf spring 231 and the veneer holding leaf spring 233.

This embodiment further differs from the previous embodiments in the arrangement of veneer transferring conveyor belts. Specifically, a pair of lower and upper driven rolls 241, 243 is provided and the paired veneer transferring conveyor belts 141, 153 are mounted around the rolls 241, 243, respectively. Another paired lower and upper idle rolls 245, 247 are located immediately downstream of the driven rolls 241, 243, and a pair of lower and upper driven rolls 249, 260 is disposed downstream of the idle rolls 245, 247, respectively. Lower and upper veneer transferring conveyor belts 253, 255 are trained around and between the rolls 245 and 249, and 247 and 260, respectively. The veneer transferring conveyor belts 253, 255 are provided by so-called package conveyor belt whose outer surfaces have a high coefficient of friction against the veneer by forming the belt surface that contacts with the veneer with a number of small projections made of an elastic material. The driven rolls 249, 260 and 241, 243 are driven to rotate synchronously by the aforementioned servo motor 139.

Figure 26:
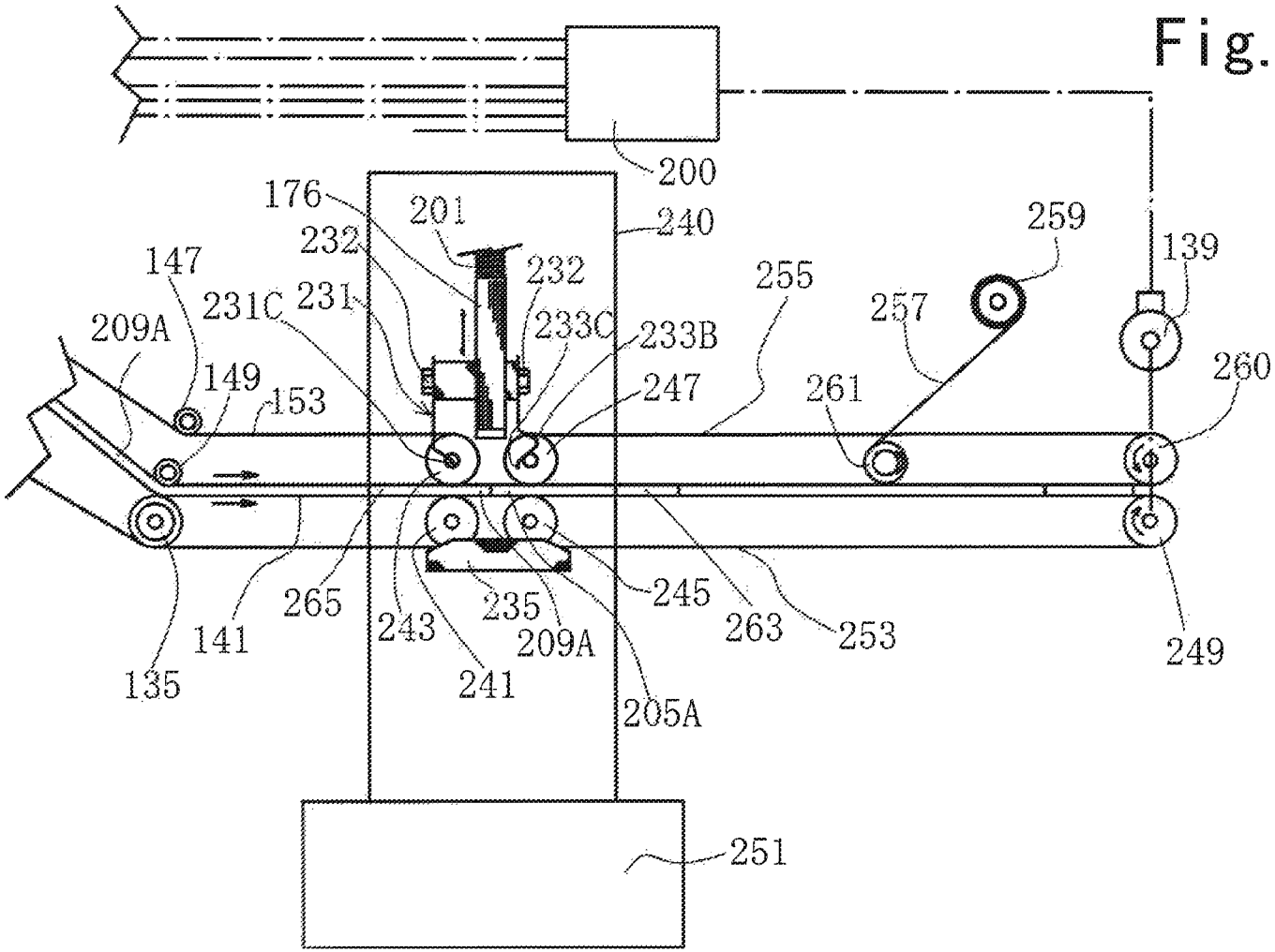
FIG. 26 is a fragmentary schematic side view of a veneer moving apparatus according to a modified embodiment of the invention.

Referring to FIG. 26, there is shown one of a plurality of adhesive tape supply devices disposed spaced along the first direction 230 of the veneer moving apparatus for supplying adhesive tapes 257 continuously to the upper surface of veneer sheet being transferred by the conveyor belts 253, 255. Each of the adhesive tape supply devices includes a tape unwinding reel 259 that unwinds an adhesive tape 257 and an idle roll 261 that applies the adhesive tape 257 to the upper surface of veneer sheet In operation, when the prospective joint 182 of any two adjacent veneer sheets being moved by the transferring conveyor belts 141, 153 and 253 255 reaches a position between the upper rolls 243, 247 as shown in FIG. 26, the driven rolls 241, 243 and 249, 260 are stopped by the servo motor 139. Then, the upper actuating plate 176 is lowered to move the leaf spring 231, 233 into engagement with the two adjacent veneer sheets 209A, 205A, respectively, so as to reduce or eliminate the gap between these two veneer sheets by moving the veneer sheet 209A toward the veneer sheet 205A by the leaf spring 231, as explained earlier. After the gap is reduced or eliminated, the upper actuating plate 176 is moved to its raised retracted position. Subsequently, the servo motor 139 is energized to drive the rolls 241, 243 and 249, 260, thus moving again the veneer sheets.

Because the outer surfaces of the transferring conveyor belts 253, 255 have a high friction against veneer surface, the veneer sheets 205A and 209A are transferred straight in the first direction 230 without changing the relative position while maintaining the aforementioned facing relation by the belts 253, 255. While the veneer sheets are being moved by the transferring conveyor belts 253, 255, adhesive tape 257 is applied to the top surface of the veneer sheets continuously by each of the adhesive tape application rolls 261. As stated earlier, a plurality of veneer sheets, each of which is made by joining a plurality of undersize effective sheets and cut into a predetermined format size, is transferred to a station where such veneer sheets are stacked into a pile.

In the above-described embodiments, the veneer moving leaf spring 231 is moved vertically linearly in the third direction 236 for allowing the tip end of the end portion 231C to stick into veneer sheet. According to the invention, however, the veneer moving leaf spring 231 may be configured to be turned from vertical position while being lowered toward veneer sheet.

Figure 28:
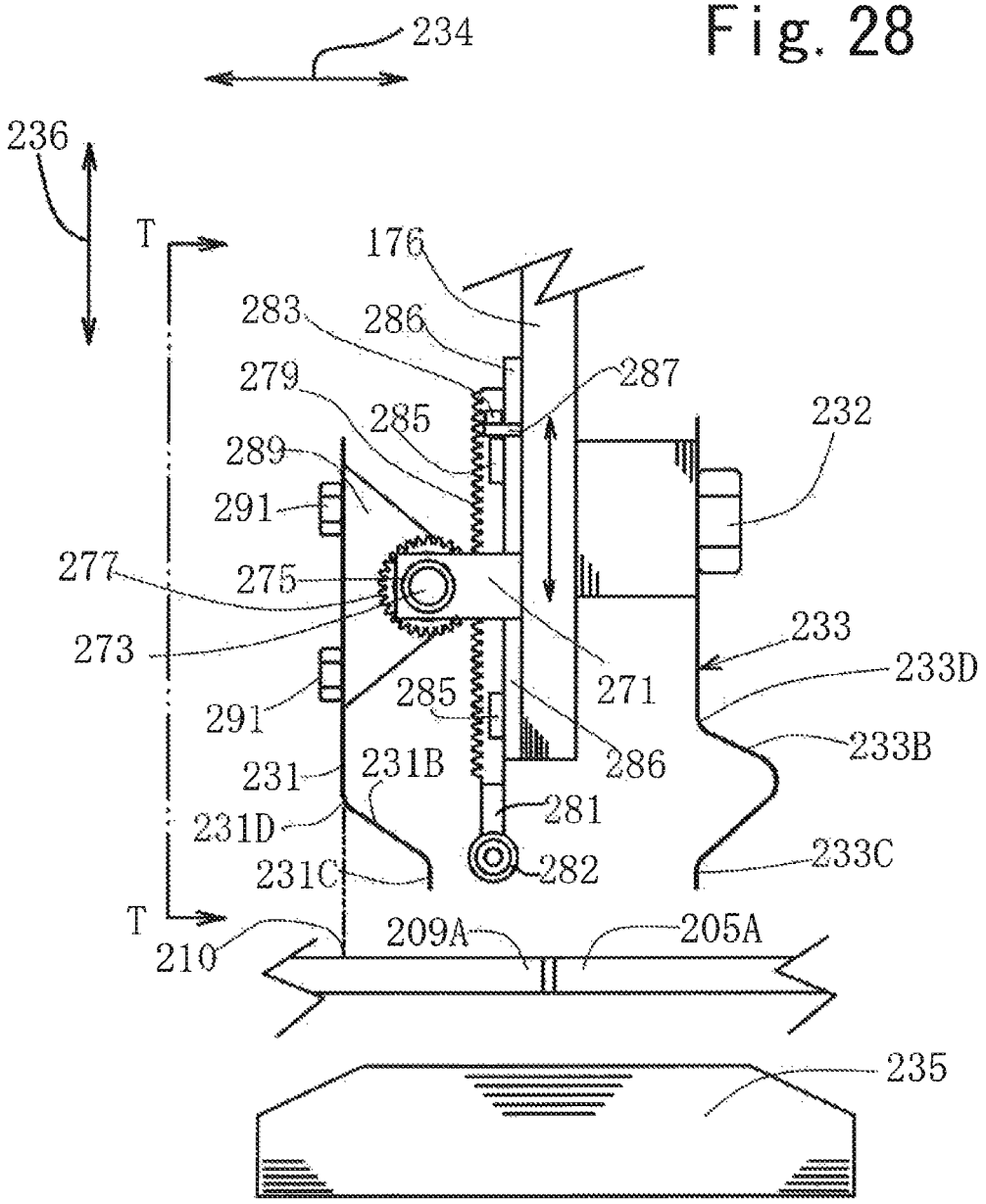
FIGS. 28 through 32 are fragmentary enlarged schematic side views showing a veneer moving device according to a modified embodiment of the invention.
Figure 29:
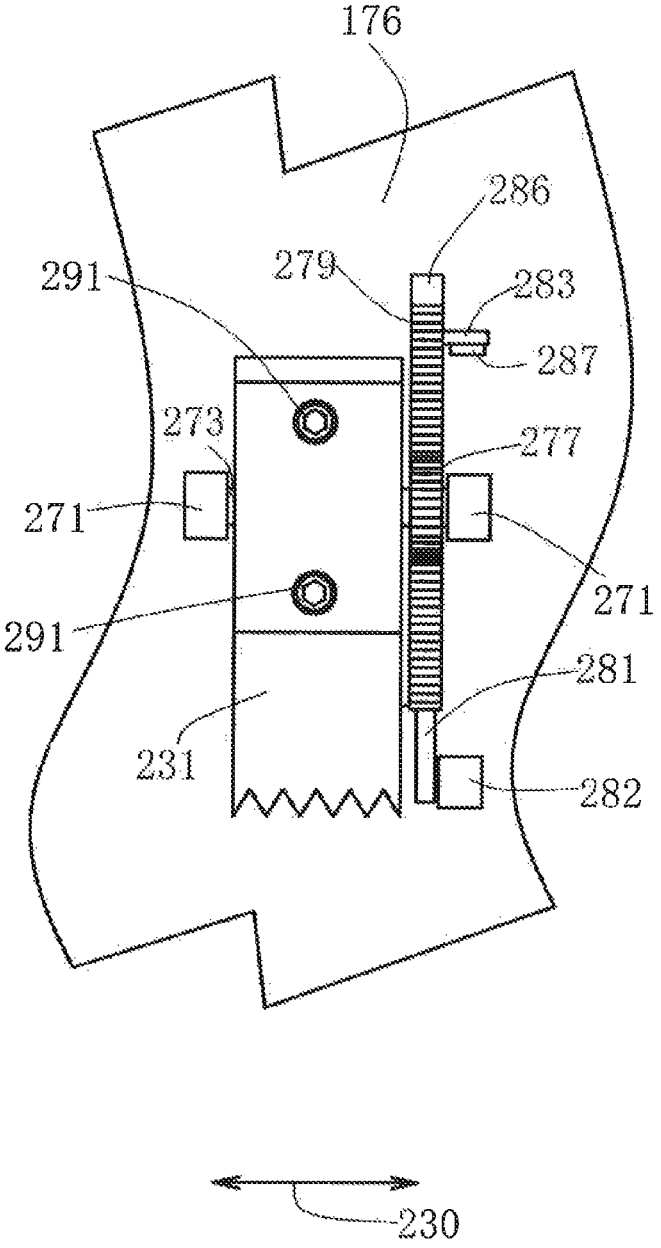

Referring to FIG. 28 showing a veneer moving device of a veneer moving apparatus of a modified embodiment of the invention and also to FIG. 29 showing the device as seen in arrow direction from line T-T in FIG. 28, numeral 271 designates a pair of bearing support blocks spaced in the first direction 230 and fixedly mounted to the upper actuating plate 176 that is reciprocally movable as indicated by double-headed arrow. A shaft 273 is rotatably supported at the opposite ends thereof by bearings 275 mounted in the bearing support blocks 271. A pinion gear 277 is fixed on the shaft 273 on one side thereof and a toothed rack 279 is fixed to linear blocks 285 which are slidably guided by a linear rail 286 fixed to the upper actuating plate 176. The pinion gear 277 is engaged with the toothed rack 279. The toothed rack 279 has at the bottom thereof a support bar 281 extending downward, and a freely rotatable roll 282 is mounted to the bottom of the support bar 281. A projection 283 is fixed to the toothed rack 279 at a position adjacent to the top of the rack 279. A stop 287 is fixed to the upper actuating plate 176 to prevent the toothed rack 279 from falling by its own weight by contacting with the projection 283. It is so configured in the above arrangement of parts that the bottom periphery of the roll 282 is positioned above the tip ends of the lower end portions 231C, 233C of the leaf springs 231, 233.

A turnable mounting block 289 is fixed on the shaft 273. Specifically, the mounting block 289 has formed therethrough a hole (not shown), and the shaft 273 is fixedly inserted through the hole. The mounting block 289 has a fan shape expanding leftward in FIG. 28, and the veneer moving leaf spring 231 is fixed to the left end surface of the mounting block 289 by bolts 291. Same veneer holding leaf spring 233 as those in the foregoing embodiments is fixedly mounted to the upper actuating plate 176 through a mounting block. As with the foregoing embodiments, a plurality of devices each comprising the veneer moving leaf spring 231, the veneer holding leaf spring 233, the toothed rack 279, and the pinion gear 277 is disposed spaced in the first direction 230.

Figure 30:
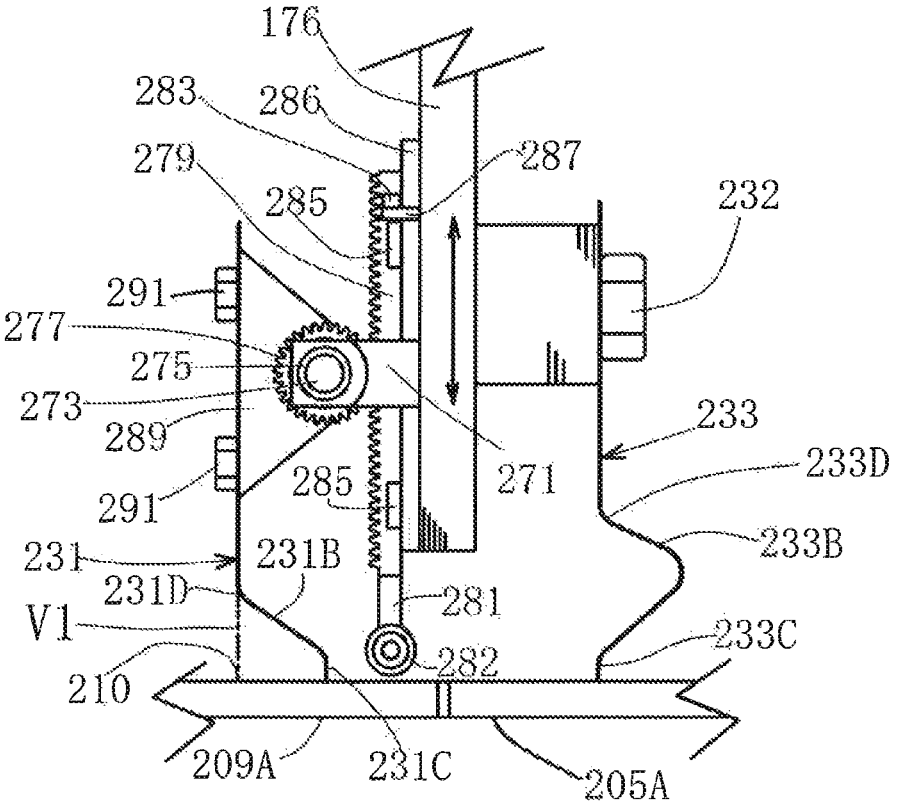

In operation, when the upper actuating plate 176 is at its raised retracted position as shown in FIG. 28, the toothed rack 279 is subjected to a downward force due to the weight of the rack 279 itself and other parts such as mounting block 289, but the contact of the projection 283 with the stop 287 fixed to the upper actuating plate 176 keeps the rack 279 from falling. In joining veneer sheets, the upper actuating plate 176 is lowered to move the veneer moving leaf spring 231 and the veneer holding leaf spring 233 to a position where the tip ends of the lower end portions 231C, 233C of the leaf springs 231, 233 are stuck into the veneer sheets 209A, 205A, respectively, as shown in FIG. 30. Such engagement of the lower end portion 233C of the leaf spring 233 holds the veneer sheet 205A in place without allowing the veneer sheet 205A to move in the first direction 230. In FIG. 30, reference symbol V1 is the imaginary plane that has been defined with reference to FIG. 19. Further downward movement of the leaf springs 231, 233 from the position of FIG. 30 causes the roll 282 to be brought into contact with the surface of veneer sheet 209A, as shown in FIG. 31, and the toothed rack 279, which is integral with roll 282, to move upward relative to the upper actuating plate 176, with the result that the pinion gear 277 engaged with the rack 279 starts to be turned in arrow direction.

Figure 31:
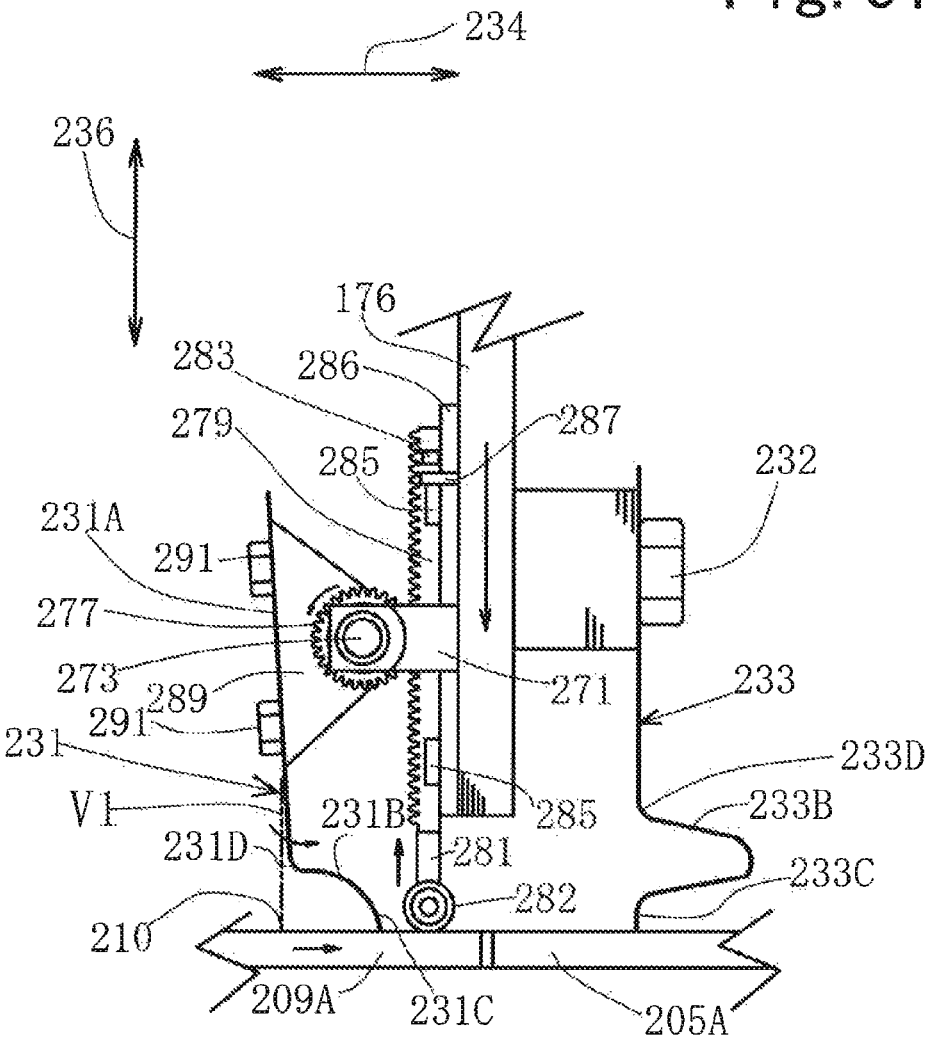
Figure 32:
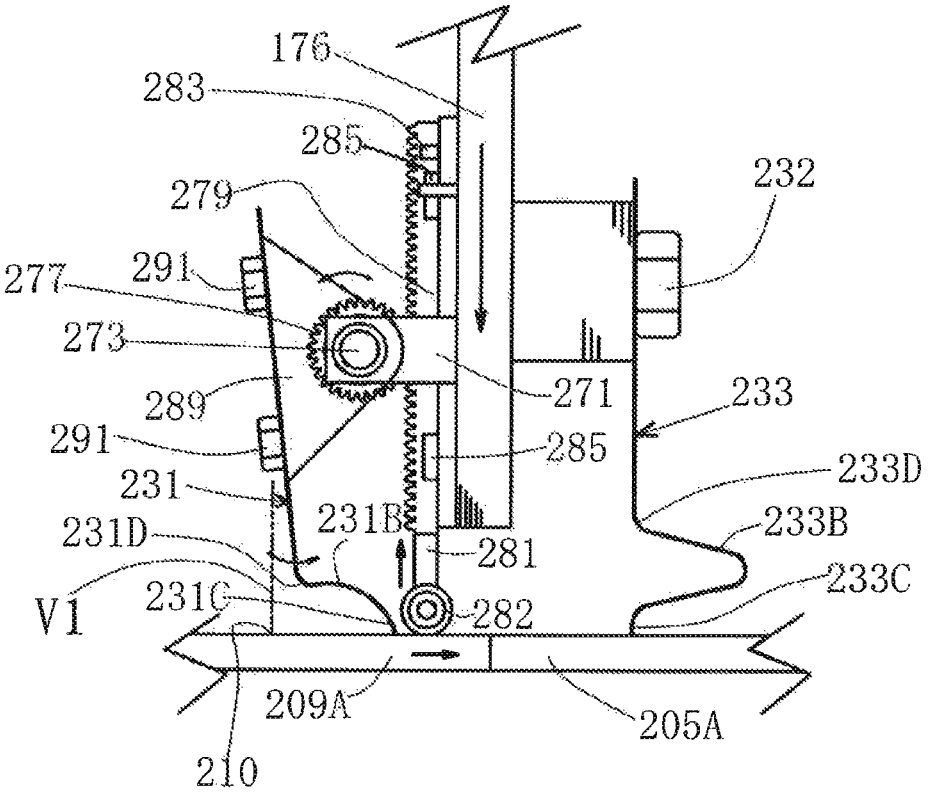

Accordingly, the shaft 273, the mounting block 289, and the veneer moving leaf spring 231, which are movable integrally with the pinion gear 277, are turned in arrow direction in FIG. 31, so that the part 231D of the leaf spring 231 is also turned in the arrow counterclockwise direction around the shaft 273, as shown in the drawing. Such turning of the part 231D of the leaf spring 231 does not then create a force that is strong enough to cause the lower end portion 231C stuck in the veneer sheet 209A to move in the second direction 234. With further turning of the moving leaf spring 231, the part 231D of the leaf spring 231 is turned along a circular path lying on the right side of the imaginary plane V1 in FIG. 31, to a position shown in FIG. 32. During the turning, the inclined portion 231B of the leaf spring 231 is elastically deformed or bent upward as shown in FIG. 32 by way of a state of FIG. 31. As has been described with reference to the preferred embodiment, such bending of the leaf spring 231 creates a force acting on the bent inclined portion 231B to restore to its original inclined shape, which in turn creates a force acting on the end portion 2310 to move rightward. Consequently, the end portion 231C, whose tip end is stuck in the veneer sheet 209A, causes the veneer sheet 209A to move toward its preceding veneer sheet 205A, as indicated by arrow in FIG. 32, thus reducing or eliminating the gap between the two veneer sheets 205A, 209A. After such movement of the veneer sheet 209A, adhesive tapes are applied to the prospective joint 182 thereby to join the two veneer sheets together, and the upper actuating plate 176 is moved back to its elevated retracted position.

In the foregoing embodiments, veneer sheets to be joined are transferred with the grain thereof extending in first direction 230, so that veneer joining is made at the edges of veneer sheets along the grain of veneer. According to the invention, however, veneer sheets may be joined along the edges formed extending across the veneer grain direction.

In the foregoing embodiments, a leaf spring is used as the veneer holding spring. For a spring to hold a veneer sheet firmly, the spring should be of a type that exerts a spring force in the third direction 236 without allowing veneer sheet to be displaced.

Figure 33:
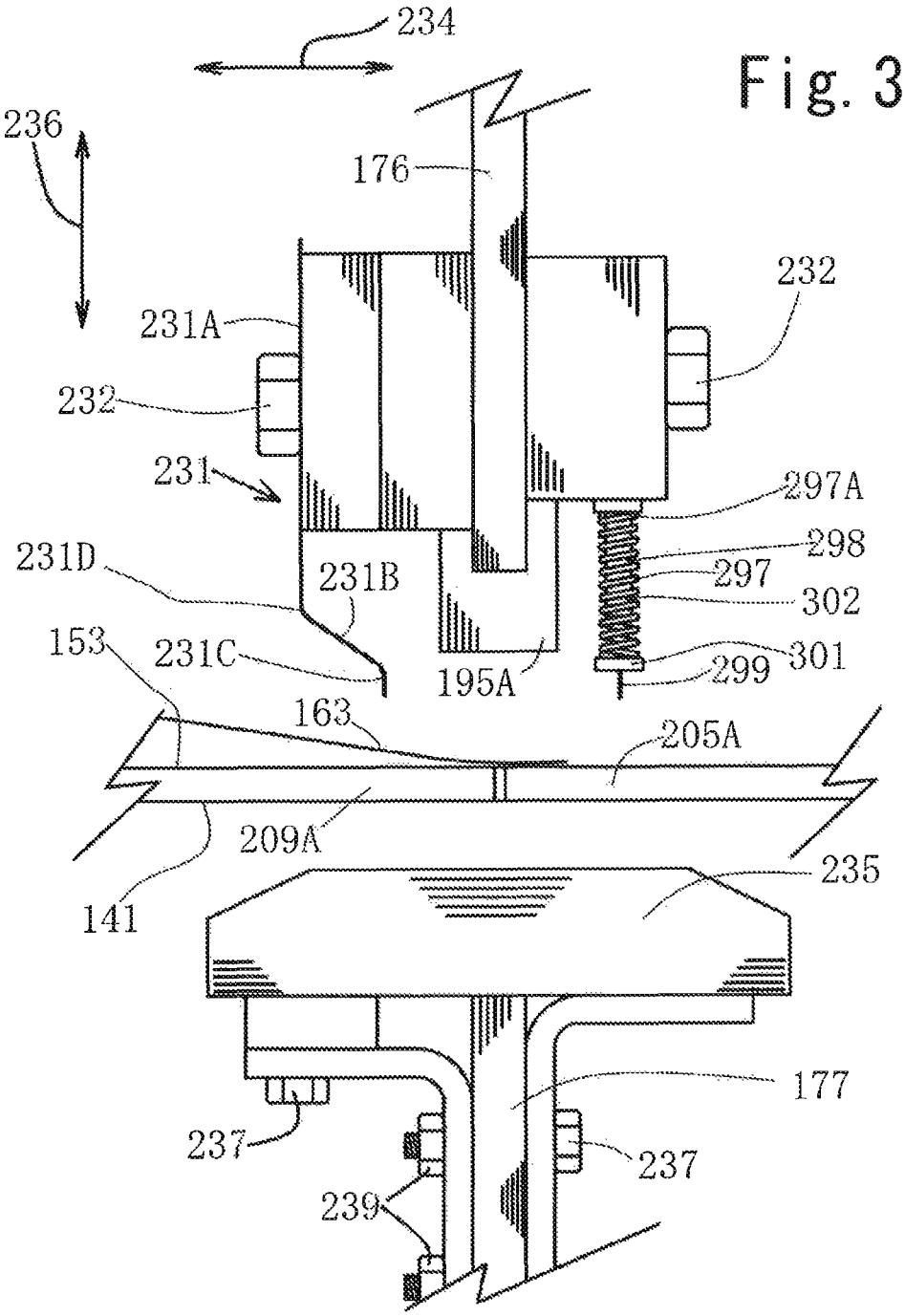
FIG. 33 is a fragmentary enlarged schematic side view of a veneer moving device according to a modified embodiment of the invention.

In FIG. 33, there is shown an embodiment of the invention in which a compression spring 297 is used in place of the leaf spring 233 for holding a veneer sheet. Specifically, the compression spring 297 is fixed at the top end 297A thereof, which corresponds to the first end portion of the invention, to the bottom of a mounting block which is in turn fixed to the upper actuating plate 176. The compression spring 297 has at the bottom thereof a holder 301 to which a projection 299 having sharpened tip end, which projection 299 corresponds to the second end portion of the invention, is fixed. As shown in FIG. 33, the veneer holding compression spring 297 has therein a cylindrical rod 302, whose top end is fixed to the mounting block and whose bottom end is spaced from the spring holder 301, for holding the compression spring 297 in a vertically straight position without allowing the spring 297 from being bent laterally when subjected to a force acting vertically on the spring 297. As with the case of FIGS. 20 and 21, downward movement of the upper actuating plate 176 causes the spring 297 to be resiliently deformed or compressed vertically and the projection 299 to stick into the veneer sheet 205A. Thus, the veneer sheet 205A is held securely against a force applied by the moving veneer sheet 209A.

According to the foregoing embodiments, the veneer moving leaf spring 231 and the veneer holding leaf or compression spring 233, 297 are moved downward by the upper actuating plate 176 so that the end portions 231C, 233C of both veneer moving and holding springs are stuck into the veneer sheets substantially simultaneously. According to the invention, however, the end portion 233C the veneer holding leaf or compression spring 233, 297 may stick into the veneer sheet earlier than the end portion 231C of the veneer moving leaf spring 231. By so doing, the gap between two veneer sheets may be reduced or eliminated with more certainty.

According to the foregoing embodiments, the end portions 231C, 233C of the veneer moving and holding springs 231, 233 are formed with a tip end having a plurality of sharpened or pointed edges. According to the invention, the tip end of the end portions may be made of any suitable material having a high coefficient of friction against veneer so as to prevent slippage relative to veneer sheet.

According to the above embodiments, two veneer sheets such as 205A, 209A set in proximity to each other with a prospective joint 182 formed therebetween are transferred by conveyor belts 141, 153. According to the present invention, however, veneer sheets may be transferred otherwise.

For example, a veneer sheet such as 205A is stopped without using a veneer holding leaf or compression spring when the cut trailing edge of the veneer sheet 205A reaches a predetermined position, and a following veneer sheet such as 209A is moved toward the veneer sheet 205A at a stop. The veneer sheet 209A is stopped when its cut leading edge is moved close to the cut trailing edge of the preceding veneer sheet 205C, and then the veneer moving spring and the veneer holding spring are actuated to allow the tip ends of the lower end portions to stick into the veneer sheet 209A, 20A, respectively, in the same manner as in the previous embodiments.

Figure 27:
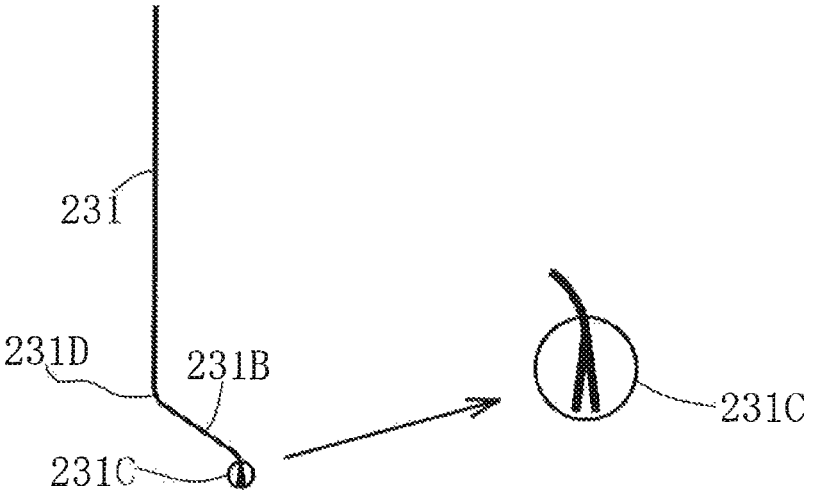
FIG. 27 is an enlarged view showing a tip end of an end portion of veneer moving leaf spring of a veneer moving device according to a modified embodiment of the invention.

In the above embodiments, the tip ends of the lower end portions 231C, 233C of the veneer moving and holding leaf springs 231, 233 have a plurality of sharpened points or edges formed aligned in the first direction 230, as clearly shown in FIG. 18. According to the invention, however, such sharpened edges may be formed in a staggered manner, or formed with the edges bent alternately in opposite directions, as shown in FIG. 27. The use of such end portions for the leaf springs 213, 233 helps protect veneer surface form having therein checks extending continuously in the grain direction of veneer sheet, thereby preventing formation of a crack in veneer sheet.

In the foregoing embodiments, the veneer moving leaf spring 231 and the veneer holding leaf spring 233 are move downward and upward integrally and hence simultaneously with each other. According to the invention, however, the two springs 231, 233 may be moved at different timings.

Figure 34:
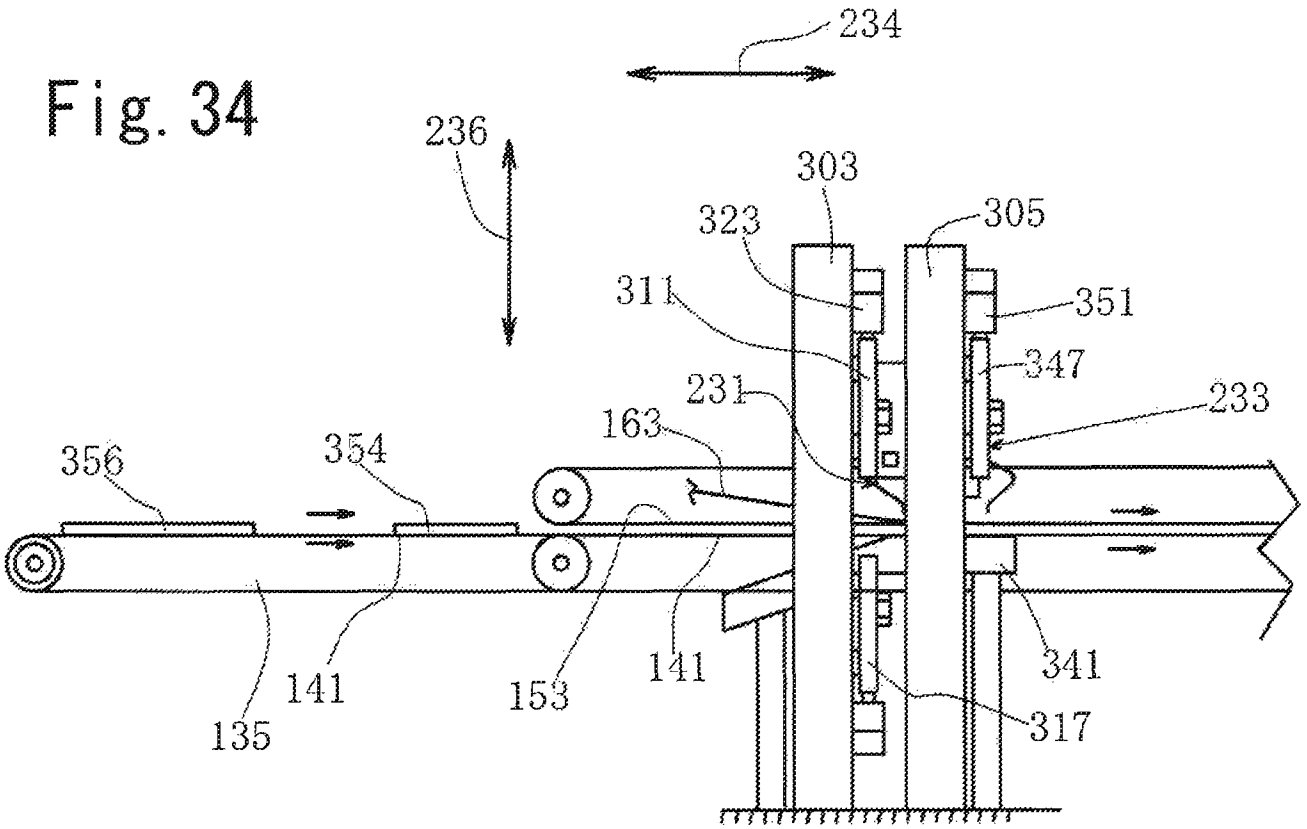
FIG. 34 is a fragmentary side view showing a veneer moving device of the veneer moving apparatus according to another preferred embodiment of the invention.
Figure 35:
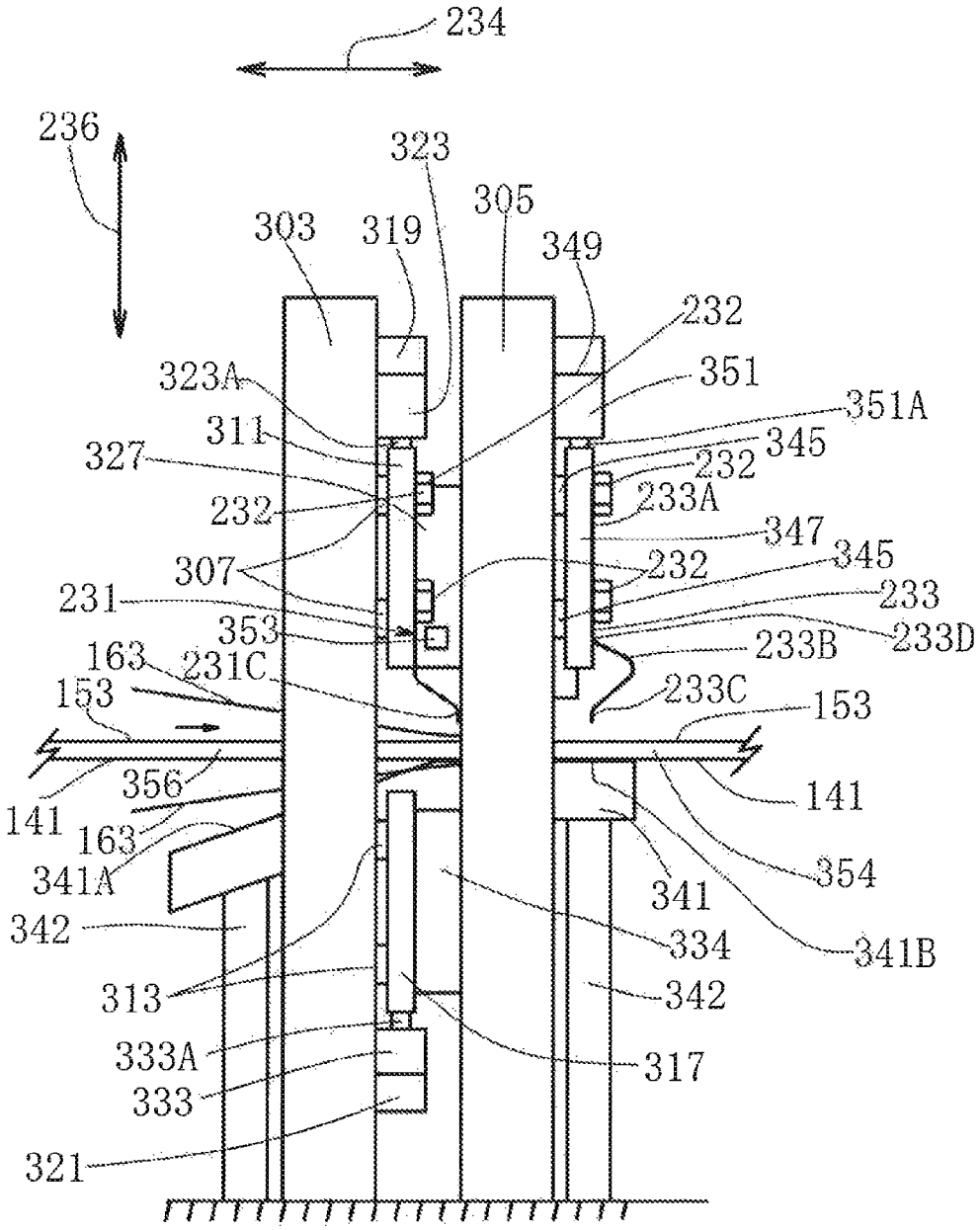
FIG. 35 is a fragmentary enlarged schematic side view showing the veneer moving apparatus of FIG. 34.
Figure 36:
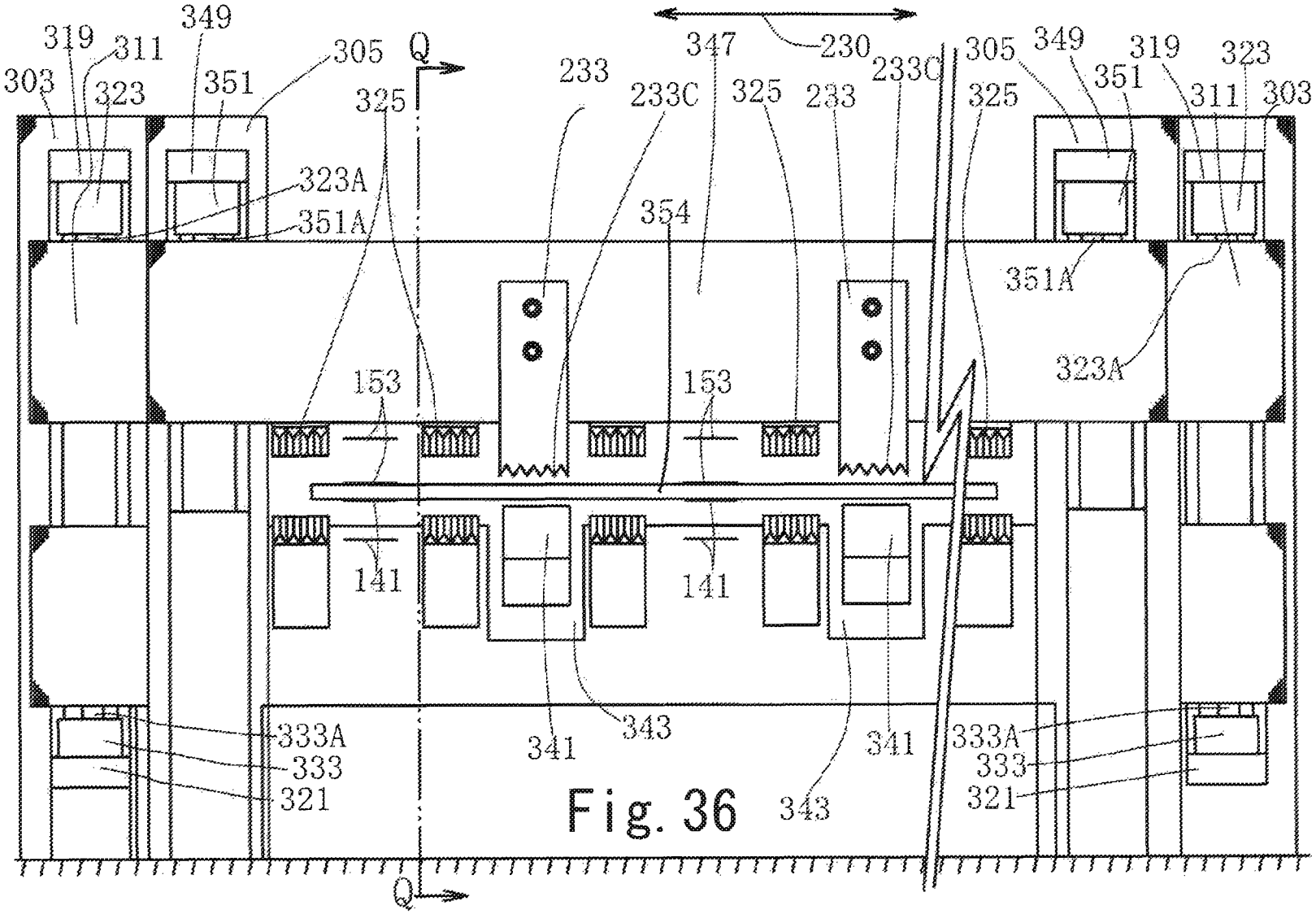
FIG. 36 is a fragmentary schematic view as seen from the right side of the veneer moving apparatus of FIG. 35.

Referring to FIGS. 34 and 36 showing a veneer moving apparatus according to another preferred embodiment of the present invention, reference numeral 303 designates a pair of outer support columns and 305 a pair of inner support columns, which are spaced in the first direction 230, respectively. The veneer transferring conveyor belt 153 is disposed above the veneer transferring conveyor belt 141. As shown in FIGS. 35 and 36, the paired support columns 303 are disposed outward of and upstream of the support columns 305 with respect to the direction in which veneer sheets are transferred by the conveyor belts 141, 153. An upper actuating plate 311 is slidably mounted to the outer columns 303 on the right side thereof as seen in FIG. 35 by way of linear guide devices 307. Similarly, a lower actuating plate 317 is slidably mounted to the outer columns 303 on the same side, but at a position below the upper actuating plate 311, by way of linear guide devices 313. Referring FIGS. 35 and 36, a pair of mounting blocks 319 is fixed to the outer support columns 303 at a position adjacent to the top thereof, projecting rightward as seen in FIG. 35. Similarly, a pair of mounting blocks 321 is fixed to the outer support columns 303 at a position adjacent to the bottom thereof, also projecting rightward.

Figure 38:
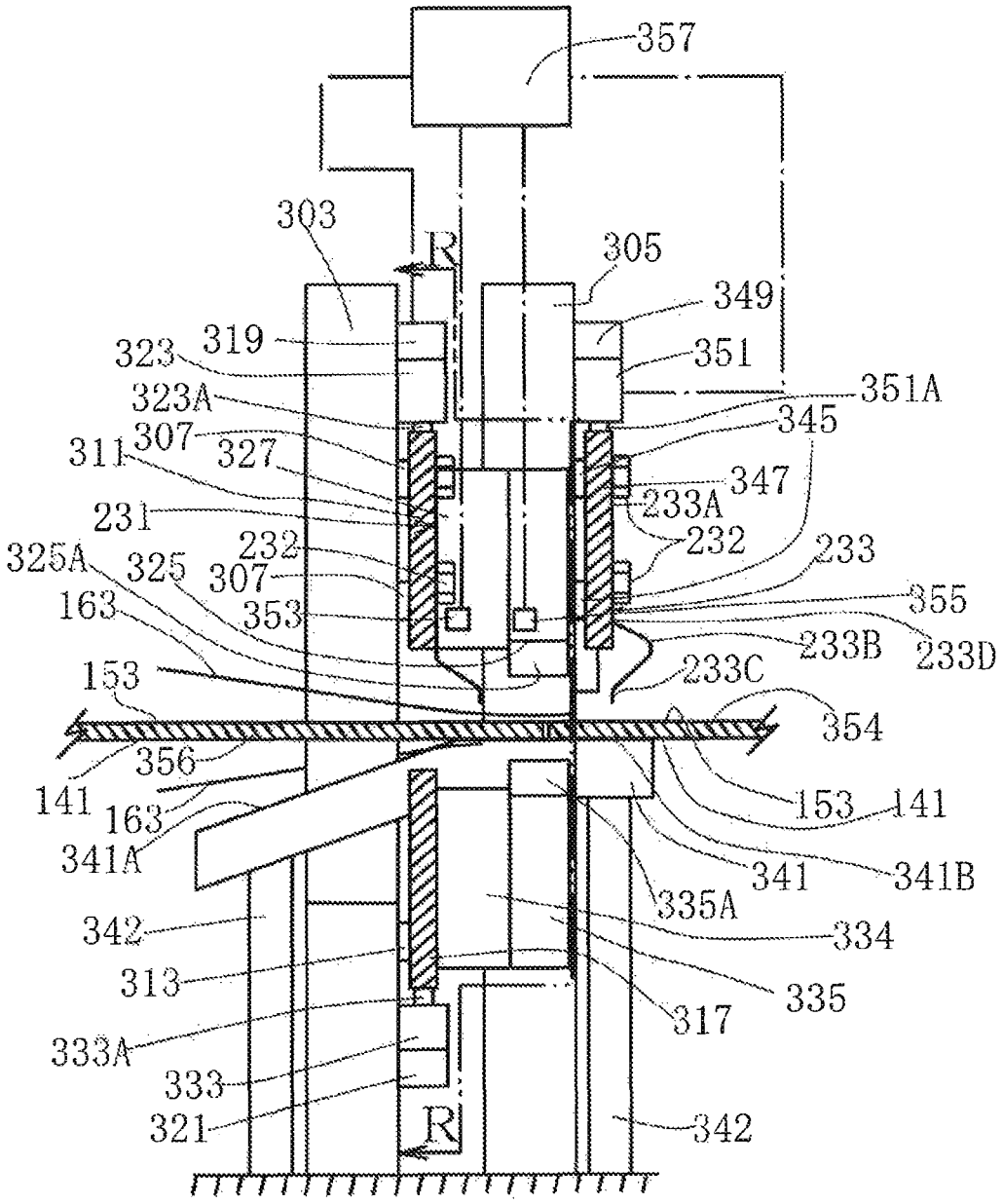
FIG. 38 is a fragmentary schematic side view as seen in arrow direction from line Q-Q of FIG. 36.
Figure 39:
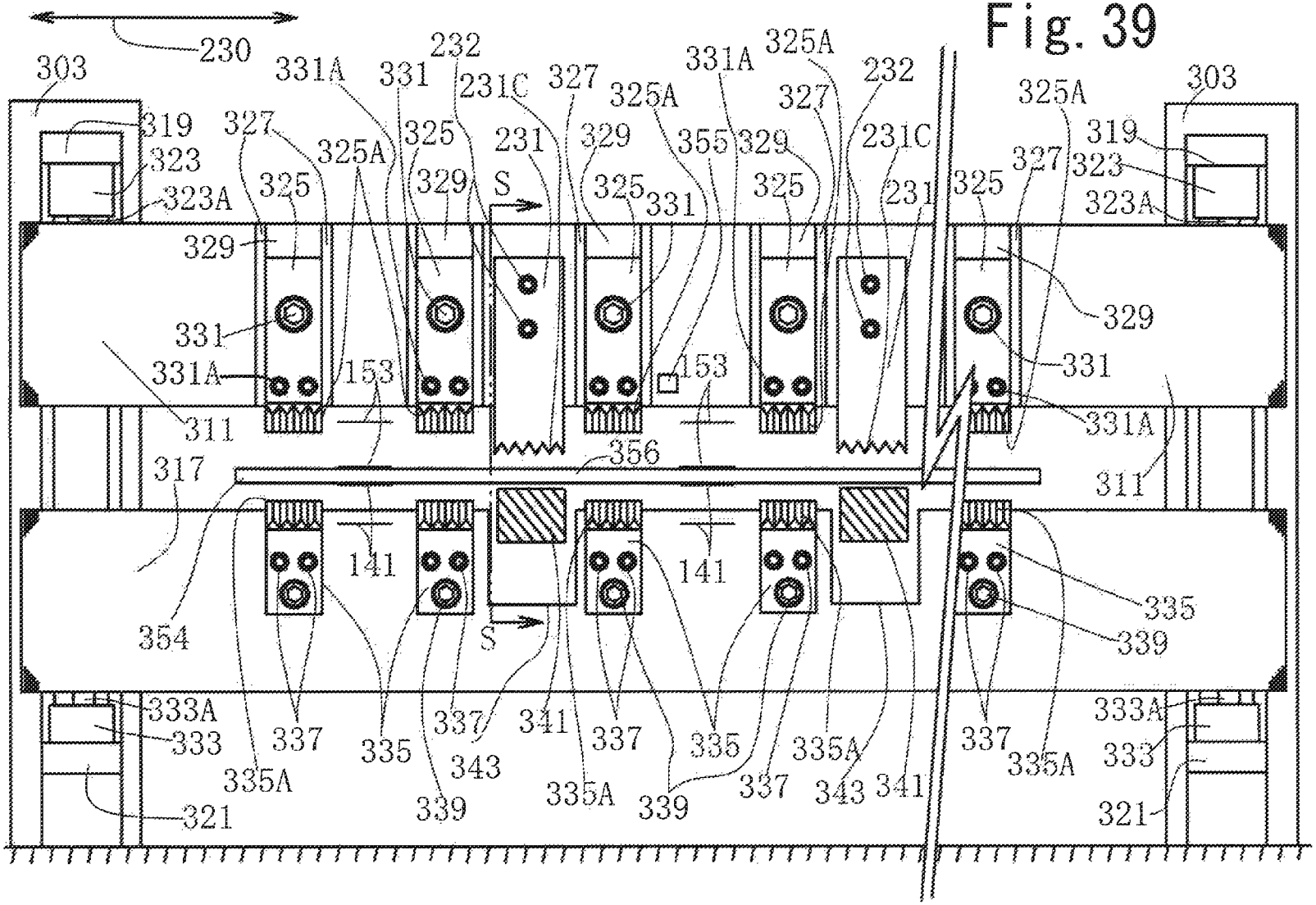
FIG. 39 is a fragmentary schematic view as seen in arrow direction from line R-R of FIG. 38.

Referring to FIGS. 35, 36 and 38, a pair of air cylinders 323 each having a piston rod 323A is connected to the bottom of the upper mounting blocks 319, and the piston rod 323A of each air cylinder 323 is connected to the upper actuating plate 311. Referring to FIG. 39 showing a view as seen in arrow direction from line R-R in FIG. 38, a plurality of veneer moving leaf springs 231, which are of substantially the same structure as the counterpart shown, e.g. in FIG. 19, is disposed spaced in the first direction 230 of the apparatus and fixed to the upper actuating plate 311 by bolts 232. As will be described in detail later, operation of the air cylinders 323 causes the veneer moving leaf springs 231 to move reciprocally between the elevated retracted position and the lowered operative position.

In FIGS. 38 and 39, reference symbol 325A designates a plurality of upper heaters disposed spaced in the first direction 230. Specifically, each of the heaters 325A is fixed by bolts 331A to the bottom of an upper heat holder 325. The heater holder 325 is received in a groove 329 formed in a mounting block 327 which is in turn fixed to the upper actuating plate 311. The heater holder 325 is positioned appropriately in the groove 329 and fixed to the mounting block 327 by bolt 331. In such structure, operating the air cylinders 323, the heater holders 325 are moved reciprocally between the elevated retracted position shown in FIGS. 38 and 39 where the heaters 325A are placed away from the veneer sheet and the lowered operative position where the heaters 325A are in pressing contact with the veneer sheet surface.

As shown in FIGS. 35 and 39, a pair of air cylinders 333 each having a piston rod 333A is fixedly mounted to the mounting blocks 321, and the piston rod 333A of each air cylinder 333 is connected to the lower actuating plate 317. A plurality of lower heater holders 335, each having a lower heater 335A fixed thereto at the top thereof by bolts 337, is fixed by bolts 337 to the lower actuating plate 317 by way of a mounting block 334 at position corresponding to the respective upper heater holders 325. Specifically, the mounting block 334 for each heater holder 335 is fixed to the actuating plate 317, and the heater holder 335 is fixed to its corresponding mounting block 334 in such a way that the top of the heater 335A is positioned slightly below the lower leg of the lower veneer transferring conveyor belt 141, as shown in FIG. 39. In such structure, operating the air cylinders 333, the lower heater holders 335 are moved reciprocally between the lowered retracted position shown in FIGS. 38 and 39 and the raised operative position where the heaters 335A are in pressing contact with the lower surface of veneer sheet.

Figure 37:
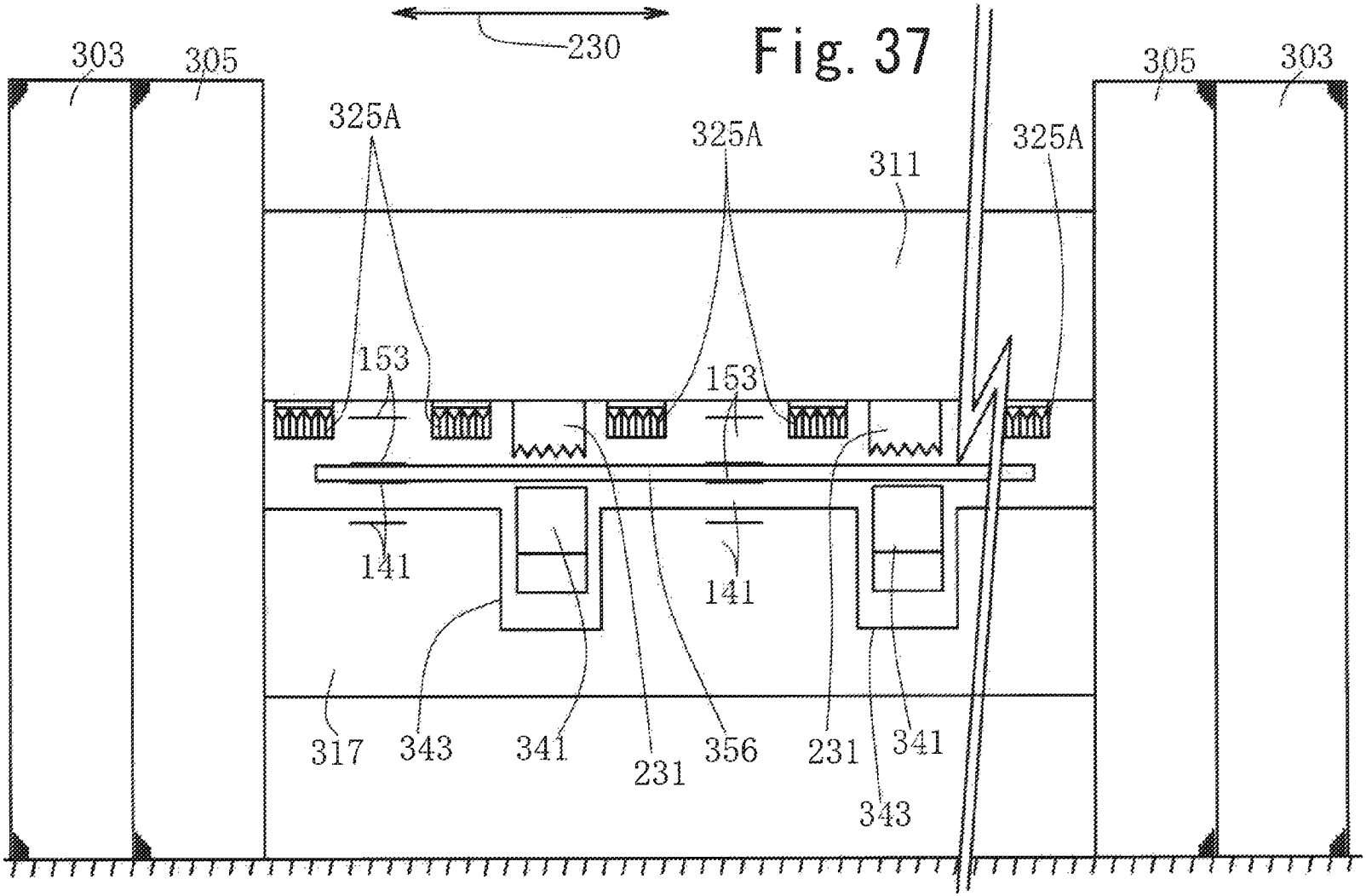
FIG. 37 is a fragmentary schematic view as seen from the left side of the veneer moving apparatus of 35.

Referring to FIGS. 35, 38 and 39, numeral 341 designates a stationary veneer support block provided for each paired veneer moving and holding leaf springs 231, 233. As shown in FIGS. 35, 37 and 39, the veneer support block 341 is disposed extending through a cut 343 formed in the upper part of the lower actuating plate 317. As shown in FIG. 35, a downstream part of the veneer support block 341 is disposed immediately below and facing the veneer moving and holding leaf springs 231, 233. The veneer support block 341 is supported at portions thereof adjacent to the opposite ends in the first direction 230 by two support members 342. As shown in FIG. 38, the veneer support block 341 has a surface 341A that is inclined upwardly from the upstream end of the block 341 to a position adjacent to the lower end portion 231C of the veneer moving leaf spring 231 and a flat surface 341B that continues from the inclined surface 341A and is formed below the leaf springs 231, 233.

Referring to FIG. 38, an actuating plate 347 for the veneer holding leaf springs 233 is vertically slidably mounted to the paired inner support columns 305 by way of linear guide devices 345. Specifically, a pair of mounting block 349 is fixed to the inner support columns 305 at a position adjacent to the top thereof, projecting rightward in FIG. 35. As shown in FIGS. 35 and 36, a pair of air cylinders 351 each having a piston rod 351A is connected to the bottom of the mounting block 349, and the piston rod 351A is connected to the actuating plate 347. A plurality of veneer holding leaf springs 233, which are of substantially the same structure as the counterpart shown, e.g. in FIG. 19, is disposed along the first direction 230 of the apparatus and fixed to the actuator plate 347 by bolts 232. The veneer holding leaf springs 233 are disposed at positions corresponding to the respective veneer moving leaf springs 231. In such structure, operation of the air cylinders 351 causes the veneer moving leaf springs 231 to move between the elevated retracted position and the lowered operative holding position.

Numeral 353 in FIGS. 35 and 38 designates a first sensor that detects a cut leading edge of a veneer sheet, and numeral 355 a second sensor that detects a cut trailing edge of the veneer sheet. Numeral 357 in FIG. 38 designates a control that receives detection signals from the sensors 353, 355 and generates to the air cylinders 323, 333, 351 signals that control the operation of such air cylinders. Furthermore, numeral 163 in FIGS. 35 and 38 designate adhesive paper tapes to be applied to opposite surfaces of veneer sheets.

The following will describe operation of the veneer moving apparatus according to the above preferred embodiment of the invention with reference to the relevant drawings.

In the initial state of the apparatus, the transferring conveyor belts 141, 153 are running in arrow direction and the veneer moving leaf spring 231, the heater holders 325, 335, and the veneer holding leaf spring 233 are placed in their retracted positions, respectively, as shown in FIGS. 34 and 35. Thus, veneer sheets such as 354, 356 are being transferred rightward as indicated by arrow in FIGS. 34 and 35.

Figure 40:
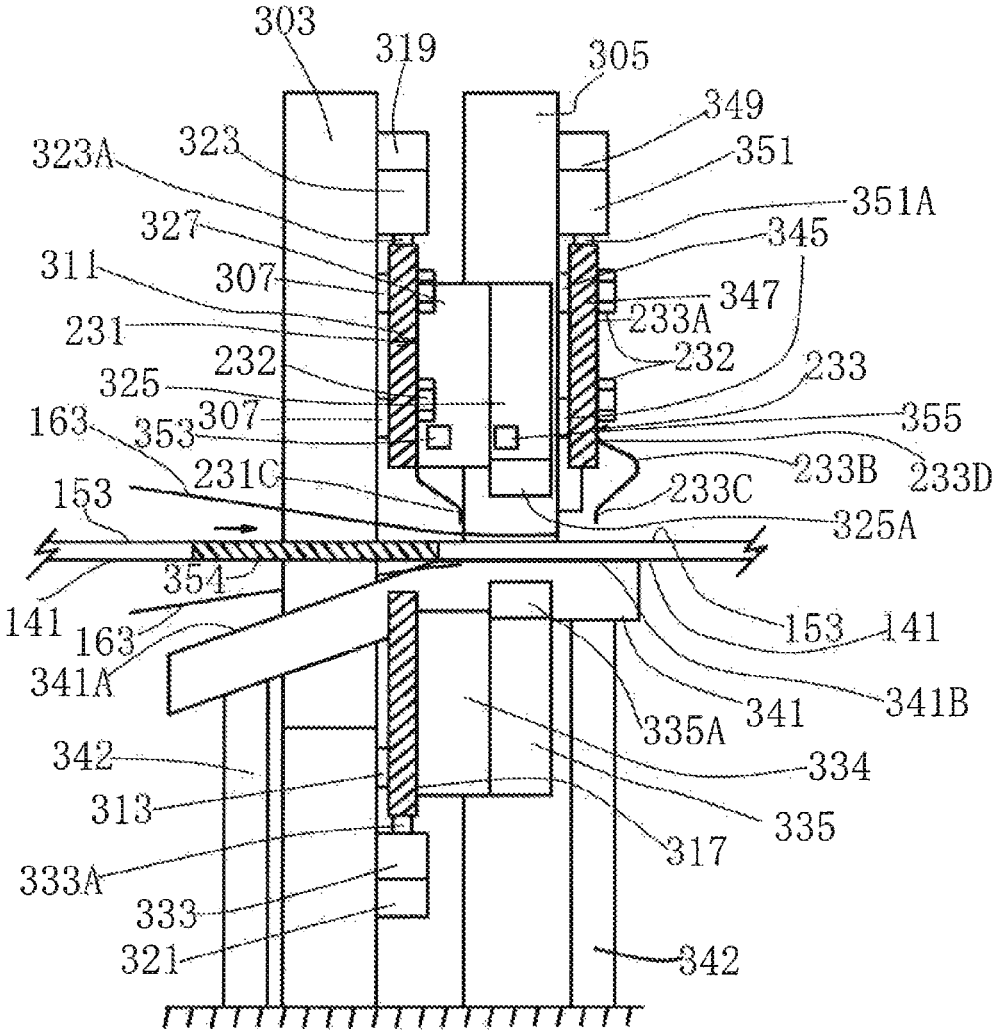
FIGS. 40 through 48 are schematic illustrative side views showing various steps of operation of the veneer moving apparatus shown in FIG. 34.
Figure 41:
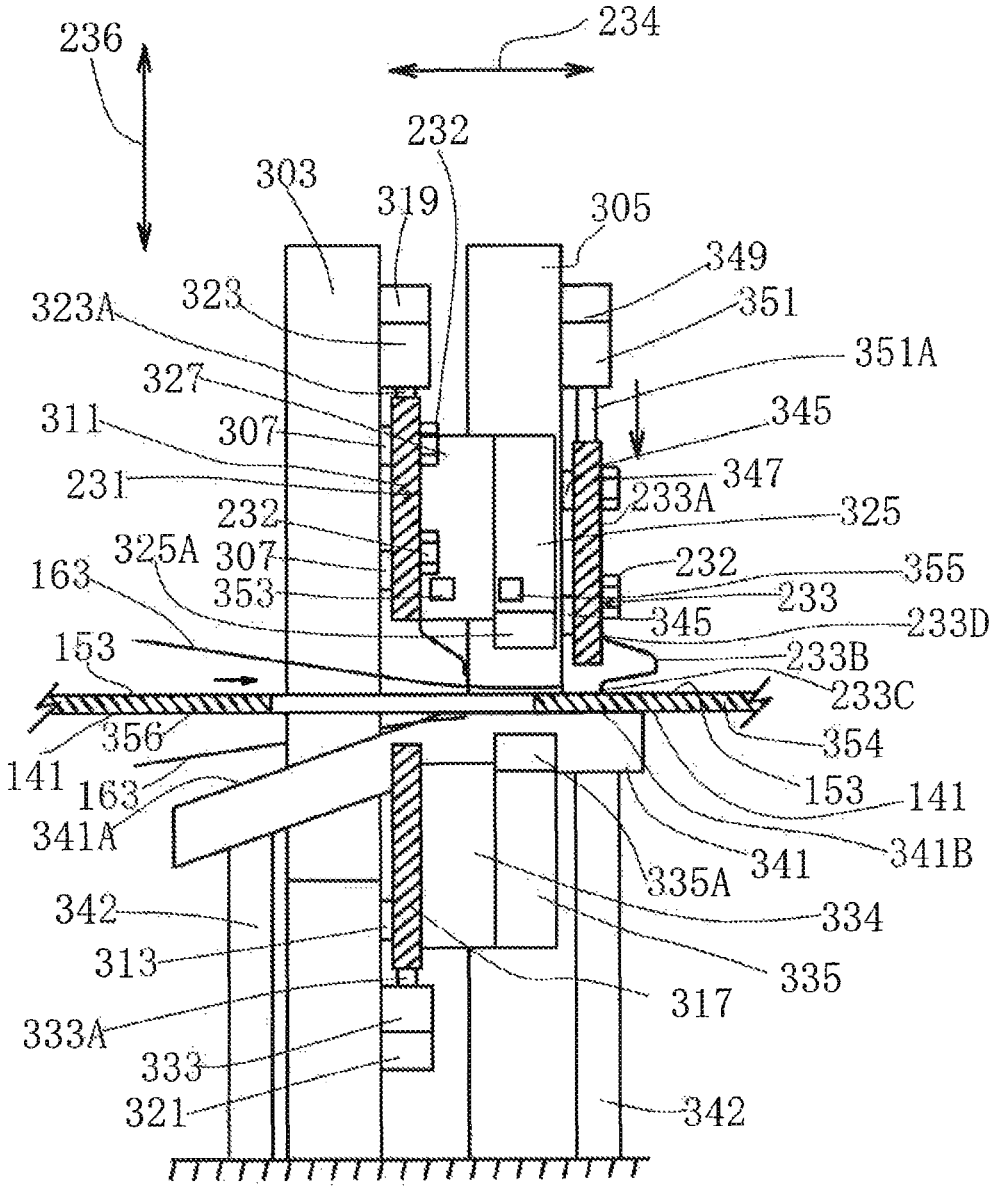
Figure 42:
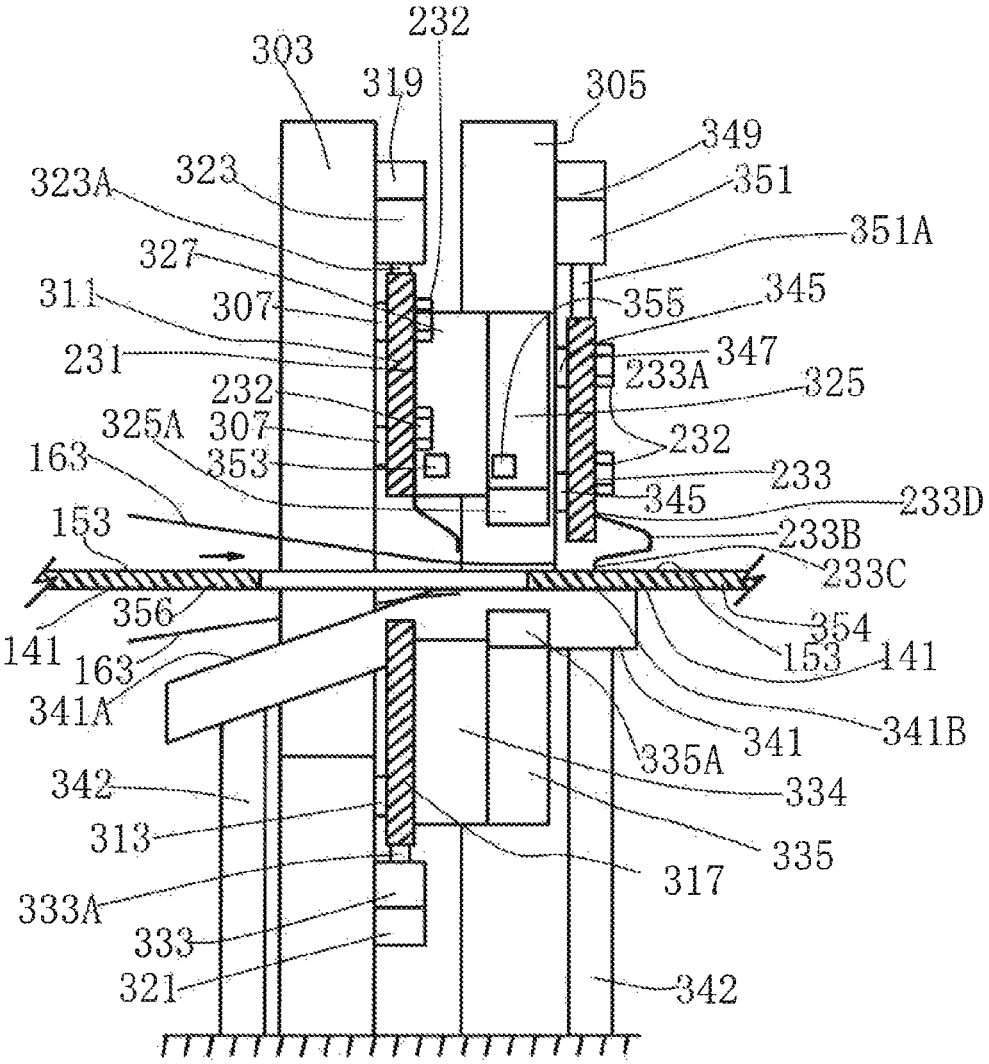

When the leading cut edge of veneer sheet 354 moves just below and hence is detected by the first sensor 353, as shown in FIG. 40, the first sensor 353 generates a detection signal to the control 357, although the control 357 is yet to transmit an operation signal. When the trailing cut edge of the same veneer sheet 354 moves just below and is detected by the second sensor 353, the sensor 353 generates another detection signal to the control 357. Responding to such detection signals from the sensors 353, 355, the control 357 generates an operation signal that actuates the air cylinders 351 and extends their piston rods 351A downward as indicated by arrow in FIG. 41. Accordingly, the actuating plate 347 is lowered with the veneer holding leaf springs 233 to a position shown in FIG. 42 where the tip end of the lower end portion 233C of each leaf spring 233 is stuck into the surface of veneer sheet 354, thereby pressing down the veneer sheet 254 against the flat surface 341 B of the veneer support block 341. The veneer sheet 354 being moved by the transferring conveyor belts 141, 153 is stopped and kept from moving further.

The control 357 is configured to actuate the air cylinders 351 at such timing and speed that veneer sheet 354 is stopped appropriately at a position where the cut trailing edge of the veneer sheet 354 is positioned substantially at the center of the heater 325A along the direction 234.

Figure 43:
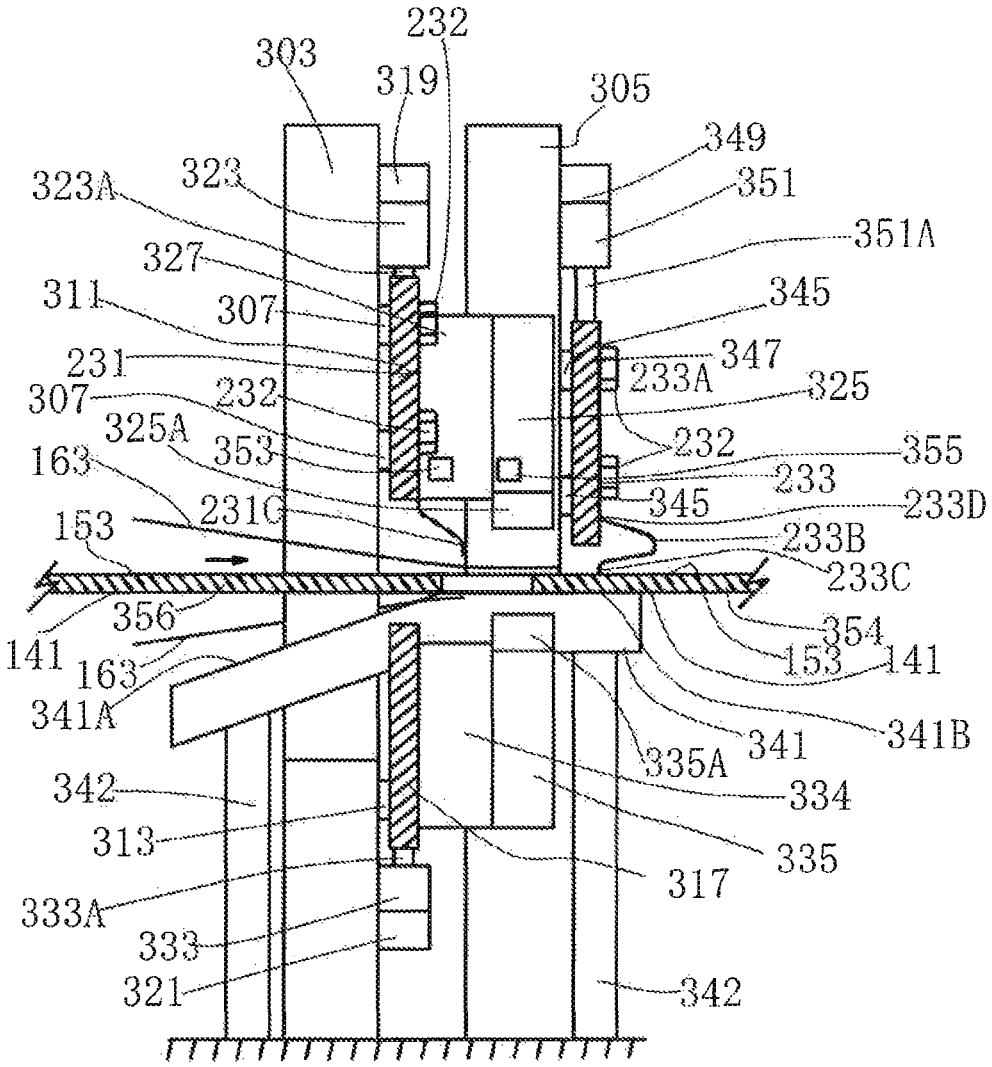
Figure 44:
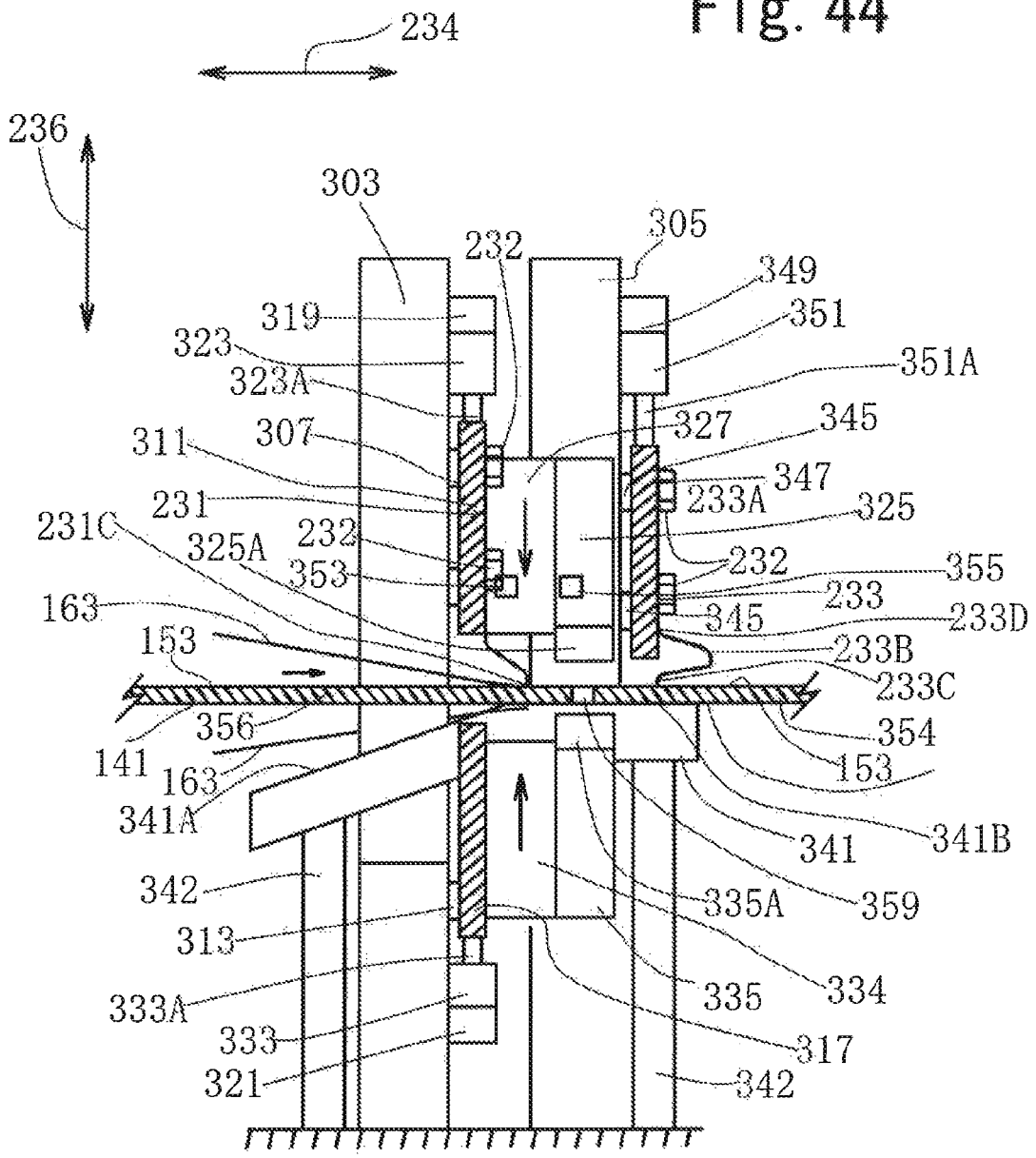

When the cut leading edge of the next veneer sheet 356 moves just below and is detected by the first sensor 353, as shown in FIG. 43, the sensor 353 generates a detection signal to the control 357. In response to such detection signal, the control 357 generates operation signals to actuates the air cylinders 323, 333 for extending the piston rods 323A, 333A, thereby lowering the upper actuating plate 311 with the veneer moving leaf springs 231 and the upper heater holders 325 and, simultaneously, raising the lower actuating plate 317 with the lower heater holders 335. As a result, the heaters 335A are moving toward the lower surface of veneer sheet 354, and the end portions 231C of the veneer moving leaf springs 231 are brought into contact with the upper surface of veneer sheet 354, as shown in FIG. 44. Operation of the air cylinders 323 is so time-controlled by the control 357 that there still exists a gap between the veneer sheets 354 and 356, as shown in FIG. 44, when the end portions 231C of the veneer moving leaf springs 231 are just brought into contact with the surface of veneer sheet 356.

Figure 45:
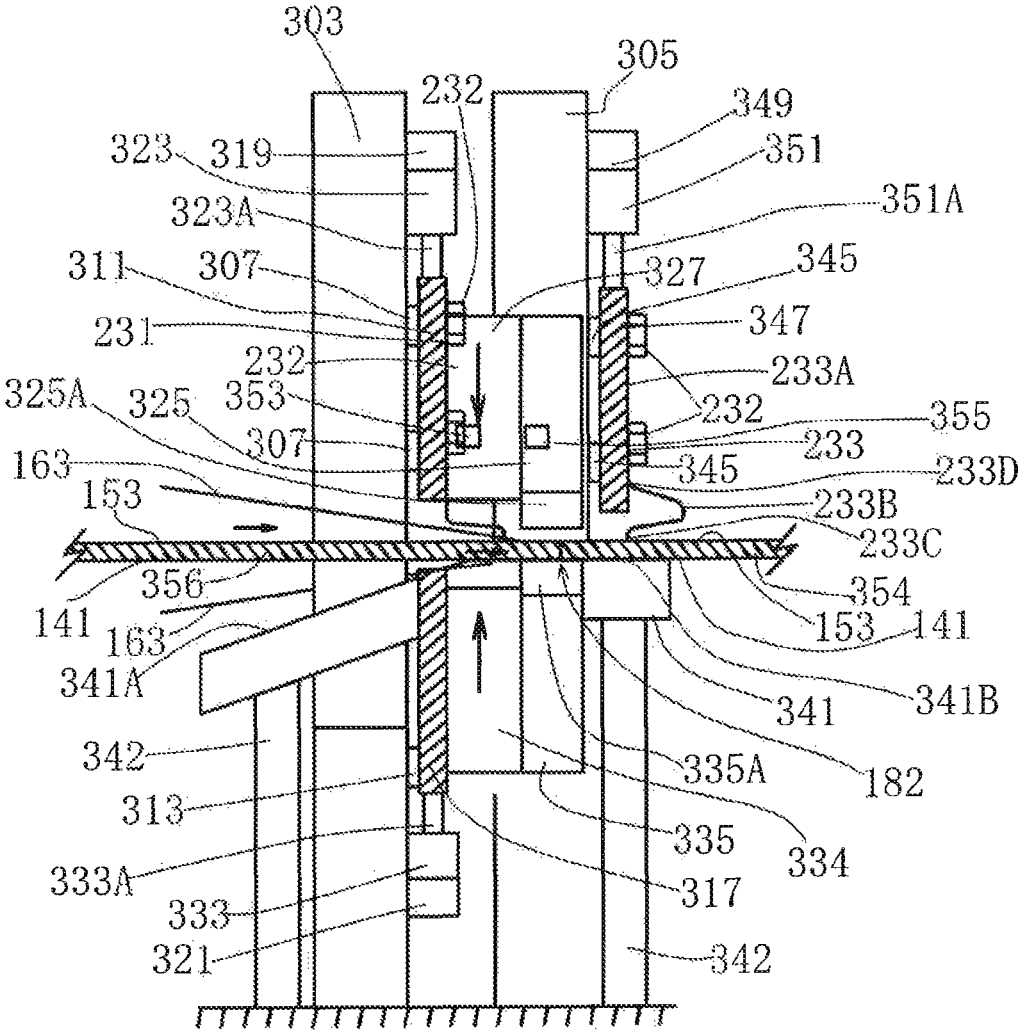

With further extension of the piston rods 323A, the veneer sheet 356 is moved by the leaf springs 231 in the second direction 234 into contact with the cut trailing edge of its preceding veneer sheet 354, thus the gap between the two veneer sheets being reduced or eliminated, as shown in FIG. 45, as described in detail earlier in the first preferred embodiment with reference to FIGS. 20 through 23.

Figure 46:
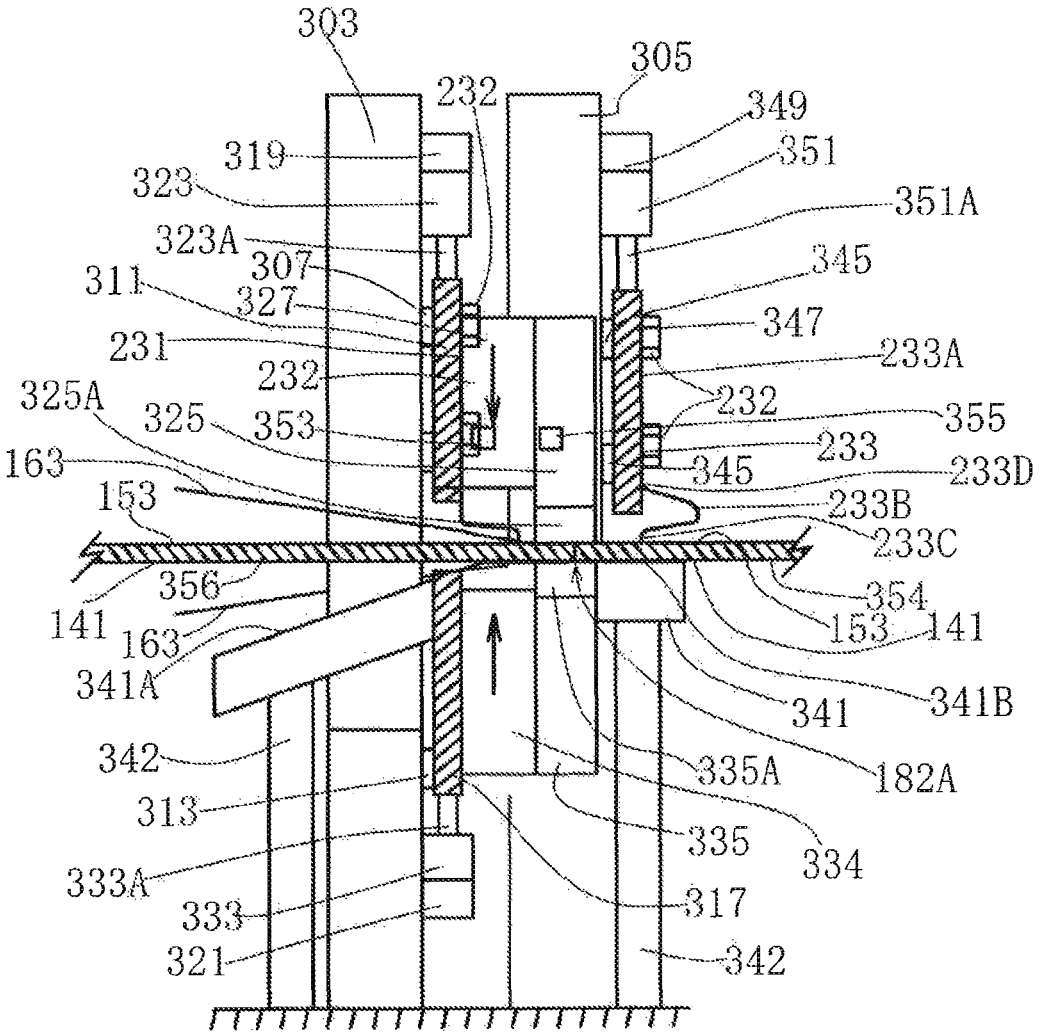

With further simultaneous extension of the piston rods 333A, the heaters 335A are moved into pressing contact with the lower surfaces of veneer sheets 354,356 across the prospective joint 182 through adhesive tapes 163. Subsequently, the upper heaters 325A are move into pressing contact with the upper surfaces of veneer sheets 354,356 across the prospective joint 182 through adhesive tape 163. The adhesive tapes 163 on opposite sided of veneer sheets 354, 356 are pressed and heated across the prospective joint 182 for a predetermined length of time, as shown in FIG. 46. As a result, a completed joint 182A is formed and the two veneer sheets 354, 356 are joined or integrated successfully.

Figure 47:
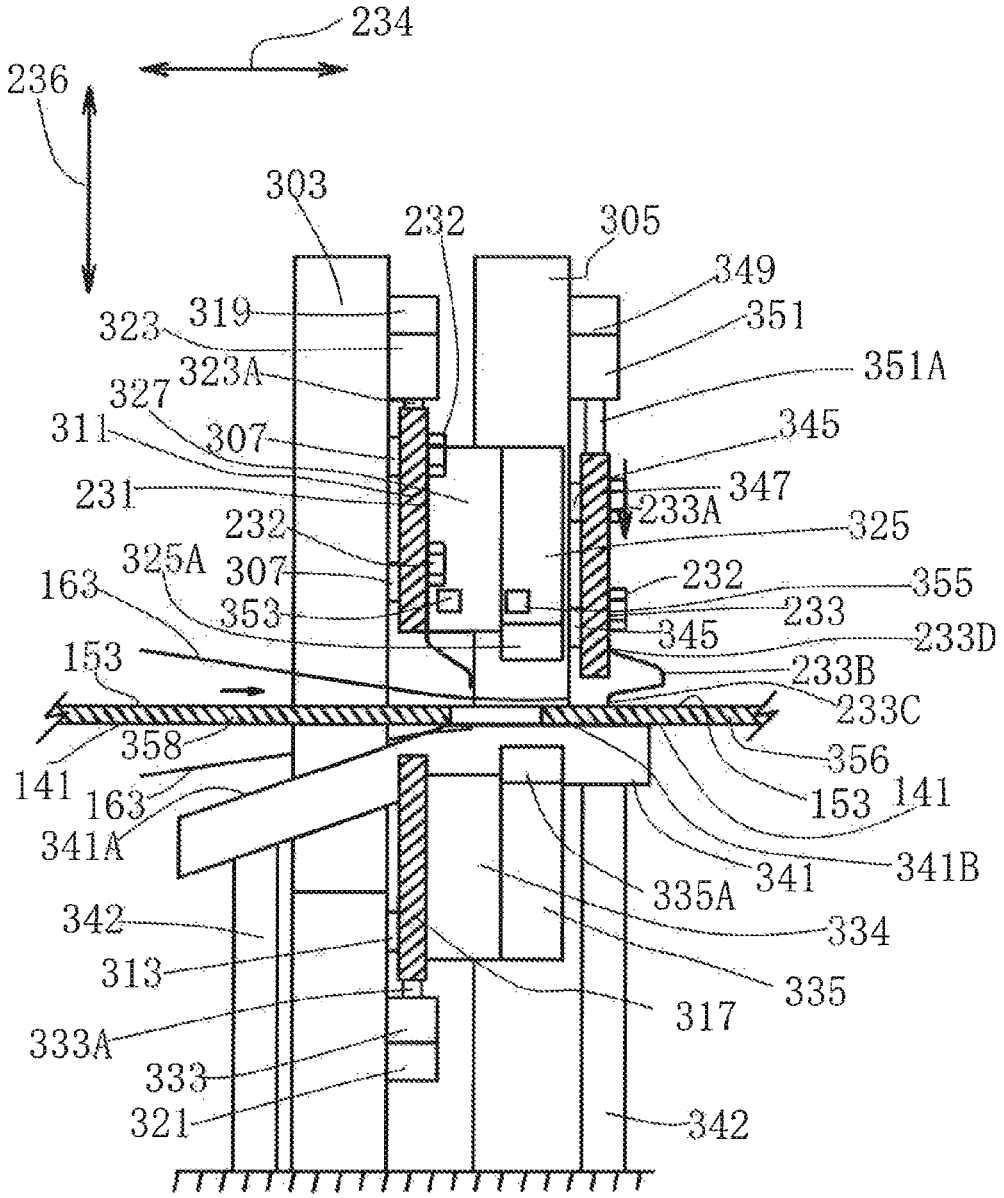

After an elapse of the predetermined length of time, the control 357 generates signals to actuate the air cylinders 323, 333, 351 to retract the piston rods 323A, 333A, 351A to the initial positions, respectively, as shown in FIG. 47. The integrated veneer sheet, which includes at least veneer sheets 354, 356, is transferred by the transferring conveyor belts 153, 141 rightward in the drawing. In the meantime, a new veneer sheet 358 is transferred as indicated by arrow in FIG. 47.

Figure 48:
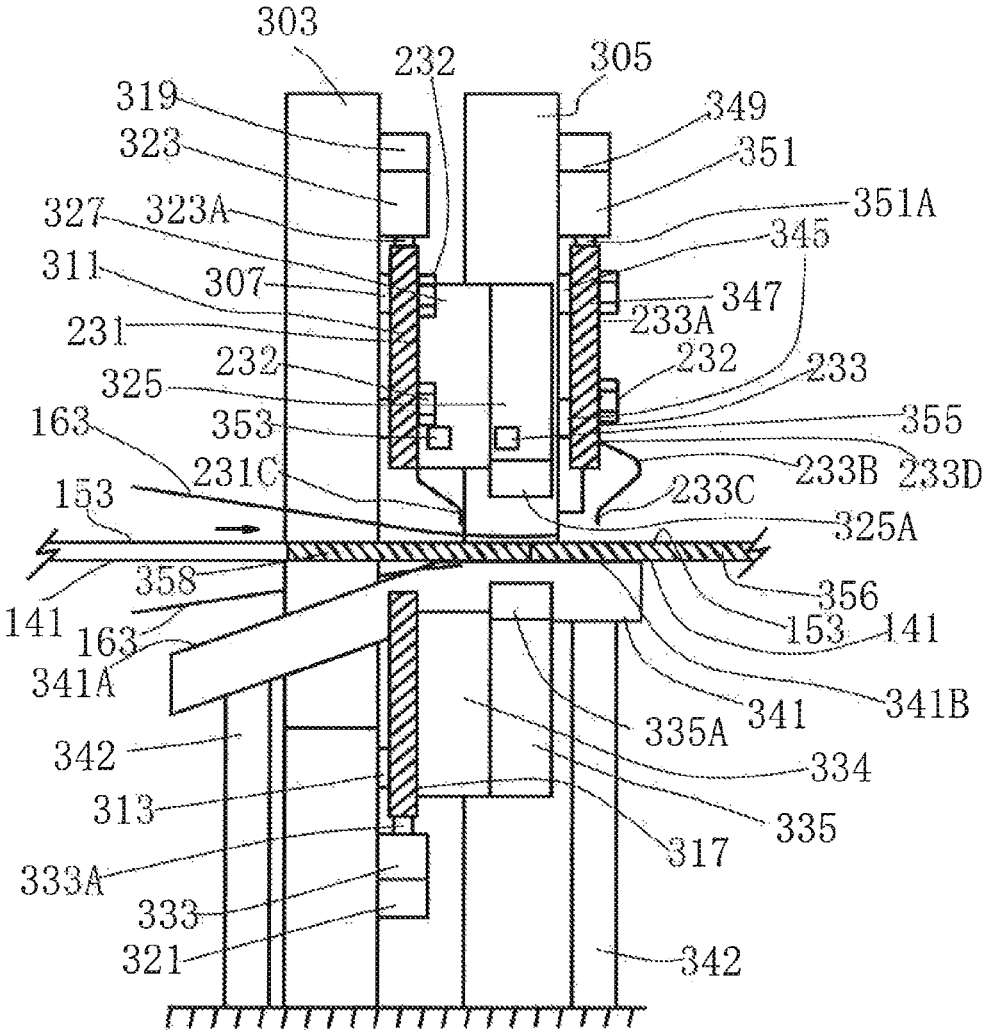

When the trailing edge of the integrated veneer sheet is detected by the second sensor 355, the control 357 responding to a detection signal from the sensor 355 actuates the air cylinders 351 to move the veneer holding leaf springs 233 to the position shown in FIG. 47 to stop the integrated veneer sheet. In this state, as the cut leading edge of the new veneer sheet 358 is detected by the first sensor 353, the control 357 responding to a detection signal from the sensor 353 causes the veneer moving apparatus to perform the same veneer moving operation as described above with reference to FIGS. 43, 44, 45 and 46. Thus, the veneer sheet 358 is integrated with the previously integrated veneer sheet, as shown in FIG. 48. For any new incoming veneer sheet, the above described steps of operation are performed repeatedly.

What is claimed is:

1. A veneer moving apparatus comprising, a plurality of first springs disposed spaced along a first direction of the apparatus and configured to move a first veneer sheet toward a stationary second veneer sheet in a second direction that is perpendicular to the first direction and parallel to surfaces of the first and the second veneer sheets;

a veneer support disposed below the first veneer sheet and the second veneer sheet and configured to support the first and the second veneer sheets at the bottom thereof; and at least one first actuator configured to move the first springs in a third direction that is perpendicular to the surfaces of the first and the second veneer sheets reciprocally toward and away from the first veneer sheet;

each of the first springs including a first leaf spring having a first end portion fixed to the at least one first actuator and a second end portion located opposite from the first end portion and closer to the first veneer sheet than the first end portion, and at least part of the first leaf spring being disposed extending obliquely from the first end portion toward the second veneer sheet with respect to an imaginary plane that extends parallel to the first direction and the third direction and passing through the first end portion; and the at least one first actuator being configured to cause each of the first leaf springs to move reciprocally along a straight path defined by the imaginary plane or a curved path lying on a side of the linear path that is adjacent to the second veneer sheet, between a first position where the second end portion of the first leaf spring is spaced away from the surface of the second veneer sheet and a second position where the second end portion of the first leaf spring is engaged with the second veneer sheet while the first end portion of the first leaf spring is spaced away from the surface of the first veneer sheet.

2. A veneer moving apparatus according to claim 1, wherein the second end portion of the first leaf spring has at a tip end thereof a plurality of sharpened portions.

3. A veneer moving apparatus according to claim 1, wherein the second end portion of the first leaf spring is formed extending in the third direction.

4. A veneer moving apparatus according to claim 1, further comprising, a plurality of second springs disposed spaced along the first direction of the apparatus and downstream of the respective first leaf springs with respect to the direction in which the first veneer sheet is moved toward the second veneer sheet and configured to hold the second veneer sheet; and at least one second actuator configured to move each of the second springs reciprocally in the third direction toward and away from the second veneer sheet;

each of the second springs having a first end portion fixed to the at least one second actuator and a second end portion located opposite from the first end portion of the second spring and closer to the second veneer sheet than the first end portion of the second spring, and the first end portion and the second portion of each second spring being aligned in the third direction;

the at least one second actuator being configured to cause each of the second springs to move reciprocally between a first position where the second end portion of the second spring is spaced away from the surface of the second veneer sheet and a second position where the second end portion of the second spring is engaged with the surface of the second veneer sheet.

5. A veneer moving apparatus according to claim 4, wherein each of the second springs includes a second leaf spring having an intermediate curved compressible portion between the first end portion and the second end portion of the second leaf spring.

6. A veneer moving apparatus according to claim 4, wherein each of the second springs includes a compression spring disposed extending in the third direction.

7. A veneer moving apparatus according to claim 4, further comprising a first sensor that is configured to determine operation timing of the at least one first actuator.

8. A veneer moving apparatus according to claim 4, further comprising a second sensor that is configured to determine operation timing of the at least one second actuator.

* * * * *